US011186996B2

(12) United States Patent
Springborn

(10) Patent No.: US 11,186,996 B2
(45) Date of Patent: Nov. 30, 2021

(54) FRICTION PICKET SYSTEM

(71) Applicant: Russell H. Springborn, Howell, MI (US)

(72) Inventor: Russell H. Springborn, Howell, MI (US)

( * ) Notice: Subject to any disclaimer, the term of this patent is extended or adjusted under 35 U.S.C. 154(b) by 163 days.

(21) Appl. No.: 16/723,764

(22) Filed: Dec. 20, 2019

(65) Prior Publication Data

US 2020/0199882 A1 Jun. 25, 2020

Related U.S. Application Data

(60) Provisional application No. 62/783,854, filed on Dec. 21, 2018.

(51) Int. Cl.
*E04F 11/18* (2006.01)
*E04H 17/14* (2006.01)

(52) U.S. Cl.
CPC ..... *E04F 11/1817* (2013.01); *E04F 11/1838* (2013.01); *E04F 2011/1821* (2013.01); *E04H 17/143* (2013.01); *E04H 17/1417* (2013.01); *E04H 17/1447* (2021.01); *E04H 17/1482* (2021.01)

(58) Field of Classification Search
CPC ..... E04F 11/181; E04F 11/1817; E04F 2011/1823; E04F 2011/1825; E04F 2011/1827; E04H 17/1413; E04H 17/1417; E04H 17/1426; E04H 17/1439; E04H 17/1447; E04H 17/1478; E04H 17/1482
See application file for complete search history.

(56) References Cited

U.S. PATENT DOCUMENTS

| | | | | |
|---|---|---|---|---|
| 6,375,166 | B1 * | 4/2002 | Schall | E04H 17/1439 256/21 |
| 9,482,028 | B2 | 11/2016 | Springborn | |
| D782,697 | S * | 3/2017 | Bizzarri | E04H 17/1447 D25/38.1 |
| 9,695,612 | B2 * | 7/2017 | Batts, III | E04H 17/1439 |
| 9,797,158 | B2 | 10/2017 | Springborn | |
| 9,908,207 | B2 | 3/2018 | Springborn | |
| 10,081,950 | B2 * | 9/2018 | Bizzarri | E04F 11/1836 |
| 10,487,534 | B2 | 11/2019 | Springborn | |
| 10,697,199 | B2 * | 6/2020 | Hellenbrand | E04H 17/1439 |
| 10,975,593 | B2 * | 4/2021 | Walker | E04H 17/1439 |
| 11,015,365 | B2 * | 5/2021 | Loucks | E04F 11/1834 |
| 2015/0252570 | A1 | 9/2015 | Springborn | |

(Continued)

*Primary Examiner* — Jonathan P Masinick
(74) *Attorney, Agent, or Firm* — Dykema Gossett PLLC

(57) ABSTRACT

A unitary railing portion for a railing assembly may include a top portion, a bottom portion, a first side portion, and a second side portion. At least one aperture in the unitary railing portion may be configured for inserting a baluster along an axis of insertion between the first side portion and the second side portion. A channel may be extended from the first side portion and a cantilevered arm may be extended from the second side portion. A retaining element may be disposed at least partially in the channel. The retaining element and the cantilevered arm may be configured to retain the baluster relative to the unitary railing portion. In some examples, the unitary railing portion may be included in a railing assembly. The railing assembly may include at least one unitary railing portion and at least one baluster inserted into the unitary railing portion.

20 Claims, 51 Drawing Sheets

(56) References Cited

U.S. PATENT DOCUMENTS

| | | | | |
|---|---|---|---|---|
| 2015/0300041 | A1* | 10/2015 | Feeko | E04H 17/1417<br>256/65.12 |
| 2017/0370121 | A1* | 12/2017 | Lindsay | E04F 11/1817 |
| 2019/0177997 | A1* | 6/2019 | Springborn | E04H 17/1417 |

* cited by examiner

FRICTION PICKET SYSTEM

CROSS-REFERENCE TO RELATED APPLICATIONS

This application claims the benefit of U.S. provisional application No. 62/783,854, filed 21 Dec. 2018, which is hereby incorporated by reference as though fully set forth herein.

Additionally, this application is related to (a) U.S. nonprovisional patent application Ser. No. 15/786,292, filed 17 Oct. 2017 (the '292 application), now pending, which is a continuation of U.S. nonprovisional patent application Ser. No. 15/246,992, filed 25 Aug. 2016 (the '992 application), now U.S. Pat. No. 9,797,158, issued 24 Oct. 2017, which is a continuation-in-part of U.S. nonprovisional patent application Ser. No. 15/041,663, filed 11 Feb. 2016 (the '663 application), now U.S. Pat. No. 9,482,028, issued 1 Nov. 2016, which claims priority to U.S. provisional patent application No. 62/115,004, filed 11 Feb. 2015 (the '004 application), now abandoned; (b) U.S. nonprovisional patent application Ser. No. 14/639,570, filed 5 Mar. 2015 (the '570 application) and published 10 Sep. 2015 as publication no. US 2015/0252570 A1, now abandoned, which claims priority to U.S. provisional patent application No. 61/948,523, filed 5 Mar. 2014 (the '523 application), now abandoned; and (c) U.S. nonprovisional patent application Ser. No. 14/639,562, filed 5 Mar. 2015 (the '562 application), now U.S. Pat. No. 9,908,207, issued 6 Mar. 2018, which claims priority to U.S. provisional patent application No. 61/948,545, filed 5 Mar. 2014 (the '545 application), now abandoned. The '292 application, the '992 application, the '663 application, the '004 application, the '570 application, the '523 application, the '562 application, and the '545 application are all hereby incorporated by reference in their entireties as though fully set forth herein.

TECHNICAL FIELD

This instant disclosure relates generally to an apparatus for connecting one or more balusters/pickets to a rail of a railing and/or a fence.

BACKGROUND

Conventional railing designs often require a discrete fastener, such as a bolt or a screw to connect a baluster to a rail or a fence. Relative to a design that does not require a discrete fastener, assembling and/or manufacturing railings or fences that require such discrete fasteners may require additional time, cost, larger shipping containers/packaging, and/or effort, which may be associated with centering components, measuring distances between balusters, locating drilling locations, drilling holes, and/or driving fasteners into the holes. A design that may eliminate and/or simplify one or more of the above activities from an assembly process may be desirable.

SUMMARY

A unitary railing portion for a railing assembly may include a top portion, a bottom portion, a first side portion, and a second side portion. At least one aperture in the unitary railing portion may be configured for inserting a baluster along an axis of insertion between the first side and the second side. A channel may be extended from the first side portion and a cantilevered arm may be extended from the second side portion. A retaining element may be disposed at least partially in the channel. The retaining element and the cantilevered arm, in combination, may be configured to retain the baluster relative to the unitary railing portion.

The unitary railing portion may be configured to frictionally engage the baluster between the retaining element and a distal end of the cantilevered arm. In some examples, the unitary railing portion may include a structural beam extended across a lateral cross section of the unitary railing portion from the first side to the second side. In an example, the unitary railing portion may include a support rib extended from the second side. The support rib may be located between the cantilevered arm and the top portion. The support rib may be configured to provide lateral stiffness to the unitary railing portion and configured to support the baluster within the unitary railing portion. In an example, the support rib may be configured to limit an amount of deflection of the cantilevered arm when the baluster is inserted into the unitary railing portion. In some examples, the top portion, the bottom portion, the first side portion, the second side portion, the channel, and the cantilevered arm may be a single-piece.

In an example, the distal end of cantilevered arm may include a force concentration edge configured to frictionally engage the baluster. In another example, the cantilevered arm may be disposed at an angle with respect to the axis of insertion of the baluster. The angle and a length of the cantilevered arm may be configured to be biased by insertion of the baluster to exert force on the baluster. In an example, the cantilevered arm may be configured to bend with respect to the unitary railing portion. In a further example, the cantilevered arm may be configured to bend in a first direction to provide clearance for the baluster when inserted and may be configured to bend in an opposing second direction to increase the frictional engagement between the baluster and the unitary railing portion upon withdrawal of the baluster.

In some examples, the unitary railing portion may be included in a railing assembly. The railing assembly may include at least one unitary railing portion and at least one baluster inserted into the unitary railing portion. The railing assembly may include a first unitary railing portion, a first channel, a cantilevered arm, a retaining element, and a baluster. The first unitary railing portion may include a top portion, a bottom portion, a first side portion, and a second side portion. The bottom portion may include at least one aperture configured for inserting a baluster along an axis of insertion between the first side and the second side. A first channel may be extended from the first side portion, and a cantilevered arm may be extended from the second side portion. A retaining element may be disposed at least partially in the first channel. The baluster may include a first end and a second end. The first end may be located through the aperture and frictionally engaged between the retaining element and the cantilevered arm.

The first unitary railing portion may be configured to frictionally engage the baluster between the retaining element and a distal end of the cantilevered arm. In some examples, the first unitary railing portion may include a structural beam extended across a lateral cross section of the first unitary railing portion from the first side to the second side. In an example, the first unitary railing portion may include a support rib extended from the second side. The support rib may be located between the cantilevered arm and the top portion. The support rib may be configured to provide lateral stiffness to the first unitary railing portion and configured to support the baluster within the first unitary railing portion. In an example, the support rib may be configured to limit an amount of deflection of the cantilevered arm when the baluster is inserted into the first unitary railing portion. In some examples, the top portion, the bottom portion, the first side portion, the second side portion, the channel, and the cantilevered arm may be a single-piece.

In an example, the distal end of the cantilevered arm may include a force concentration edge configured to frictionally engage the baluster. In another example, the cantilevered arm may be disposed at an angle with respect to the axis of insertion of the baluster. The angle and a length of the cantilevered arm may be configured to be biased by insertion of the baluster to exert force on the baluster. In an example, the cantilevered arm may be configured to bend with respect to the first unitary railing portion. In a further example, the cantilevered arm may be configured to bend in a first direction to provide clearance for the baluster when inserted and may be configured to bend in an opposing second direction to increase the frictional engagement between the baluster and the first unitary railing portion upon withdrawal of the baluster.

In some examples, the railing assembly may further include a second unitary railing portion. The second unitary railing portion may include a second channel disposed on a side portion of the second unitary railing portion. A retaining element may be disposed in the second channel, and a second cantilevered arm extended from an opposing side of the second unitary railing portion. The baluster may be located through an aperture of the second unitary railing portion and may be frictionally engaged between the second retaining element and the second cantilevered arm.

Additional features, advantages, and embodiments may be set forth or become apparent from consideration of the following detailed description and drawings. Moreover, it is to be understood that both the foregoing summary and the following detailed description are exemplary only and intended to provide explanation without limiting the scope of the disclosure as claimed.

BRIEF DESCRIPTION OF THE DRAWINGS

The accompanying drawings, which are included to provide a further understanding are incorporated in and constitute a part of this specification, illustrate preferred embodiments and, together with the detailed description, serve to explain the principles of embodiments of the disclosure. In the drawings.

DETAILED DESCRIPTION

Figure 1A:
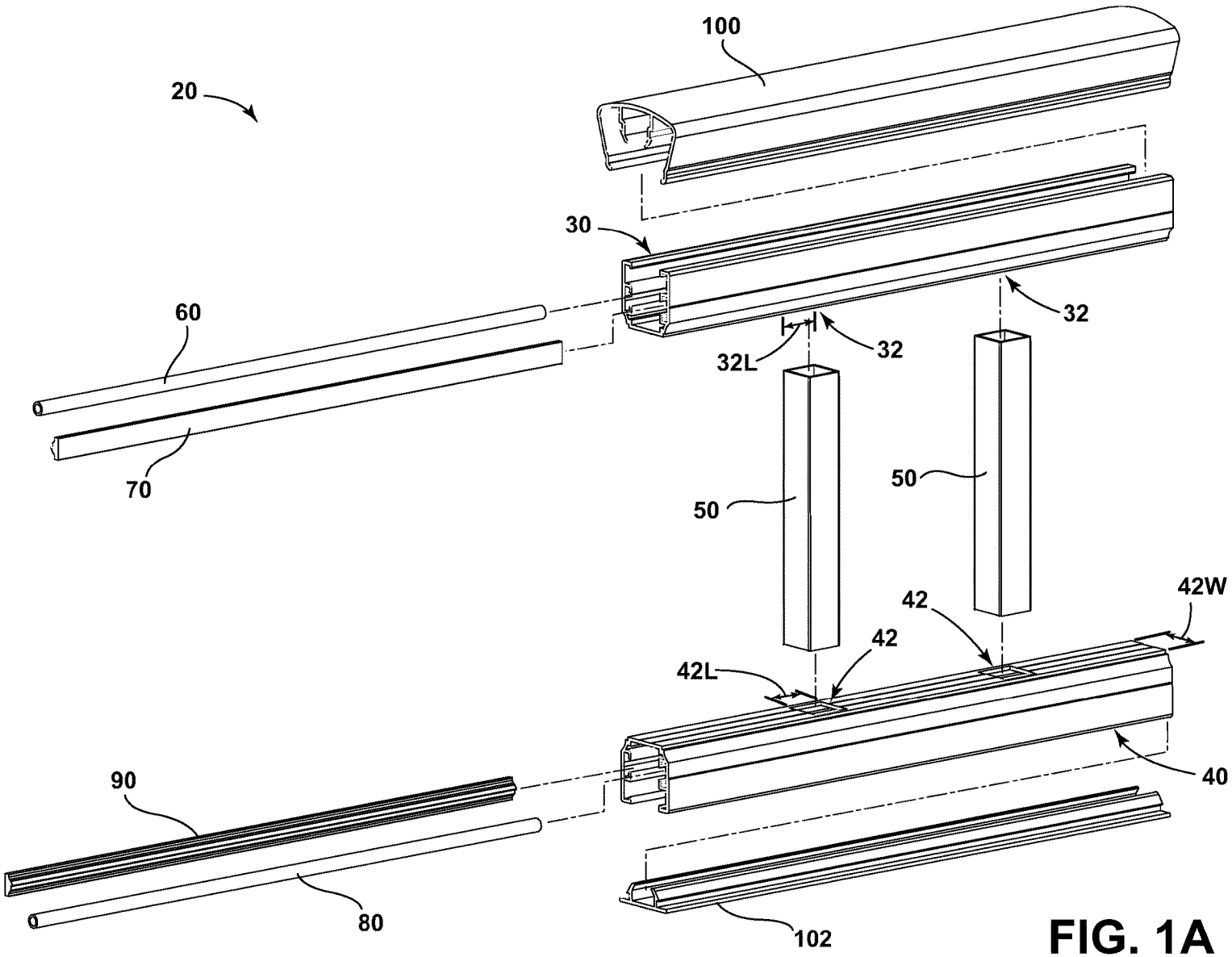
FIGS. 1A-1D depict exploded views generally illustrating portions of embodiments of a friction picket system in accordance with teachings of the present disclosure.
Figure 1B:
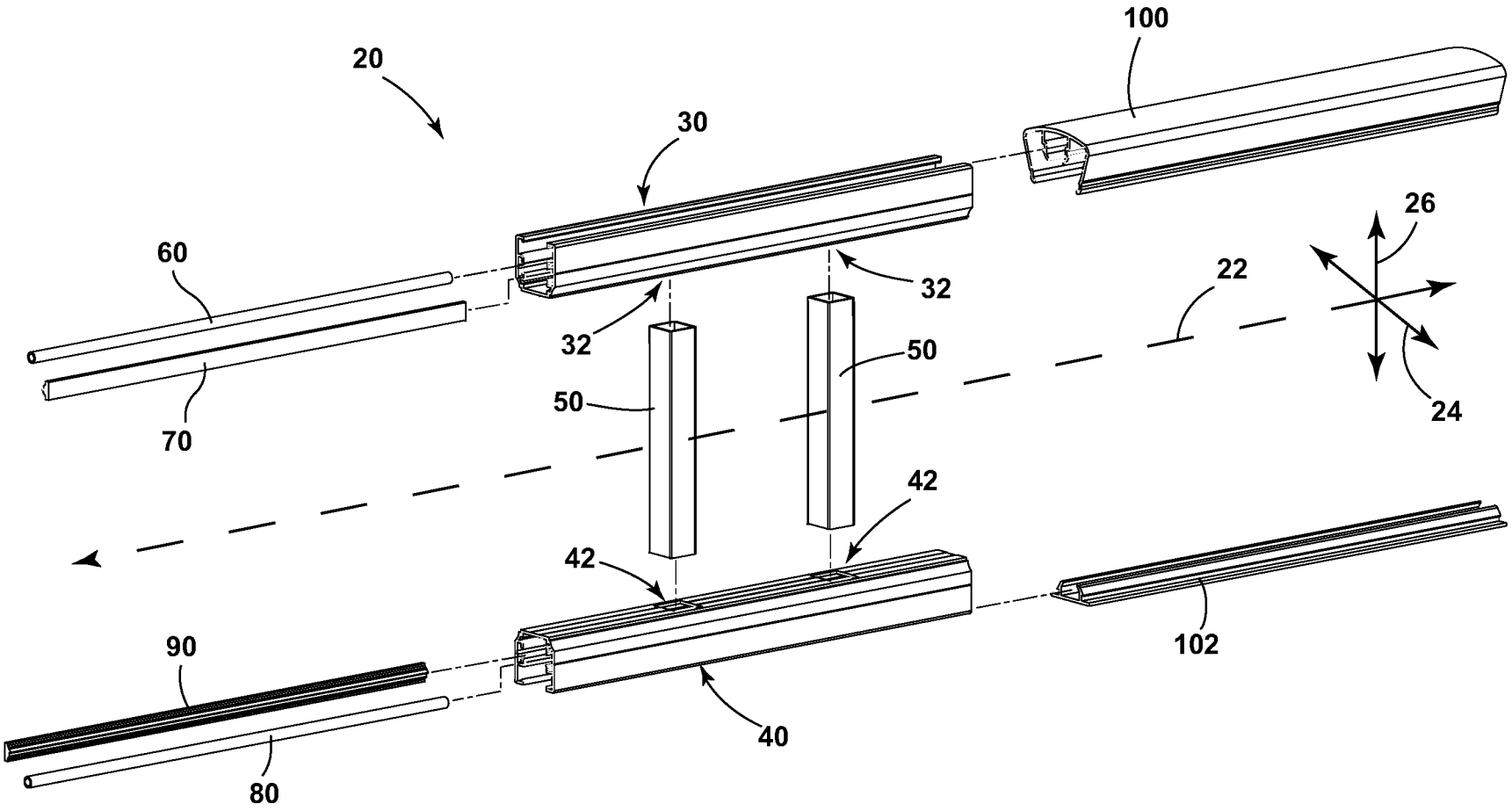

Reference will now be made in detail to embodiments of the present disclosure, examples of which are described herein and illustrated in the accompanying drawings. While the disclosure will be described in conjunction with embodiments, it will be understood that they are not intended to limit the disclosure to these embodiments. On the contrary, the disclosure is intended to cover alternatives, modifications and equivalents, which may be included within the spirit and scope of the disclosure.

In embodiments, such as generally illustrated in FIGS. 1A, 1B, 1C, and 1D, a railing assembly 20 (e.g., a friction picket system) may include a first railing portion 30, a second railing portion 40, and/or one or more balusters/pickets 50 that may extend between the first railing portion 30 and the second railing portion 40. A baluster 50 may be inserted into a corresponding aperture 32 of first railing portion 30 and/or into a corresponding aperture 42 of second railing portion 40. The corresponding apertures 32, 42 may include one or more of a variety of shapes sizes, and/or configurations. For example, and without limitation, corresponding apertures 32, 42 may include a generally rectangular and/or elongated shape that may correspond to the shape of the baluster 50. In embodiments, first railing portion 30 may be disposed generally above second railing portion 40, and one or more balusters 50 may support first railing portion 30.

Figure 2:
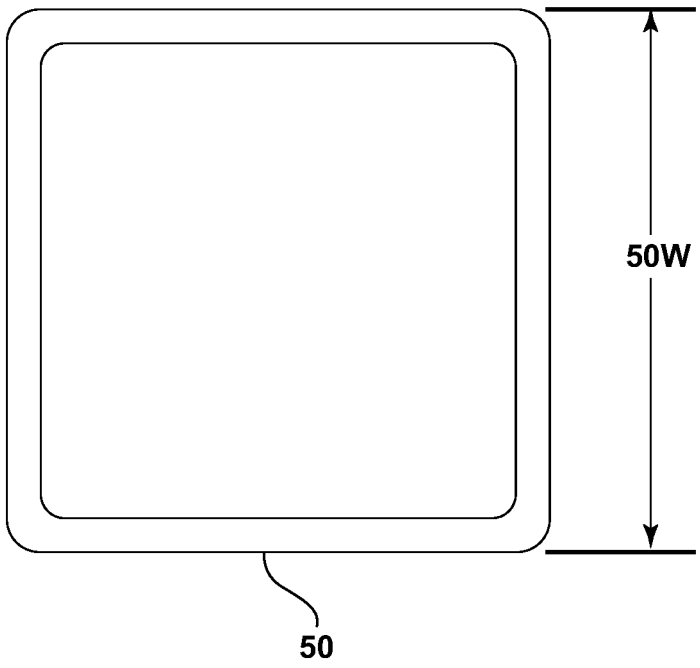
FIG. 2 illustrates a cross-sectional view of an embodiment of a baluster in accordance with teachings of the present disclosure.

In embodiments, such as generally illustrated in FIG. 2, a baluster 50 may include a generally square cross-section and corresponding apertures 32, 42 may include widths 32W, 42W (e.g., perpendicular to a longitudinal axis 22 of railing assembly 20) that are about the same as and/or slightly larger than the widths 50W of walls of the baluster 50 (e.g., a clearance fit). In embodiments, and for example only, widths 50W of the walls of the baluster 50 may be about ¾ of one inch, which may include being about 0.744 inches wide. In embodiments, corresponding apertures 32, 42 of first railing portion 30 and second railing portion 40, respectively, may include lengths 32L, 42L (e.g., which may be generally aligned with longitudinal axis 22) that are longer than the width 50W of the walls of baluster 50, which may allow for the baluster 50 to rotate relative to first railing portion 30 and/or relative to second railing portion 40 about an axis 24 that may be perpendicular to longitudinal axis 22 (e.g., apertures 32, 42 may be elongated in a direction generally parallel to longitudinal axis 22). In embodiments, the lengths 32L, 42L of corresponding apertures 32, 42 of first railing portion 30 and/or second railing portion 40 may allow for first railing portion 30 and/or second railing portion 40 to rotate relative to baluster 50.

Figure 3A:
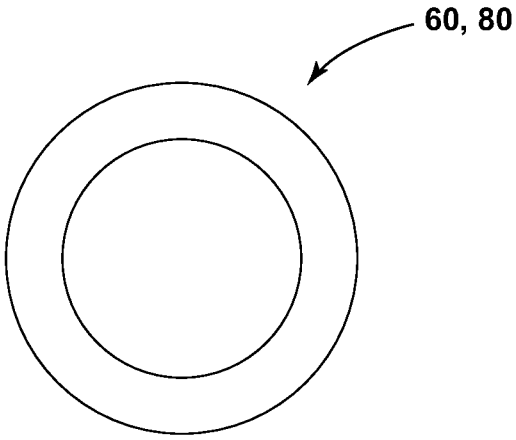
FIG. 3A illustrates a cross-sectional view of an embodiment of a retaining element in accordance with teachings of the present disclosure.

In embodiments, such as generally illustrated in FIGS. 1A, 1B, 1C, 1D, 3A, 3B, 3C, 4A, 4B, 5A, 5B, 6A, 6B, and 6C, first railing portion 30 and/or second railing portion 40 may include one or more retaining elements (e.g., retaining elements 60, 70, 80, 90, 160, 180, 260, 280). For example, and without limitation, first railing portion 30 may include a first retaining element 60 and/or a second retaining element 70, and second railing portion 40 may include a first retaining element 80 and/or a second retaining element 90 (see, e.g., FIGS. 1A, 1B, and 3A). Additionally or alternatively, first railing portion 30 may include first retaining element 160 and/or second retaining element 70, and second railing portion 40 may include first retaining element 180 and/or second retaining element 90 (see, e.g., FIGS. 1C, 1D, and 3B). The first retaining elements 60, 80 and/or the second retaining elements 70, 90 may be configured to help retain one or more balusters 50 relative to respective railing portions 30, 40 once the baluster(s) 50 has been inserted into one or more corresponding apertures 32, 42.

Figure 1C:
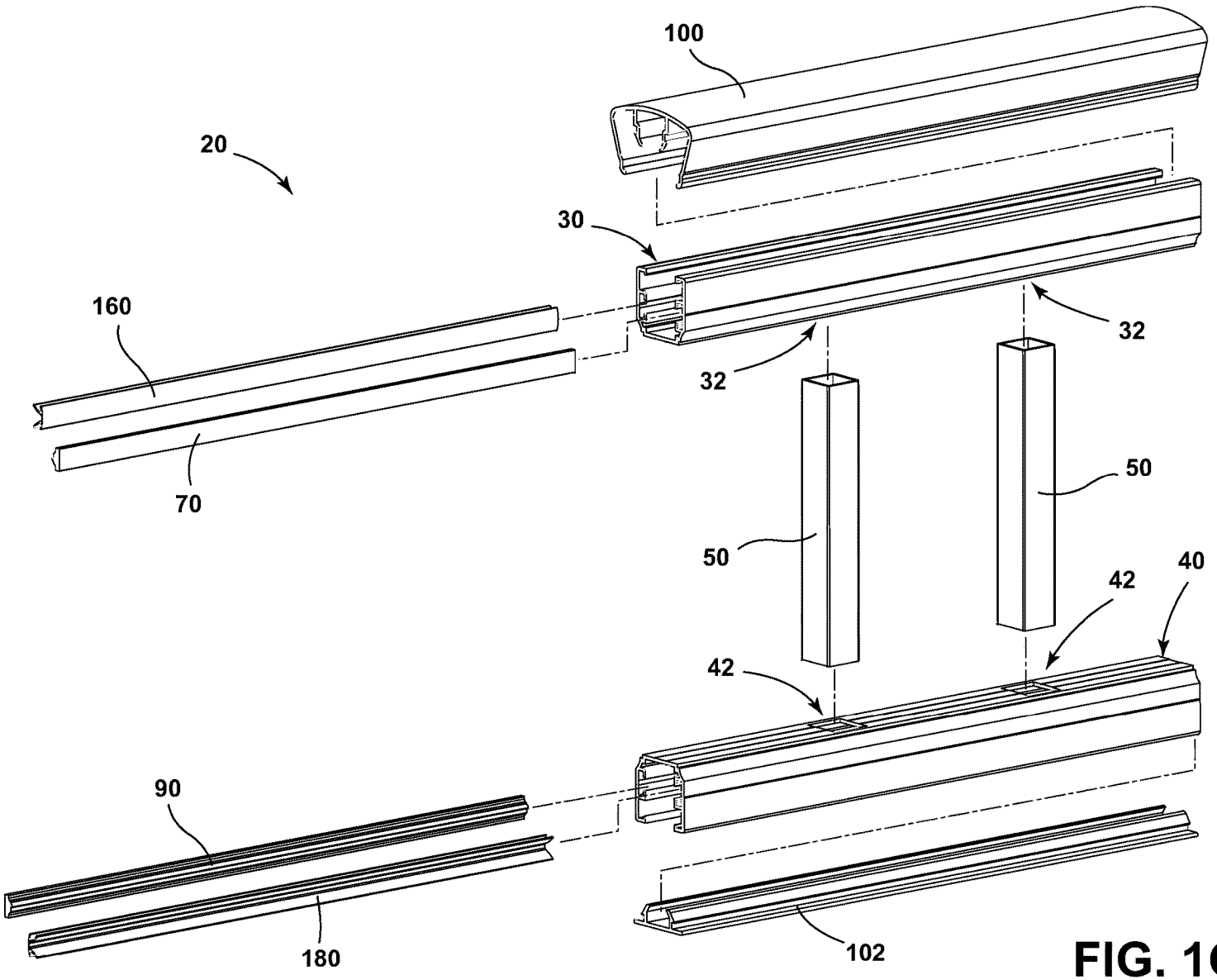
Figure 1D:
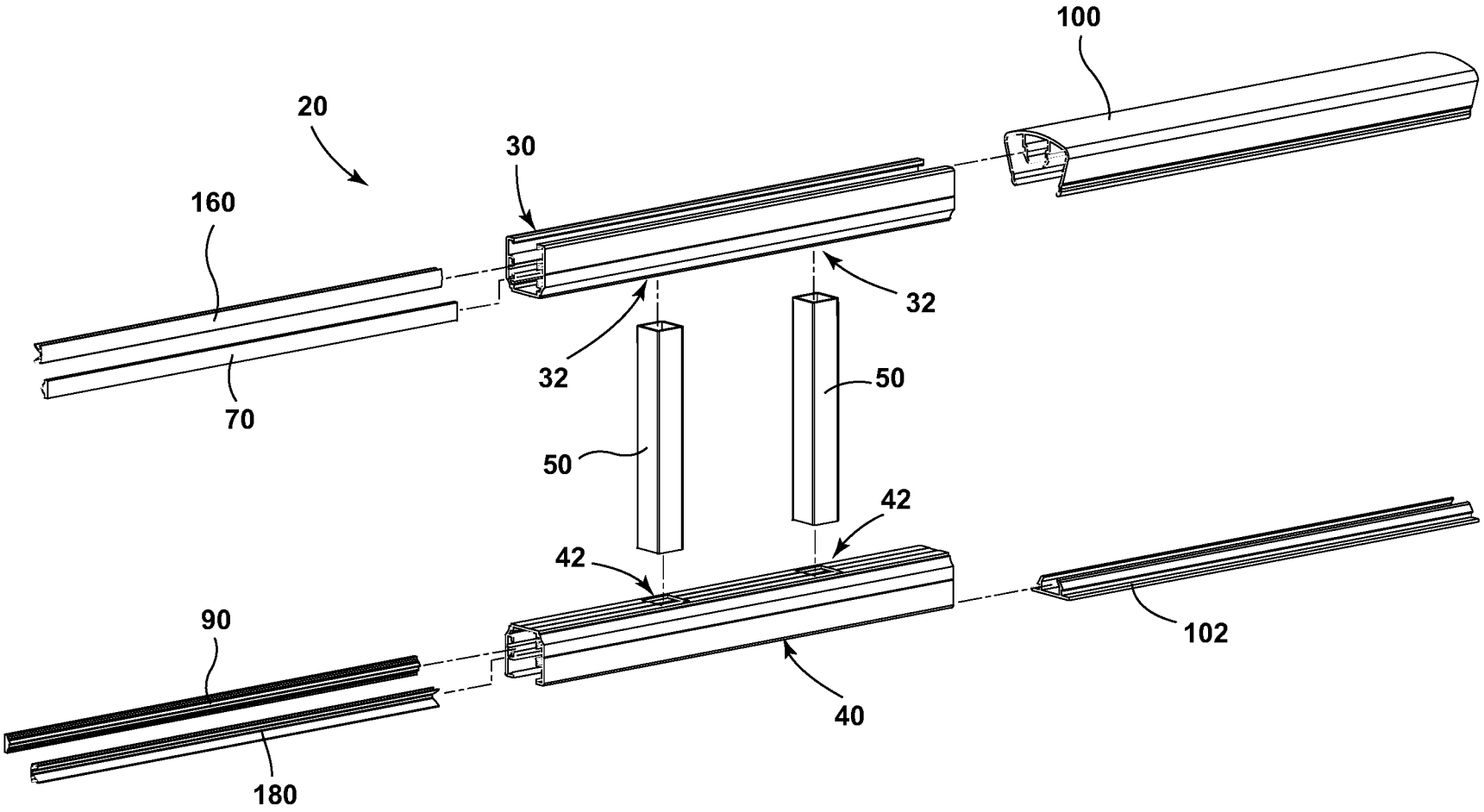
Figure 3B:
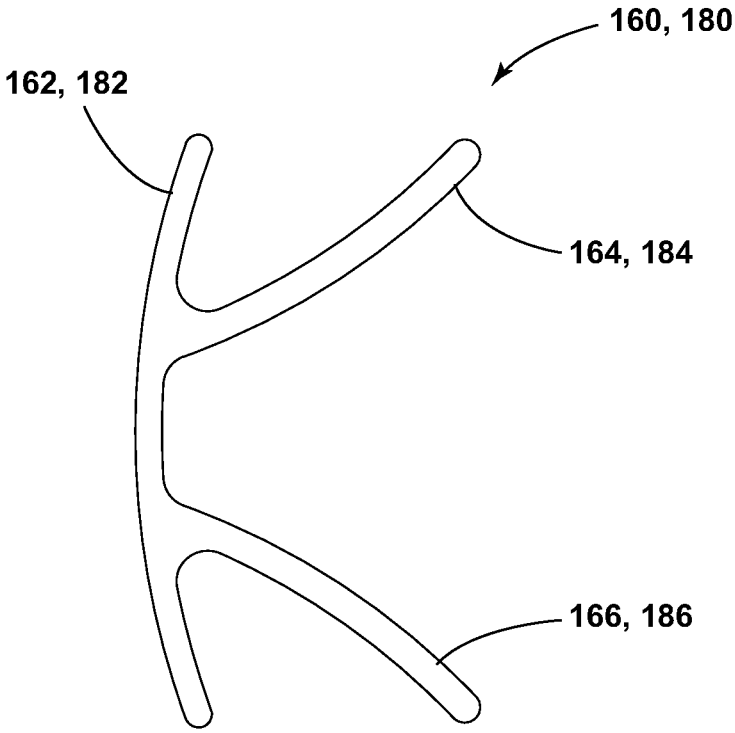
FIG. 3B depicts a cross-sectional view of an embodiment of a retaining element in accordance with teachings of the present disclosure.
Figure 3C:
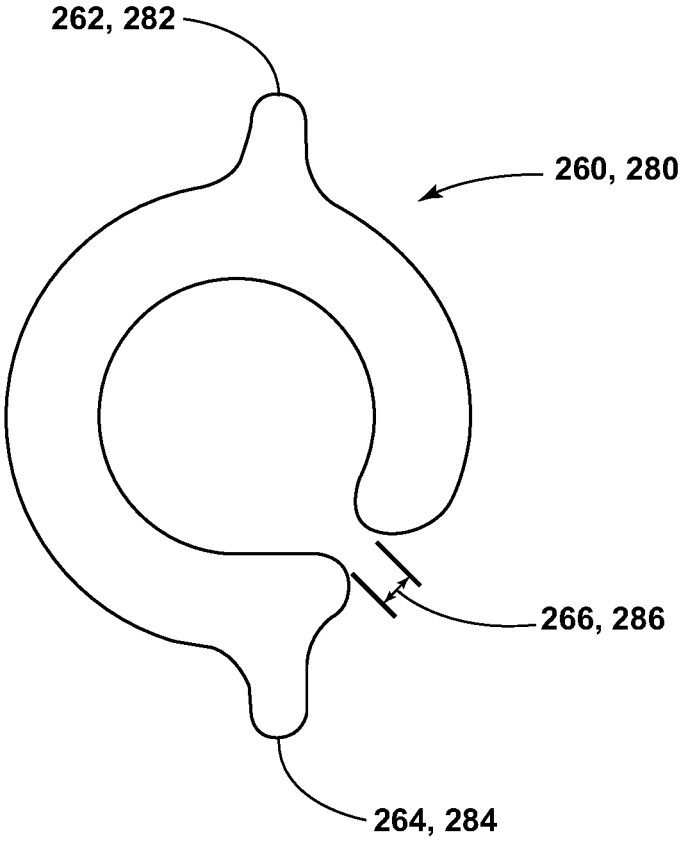
FIG. 3C illustrates a cross-sectional view of an embodiment of a retaining element in accordance with teachings of the present disclosure.
Figure 4A:
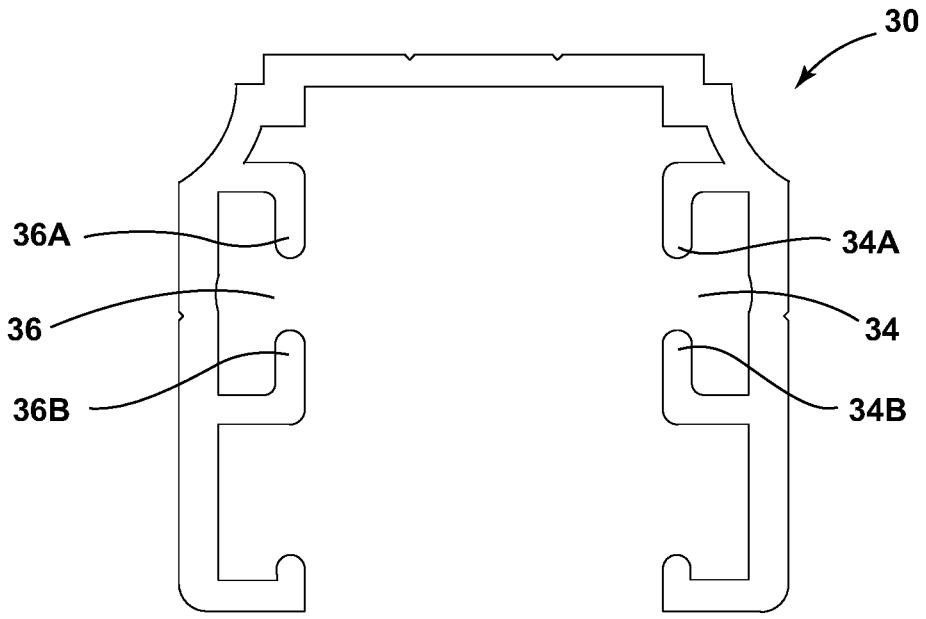
FIG. 4A depicts a cross-sectional view of an embodiment of a first railing portion in accordance with teachings of the present disclosure.
Figure 4B:
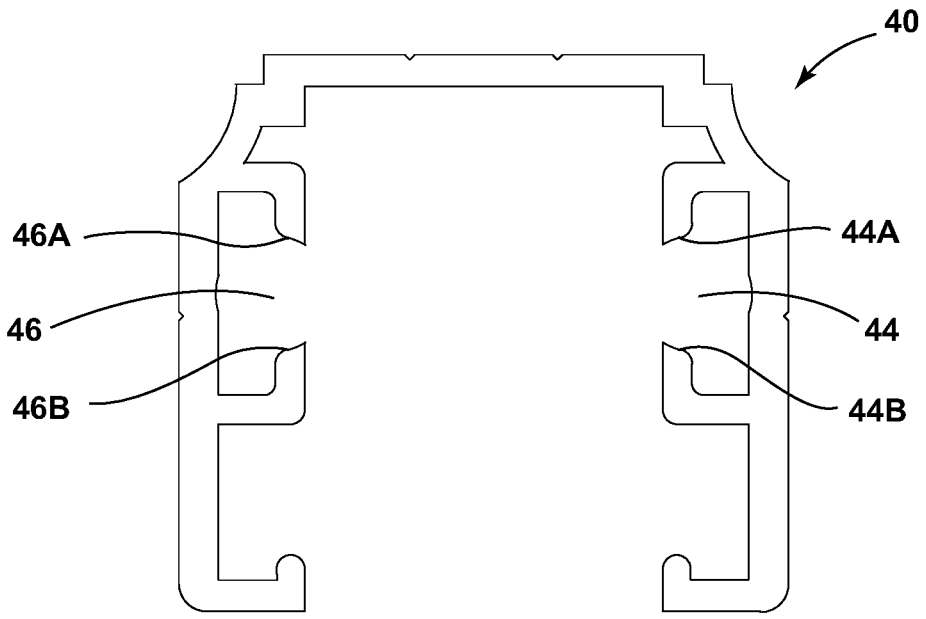
FIG. 4B depicts a cross-sectional view of an embodiment of a second railing portion in accordance with teachings of the present disclosure.
Figure 5A:
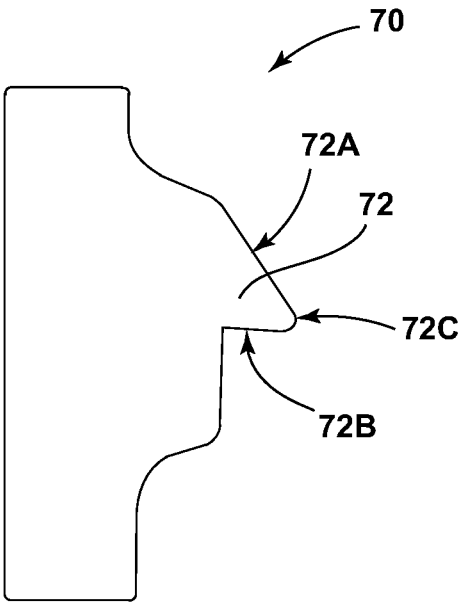
FIGS. 5A and 5B illustrate cross-sectional views of embodiments of retaining elements in accordance with teachings of the present disclosure.
Figure 5B:
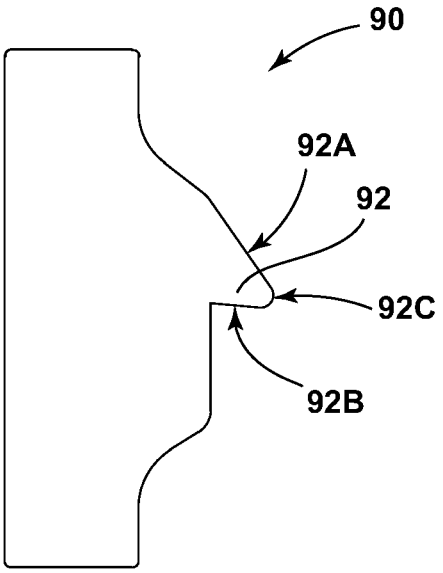
Figure 6A:
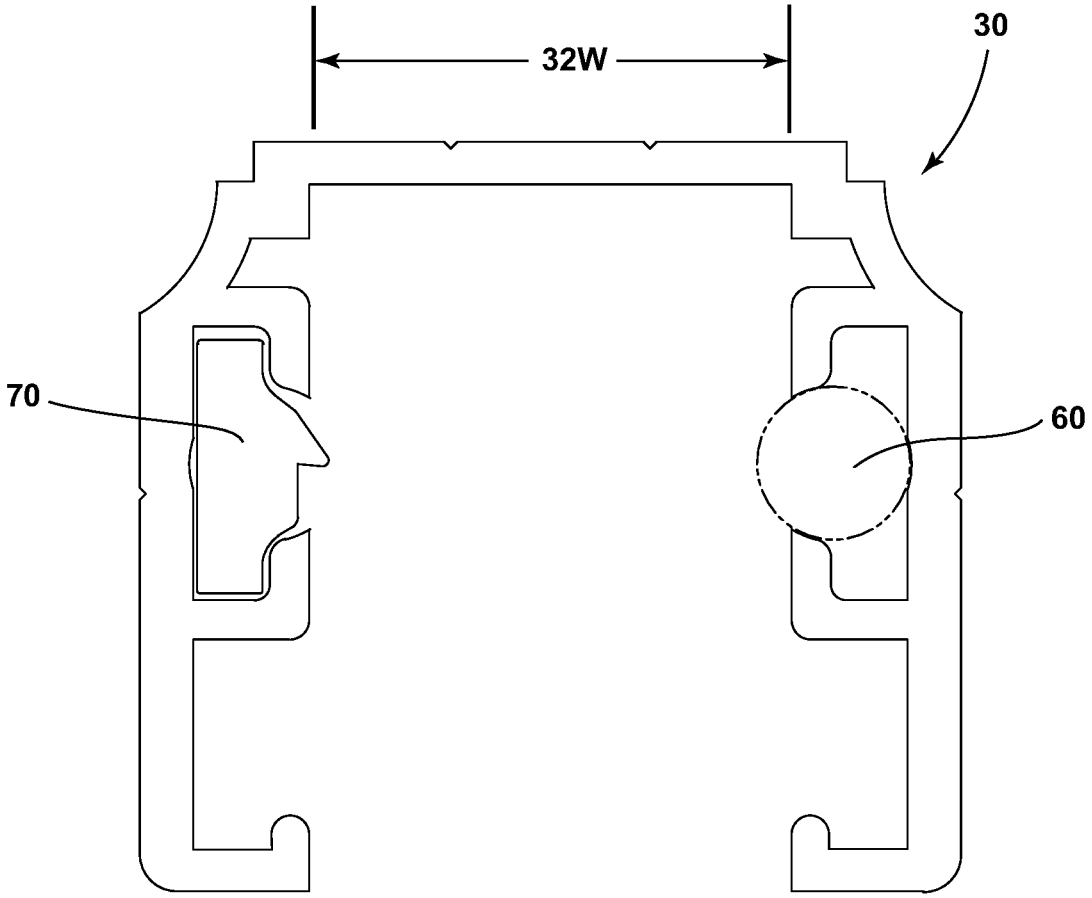
FIG. 6A depicts a cross-sectional view of embodiments of a railing portion, retaining elements, and a baluster in accordance with teachings of the present disclosure.
Figure 6B:
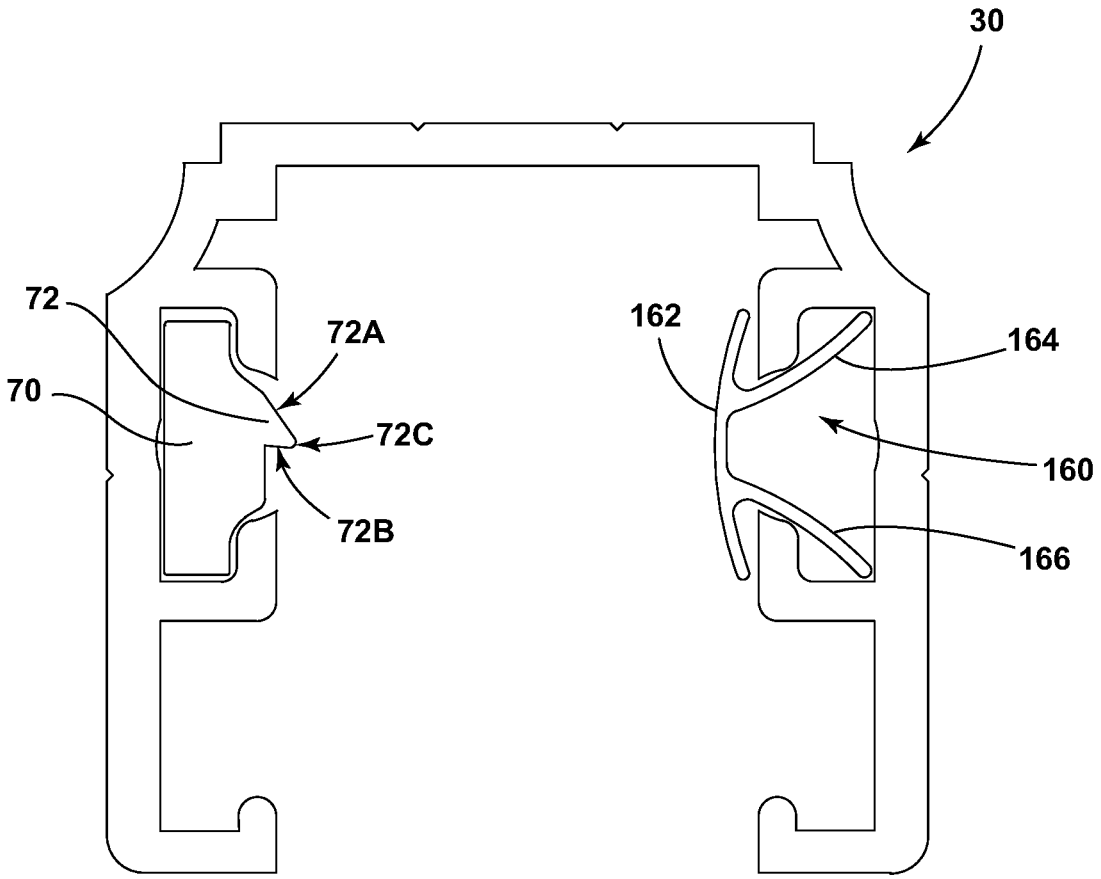
FIG. 6B illustrates a cross-sectional view of embodiments of a railing portion and retaining elements in accordance with teachings of the present disclosure.
Figure 6C:
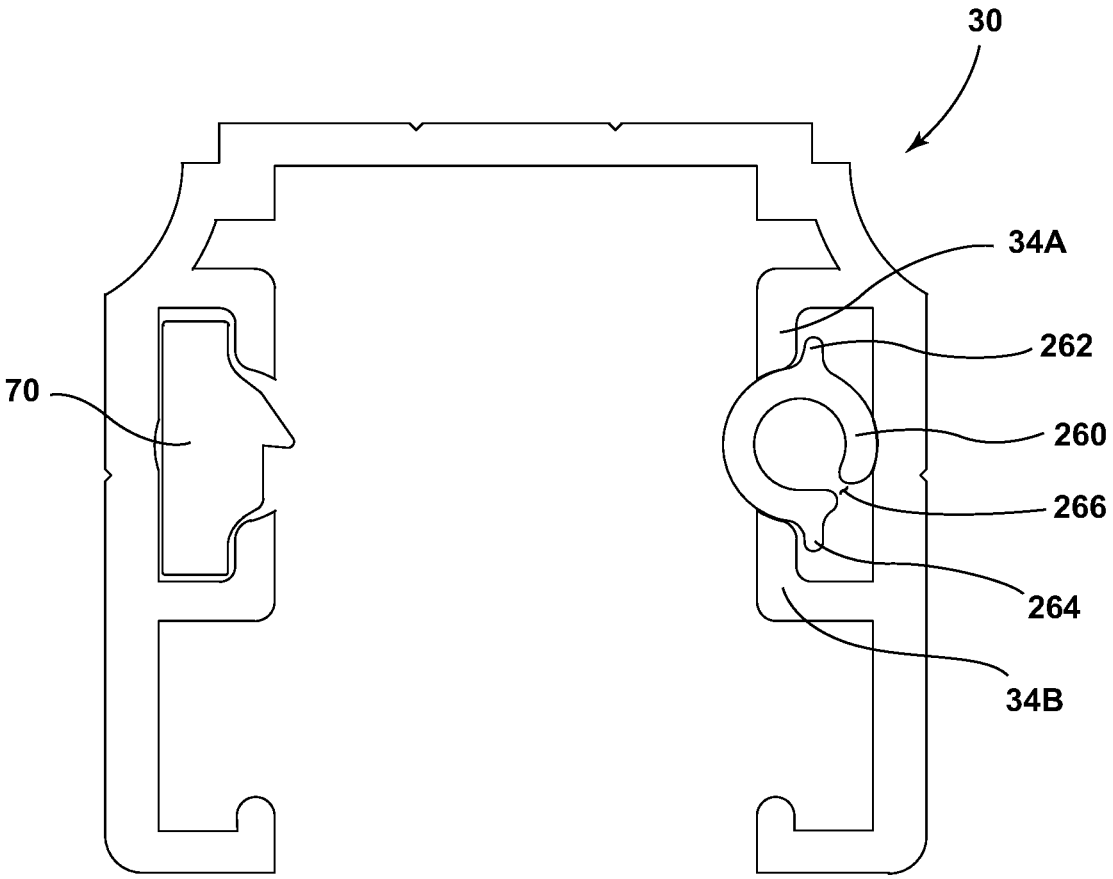
FIG. 6C illustrate a cross-sectional view of embodiments of a railing portion and retaining elements in accordance with teachings of the present disclosure.
Figure 7A:
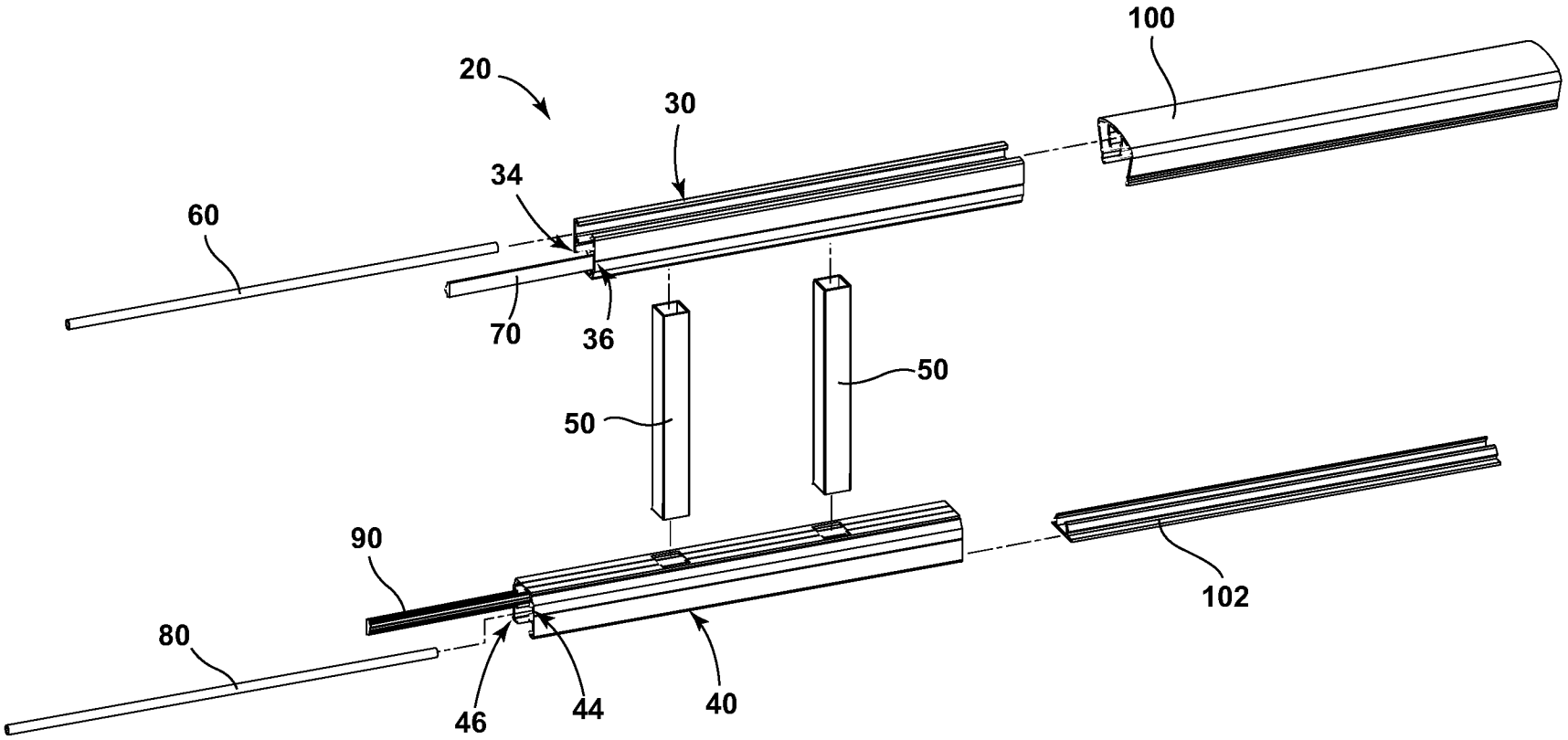
FIGS. 7A-9B depict exploded perspective views generally illustrating portions of embodiments of a friction picket system in accordance with teachings of the present disclosure.
Figure 7B:
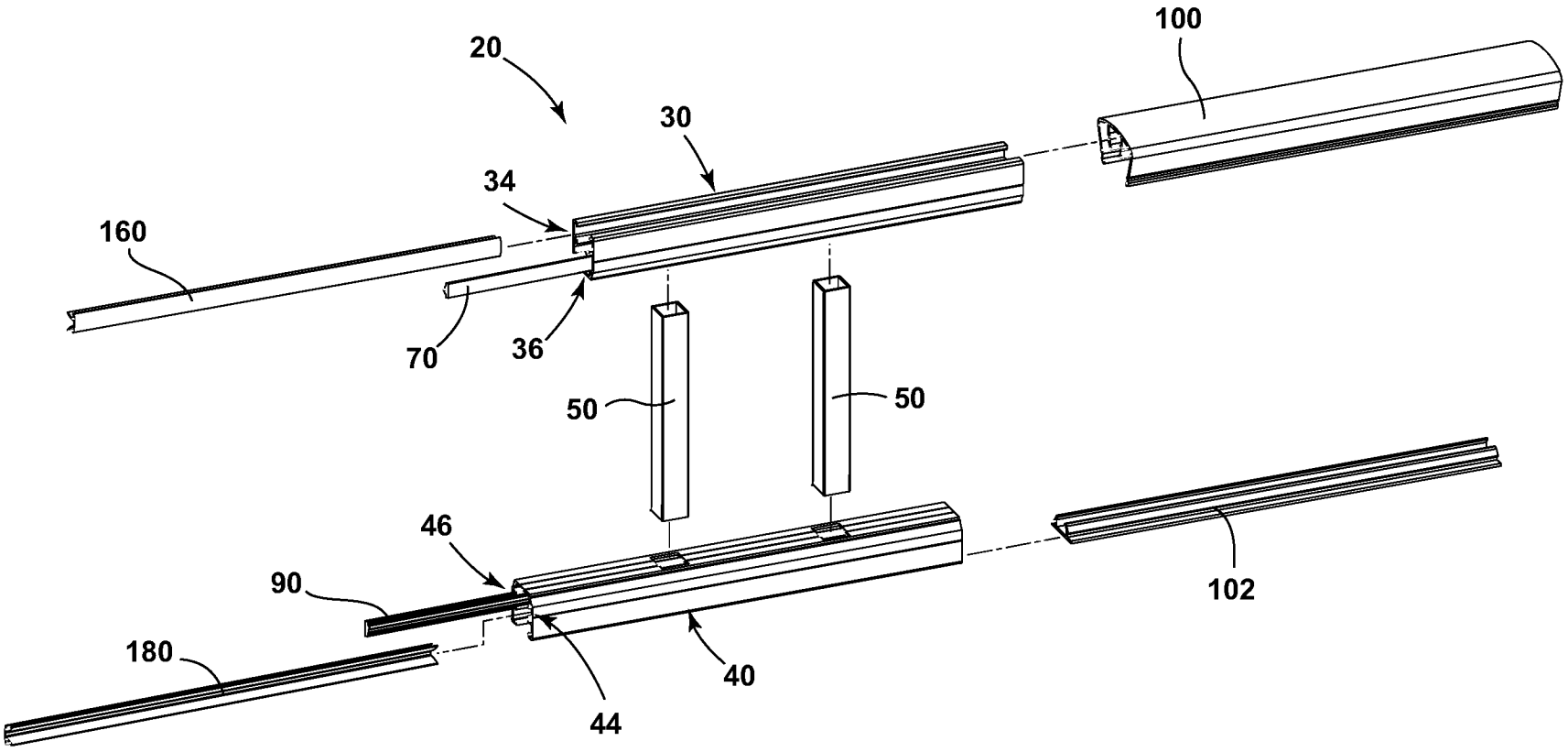
Figure 8A:
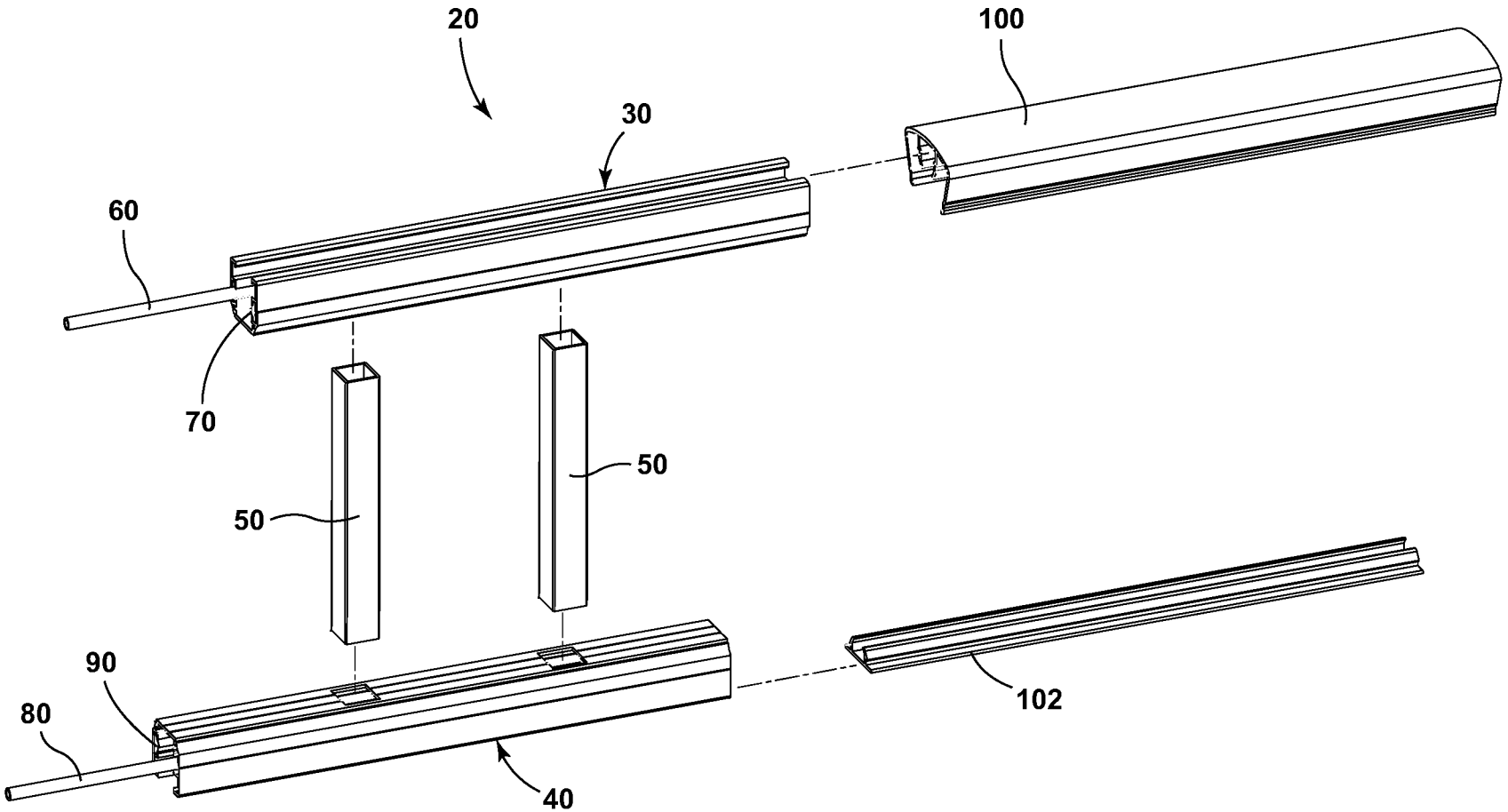
Figure 8B:
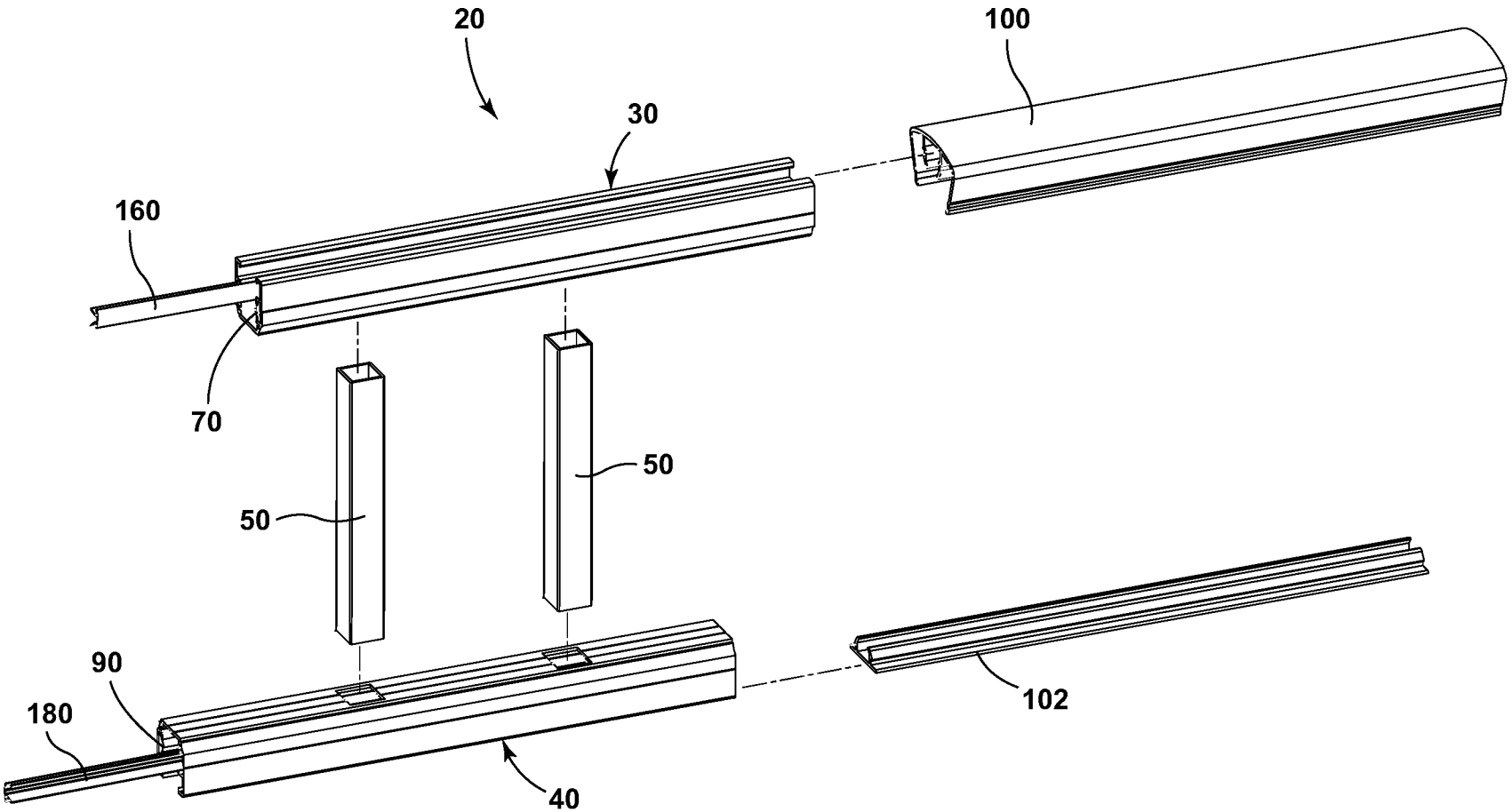

In embodiments, first retaining elements 60, 80, 160, 180, 260, 280 may include one or more of a variety of shapes, sizes, and/or configurations. For example, and without limitation, first retaining elements (e.g., elements 60, 80) may be configured as a resilient tube, such as a polyethylene, vinyl, or polymer tube, and/or may be referred to herein as tubes 60, 80, but are not so limited. In embodiments, first retaining elements (e.g., elements 160, 180) may include a generally K-shaped configuration, such as generally illustrated in FIGS. 1C, 1D, and 3B. In embodiments, first retaining element 160 and first retaining element 180 may include similar configurations and/or the same configurations. First retaining elements 160, 180 may each include a base 162, 182, a first leg 164, 184, and/or a second leg 166, 186. Bases 162, 182 may include a curved configuration and may be curved outward (e.g., such that the distances between bases 162, 182 and legs 164, 166, 184, 186 is less than if bases 162, 182 were not curved). In embodiments, the curvature of bases 162, 182 may be configured to cause and/or promote friction with balusters 50. For example, and without limitation, upon initial insertion of a baluster 50 into an aperture (e.g., aperture 32, 42), a baluster 50 may initially contact a base 162, 182 while the base 162, 182 includes a curved configuration. If insertion is continued, the baluster 50 may flatten out the base 162, 182, at least to some degree, but the base 162, 182 may continue to apply a biasing/retaining force to the baluster 50.

In embodiments, first retaining elements 260, 280 may include a C-shaped configuration (see, e.g., FIGS. 3C, 6C, and 20A-21D). For example, and without limitation, first retaining elements 260, 280 may include a generally cylindrical shape that may include a gap 266, 286 that may extend along its length, which may provide retaining elements 260, 280 with a generally C-shaped cross section. The gap 266, 286 may allow for easier insertion of first retaining elements 260, 280 into a railing portion (e.g., channels 236, 244 of railing portions 230, 240), such as by allowing for manufacturing tolerances.

Retaining elements 260, 280 may include protrusions 262, 264, 282, 284 that may extend radially outward. Protrusions 262, 264, 282, 284 may be configured to help maintain retaining elements 260, 280 in a railing portion 230, 240. For example, and without limitation, first protrusions 262, 282 may be configured to engage protrusions 234A, 244A of railing portions 230, 240, and/or second protrusions 264, 284 may be configured to engage protrusions 234B, 244B of railing portions 230, 240. First protrusions 262, 282 and second protrusions 264, 284 may be disposed at a distance from each other, such as about 180 degrees from each other. In embodiments, second protrusions 264, 284 may be disposed at or about gaps 266, 286.

In embodiments, such as generally illustrated in FIGS. 4A, 4B, 6A, 6B, 6C, 10A, and 10B, first retaining elements 60, 160, 80, 180, 260, 280 may be disposed at least partially in channels 34, 44 of first railing portion 30 and second railing portion 40, respectively, that may be formed by opposing L-shaped protrusions (e.g., protrusions 34A, 34B, 44A, 44B) that may limit movement of the first retaining elements 60, 80 (e.g., may limit movement in directions not generally parallel with longitudinal axis 22). First retaining elements 60, 160, 80, 180, 260, 280 may be slid into the channels 34, 44 from ends of the first railing portion 30 and/or the second railing portion 40. For example, and without limitation, first legs 164, 184 and/or second legs 166, 186 of first retaining elements 160, 180 may be disposed at oblique angles relative to bases 162, 182 (e.g., may include a K-shaped configuration) and may be disposed substantially within channels 34, 44. Bases 162, 182 may be disposed outside of channels 34, 44 and/or may be disposed at or near, and/or may abut protrusions 34A, 34B, 44A, 44B.

In embodiments, first retaining elements 60, 160, 80, 180, 260, 280 may be configured to bias and/or apply a force to a baluster 50 in a direction generally parallel to axis 24 (e.g., toward a second retaining element 70, 90) once the baluster 50 has been inserted into an aperture 32, 42. For example, and without limitation, a diameter of first retaining elements 60, 80, 260, 280 may be sufficiently large such that at least a portion of first retaining elements 60, 80, 260, 280 may extend out of channels 34, 44, (and/or channels 234, 244 of railing portions 230, 240 of FIGS. 18A-21D, for example) to contact and/or apply a force to baluster 50. In embodiments in which first retaining elements 160, 180 include curved bases 162, 182, the curvature may be outward (e.g., beyond protrusions 34A, 34B, 44A, 44B) to contact and/or apply a force to baluster 50. Additionally or alternatively, first retaining elements 60, 160, 80, 180, 260, 280 may be sufficiently flexible to allow an inserted baluster 50 to rotate relative to first railing portion 30 and/or second railing portion 40 to a desired stair angle about axis 24 or an axis generally parallel to axis 24 (e.g., from an initial angle of 0 degrees, relative to vertical axis 26 to a desired stair angle that may be between 0 degrees and 40 degrees).

In embodiments, such as generally illustrated in FIGS. 5A, 5B, 6A, 6B, 6C, second retaining elements 70, 90 may include one or more of a variety of shapes, sizes, and/or configurations. For example, and without limitation, second retaining elements 70, 90 may be configured as a pressure insert that may include a tab 72, 92, and/or second retaining elements 70, 90 may be referred to herein as pressure inserts 70, 90, but are not so limited. In embodiments, tabs 72, 92 and/or a pressure inserts 70, 90 may be relatively rigid (e.g., relative to first retaining elements 60, 80, 160, 180, 260, 280) and/or may comprise aluminum. Pressure inserts 70, 90 may be disposed and/or inserted into a channel of a railing portion (e.g., channel 36 of first railing portion 30 and/or channel 46 of second railing portion 40). Channels 36, 46 may be formed and/or defined by opposing L-shaped protrusions 36A, 36B, 46A, 46B that may limit movement of pressure inserts 70, 90.

In embodiments, tabs 72, 92 may include one or more of a variety of shapes, sizes, and/or configurations. For example, and without limitation, tabs 72, 92 may each include a generally triangular shape. In embodiments, an angled wall 72A, 92A (e.g., angled relative to horizontal and vertical directions) of a tab 72, 92 may be disposed such that a baluster 50 may initially contact the angled wall 72A, 92A upon insertion. In embodiments, a generally horizontal wall 72B, 92B of a tab 72, 92 may be disposed adjacent to an angled wall 72A, 92A such that the tab 72, 92 includes an end/point 72C, 92C that may contact a baluster 50 once the baluster 50 has been inserted a sufficient distance. Horizontal wall 72B, 92B may not be completely horizontal and/or may be disposed at an oblique angle relative to a horizontal direction, such as, for example, a five degree angle. In embodiments, pressure inserts 70, 90 may include a generally rectangular shape and/or tabs 72, 92 may extend inward toward a middle of first railing portion 30 and/or a middle of second railing portion 40. In embodiments, pressure inserts 70, 90 may be slid into the channels 36, 46 from ends of the first railing portion 30 and/or the second railing portion 40.

In embodiments, a railing assembly 20 may include a top cover 100 that may be decorative and/or configured for a user to hold, such as when using stairs. Top cover 100 may be connected (e.g., coupled and/or snapped) to a railing portion (e.g., first railing portion 30). In embodiments, top cover 100 may be disposed about a railing portion such that it covers some or all of the railing portion. Top cover 100 may be connected internally to the railing portion. For example, and without limitation, top cover 100 may include protrusions 100A, 100B that may extend toward the railing portion (e.g., vertically) and/or may be configured to engage with inwardly extending flanges of the railing portion (e.g., flanges 38A, 38B of first railing portion 30). Additionally or alternatively, a railing assembly 20 may include a bottom cover 102 that may be coupled and/or snapped to a railing portion (e.g., second railing portion 40). In embodiments, cover 102 may slide into a railing portion such that cover 102 is connected with the railing portion internally. For example, and without limitation, bottom cover 102 may include protrusions 102A, 102B that may extend toward the railing portion (e.g., vertically) and/or may be configured to engage with inwardly extending flanges of the railing portion (e.g., flanges 48A, 48B of second railing portion 40).

Figure 9A:
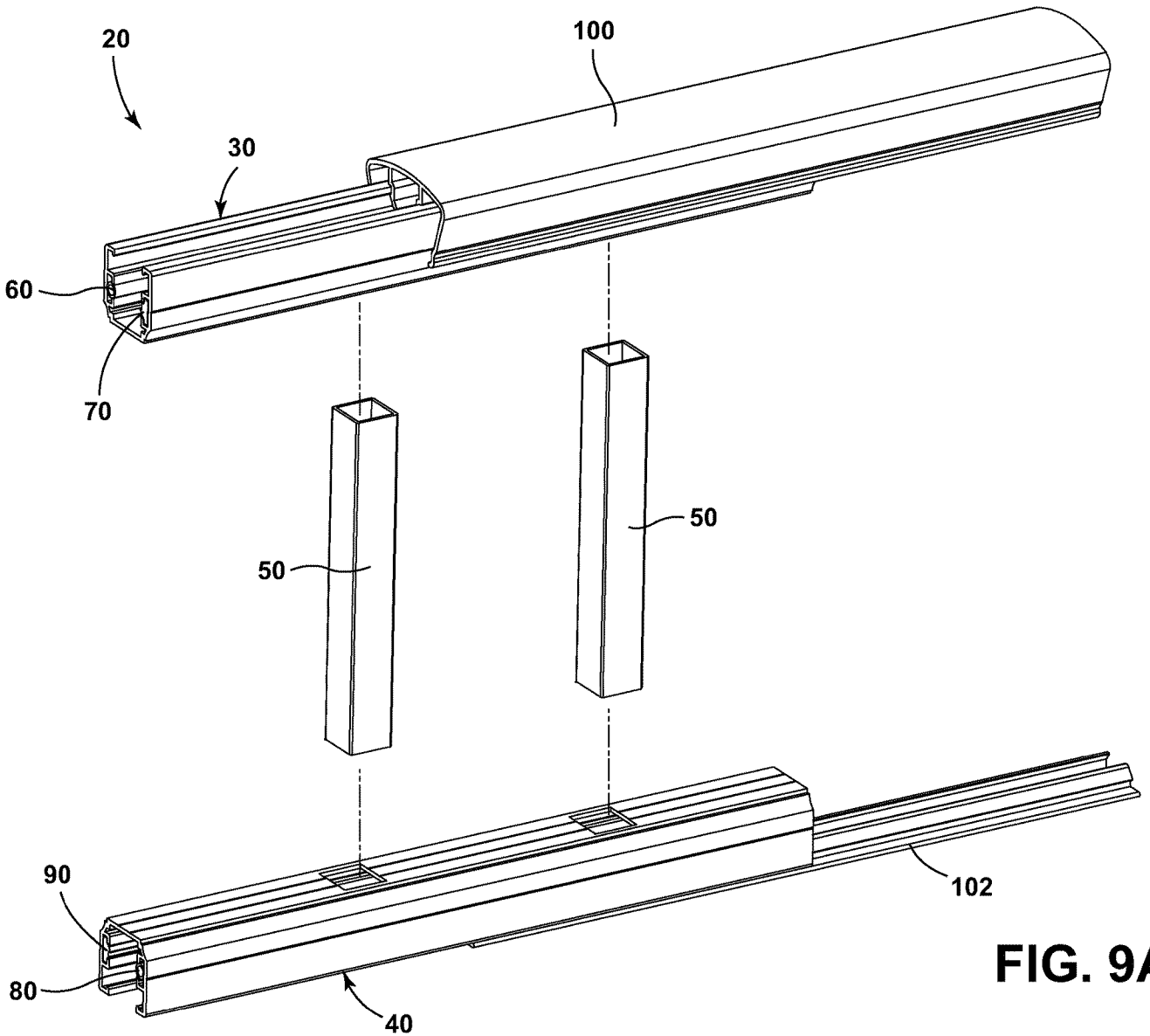
Figure 9B:
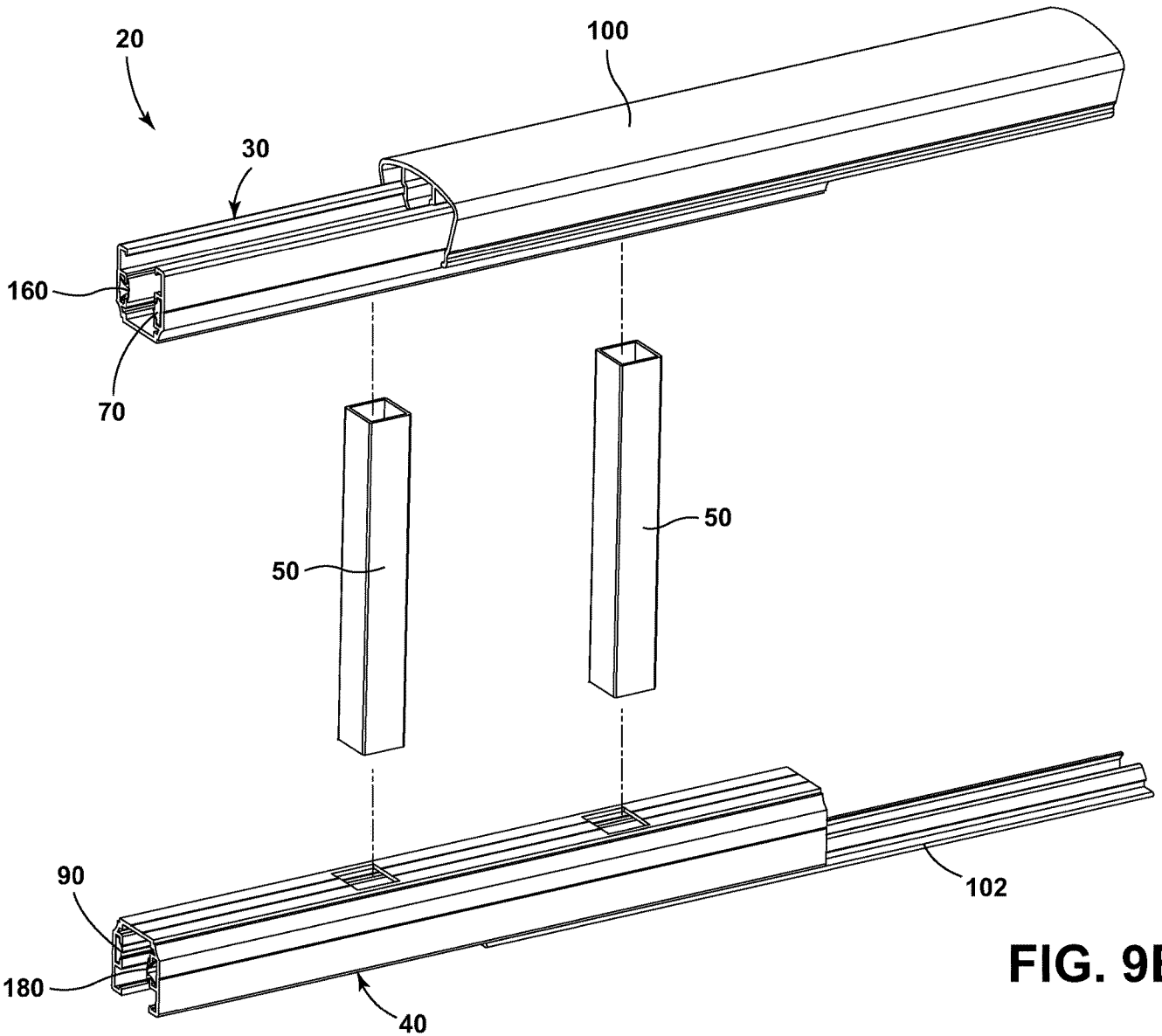
Figure 10A:
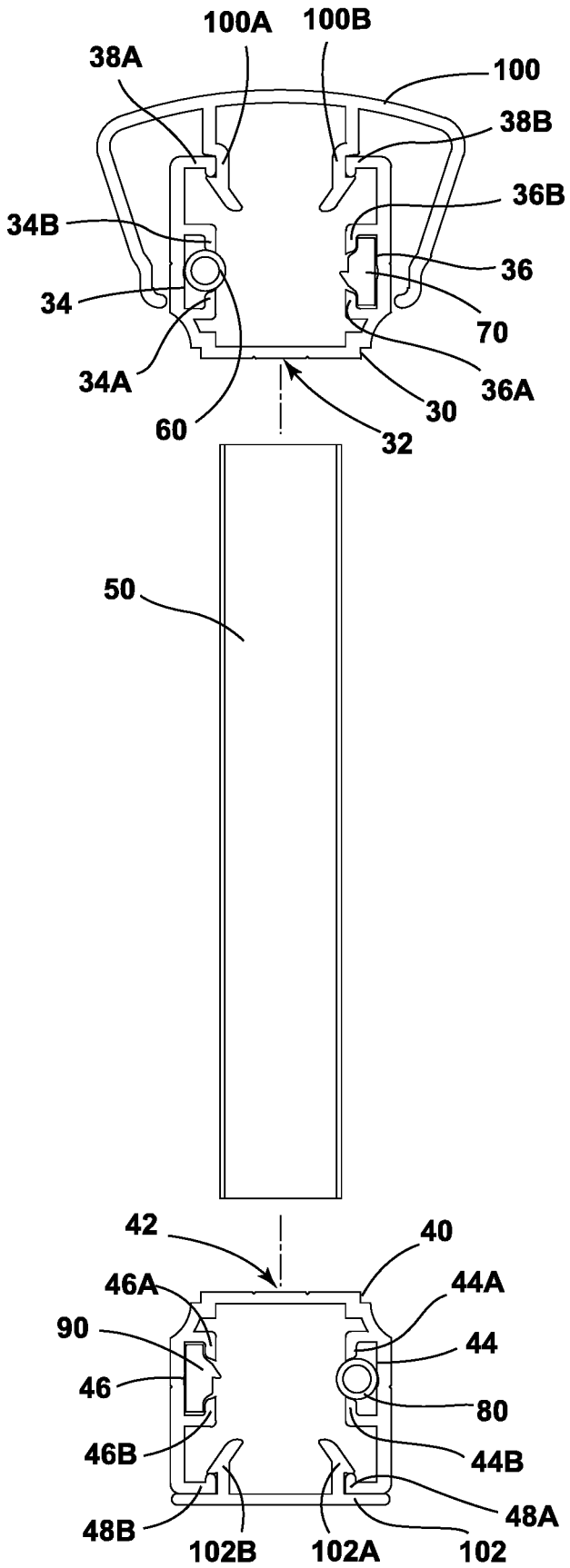
FIGS. 10A and 10B depict exploded cross-sectional views of embodiments of a friction picket system in accordance with teachings of the present disclosure.
Figure 10B:
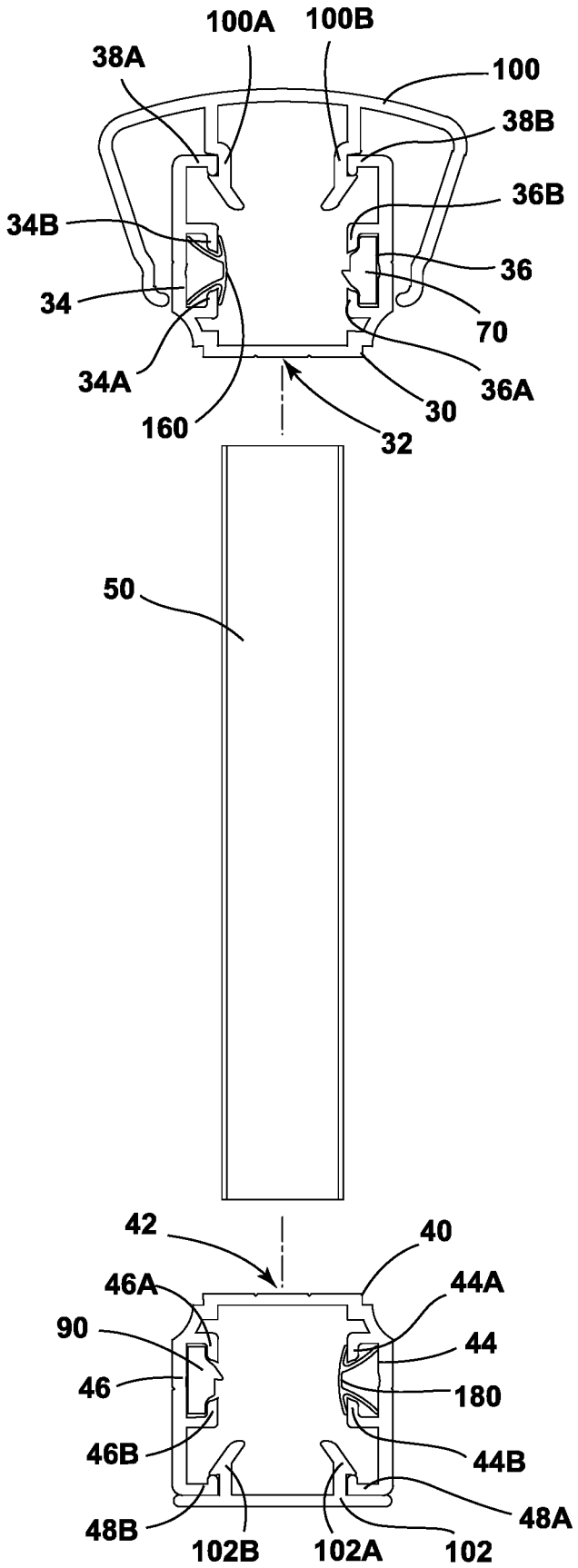
Figure 11A:
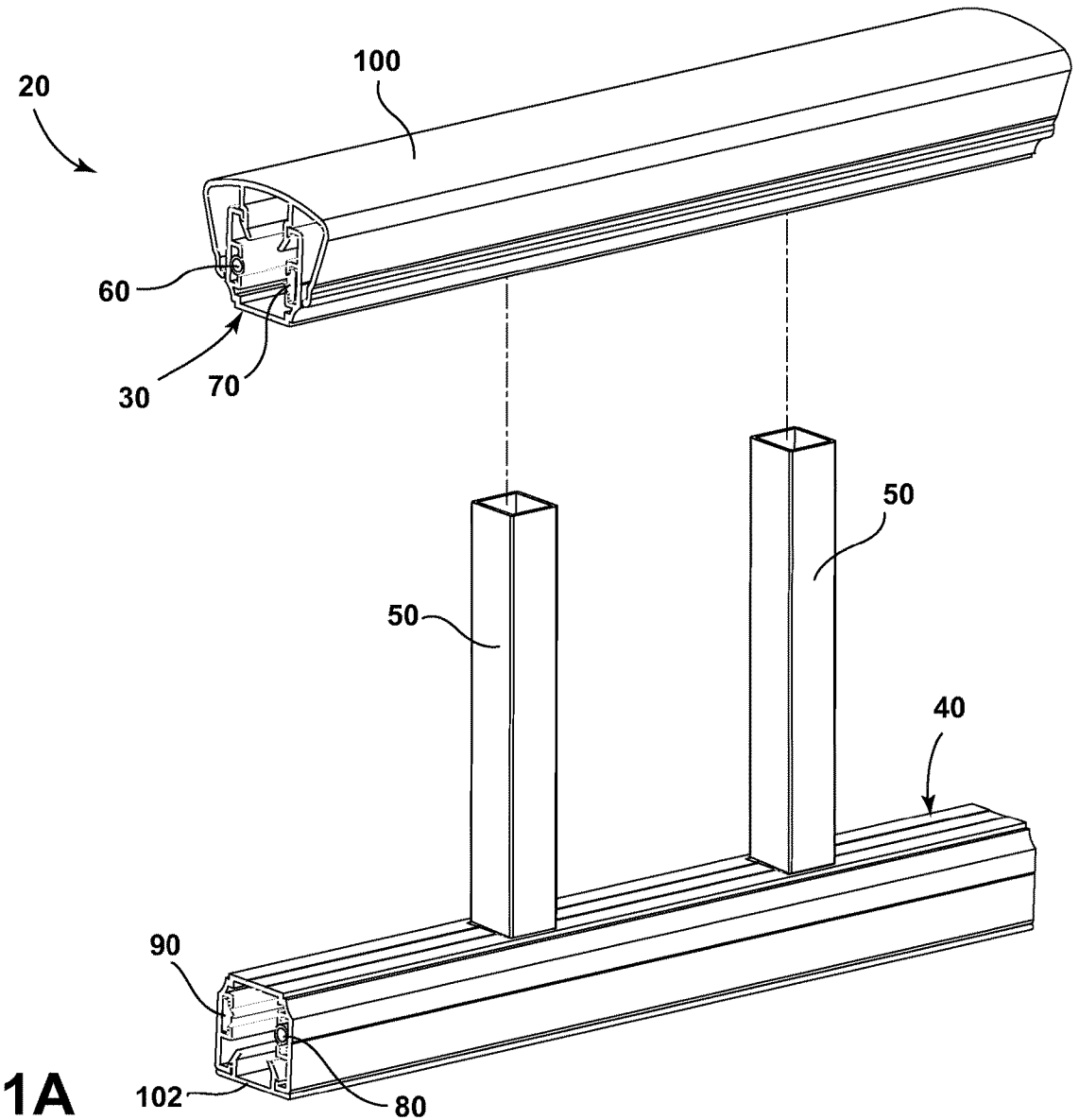
FIGS. 11A and 11B illustrate exploded perspective views generally illustrating portions of embodiments of a friction picket systems in accordance with teachings of the present disclosure.
Figure 11B:
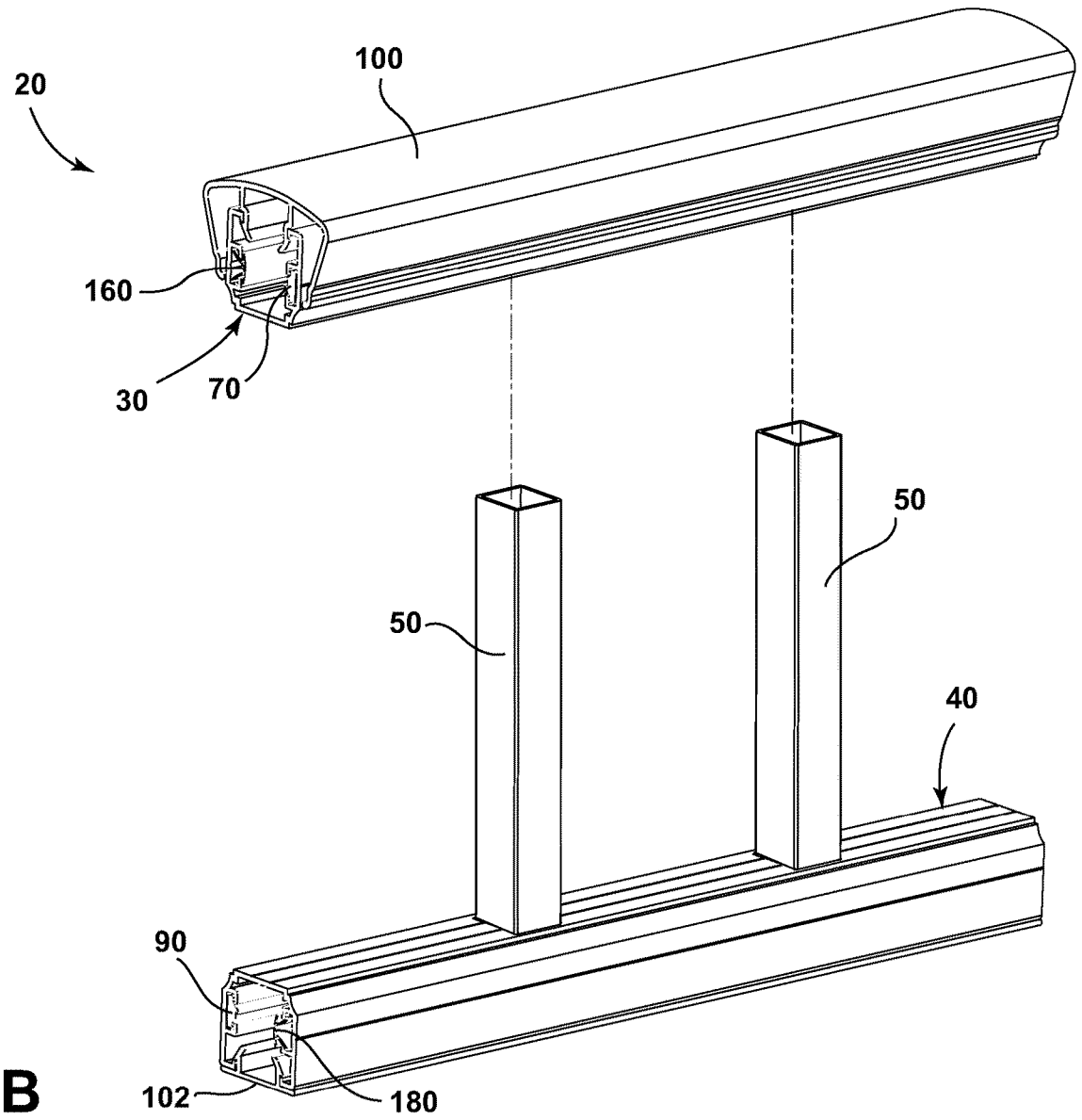
Figure 12A:
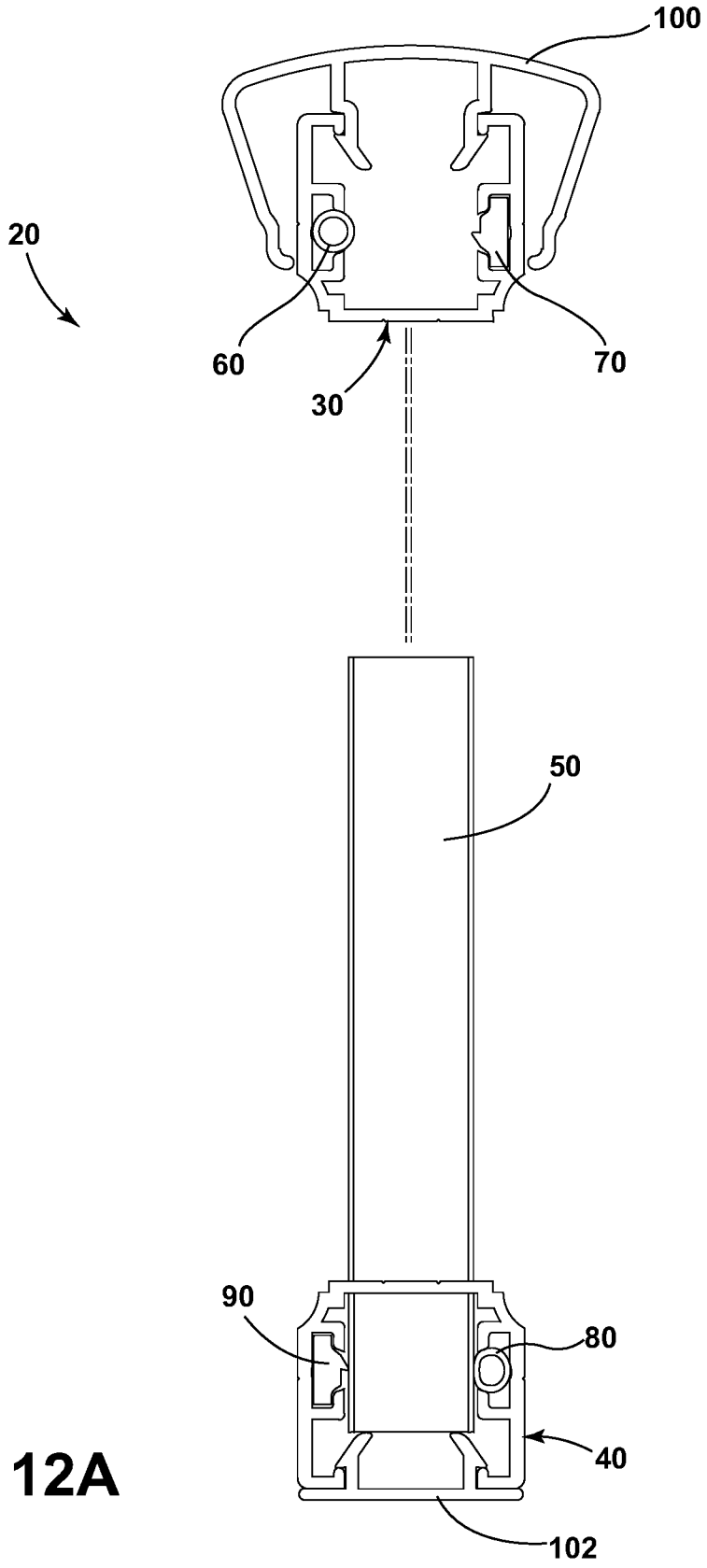
FIGS. 12A and 12B depict exploded cross-sectional views of embodiments of a friction picket system in accordance with teachings of the present disclosure.
Figure 12B:
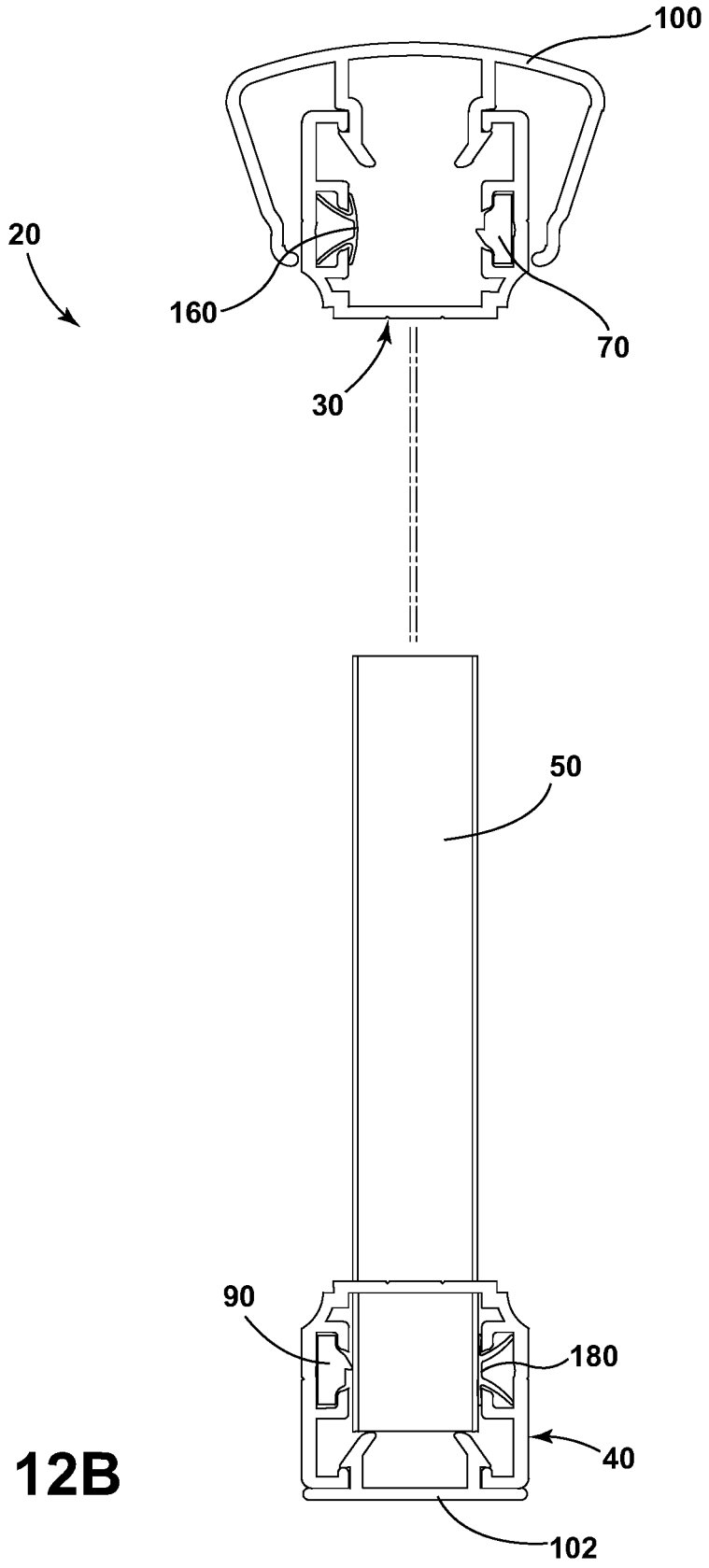
Figure 13A:
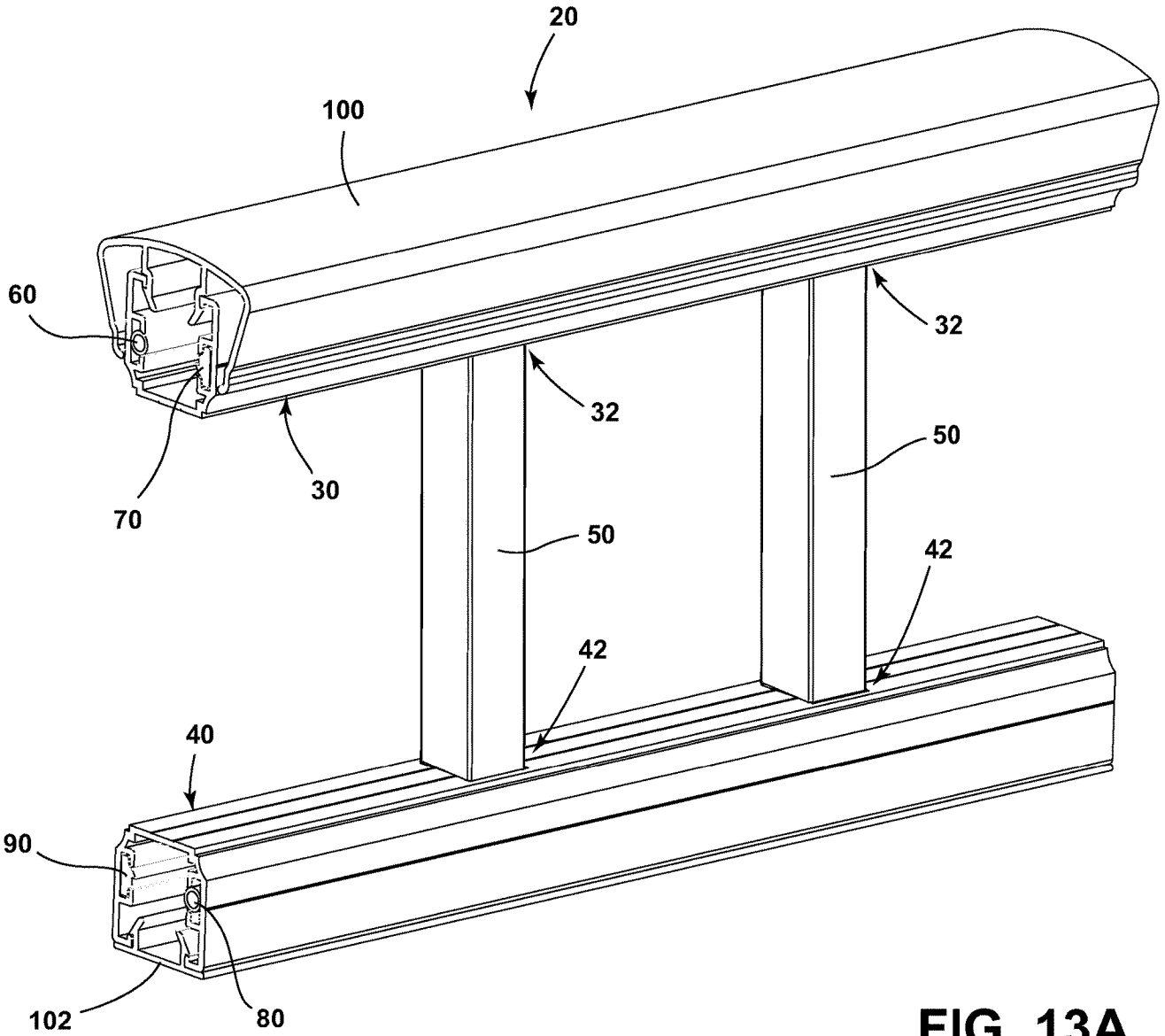
FIGS. 13A-15B illustrate perspective views generally illustrating portions of embodiments of a friction picket system in accordance with teachings of the present disclosure.
Figure 13B:
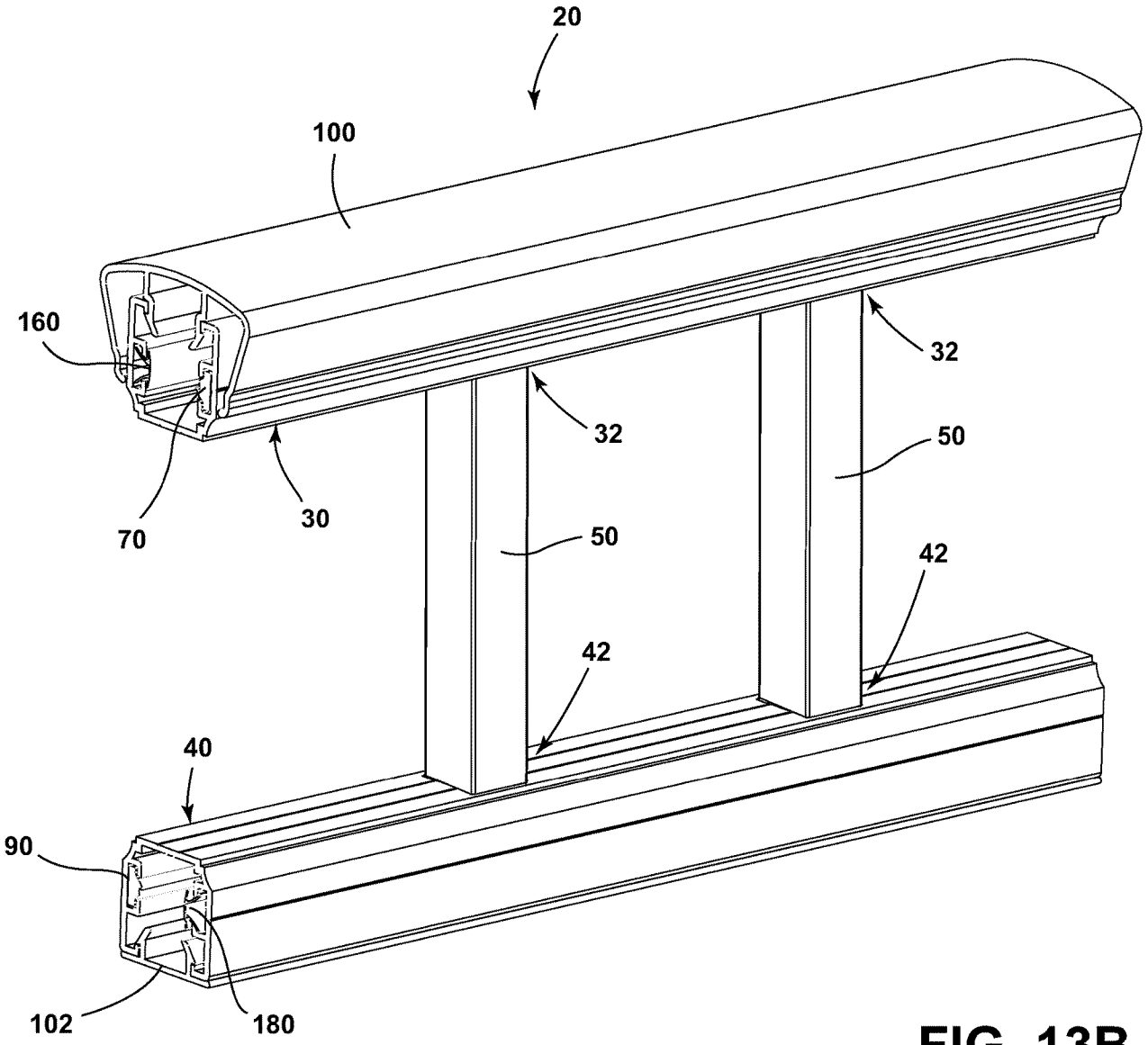
Figure 14A:
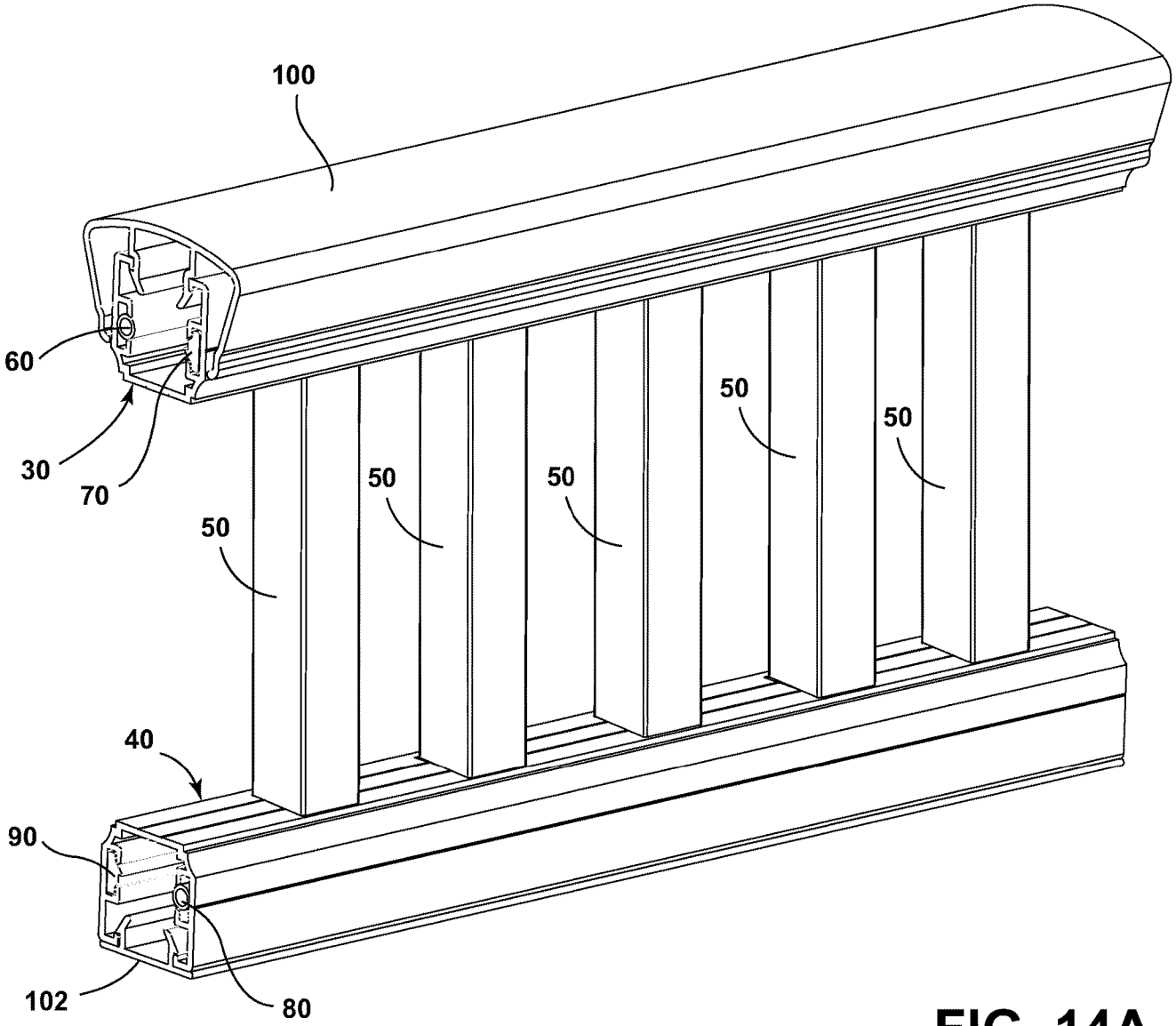
Figure 14B:
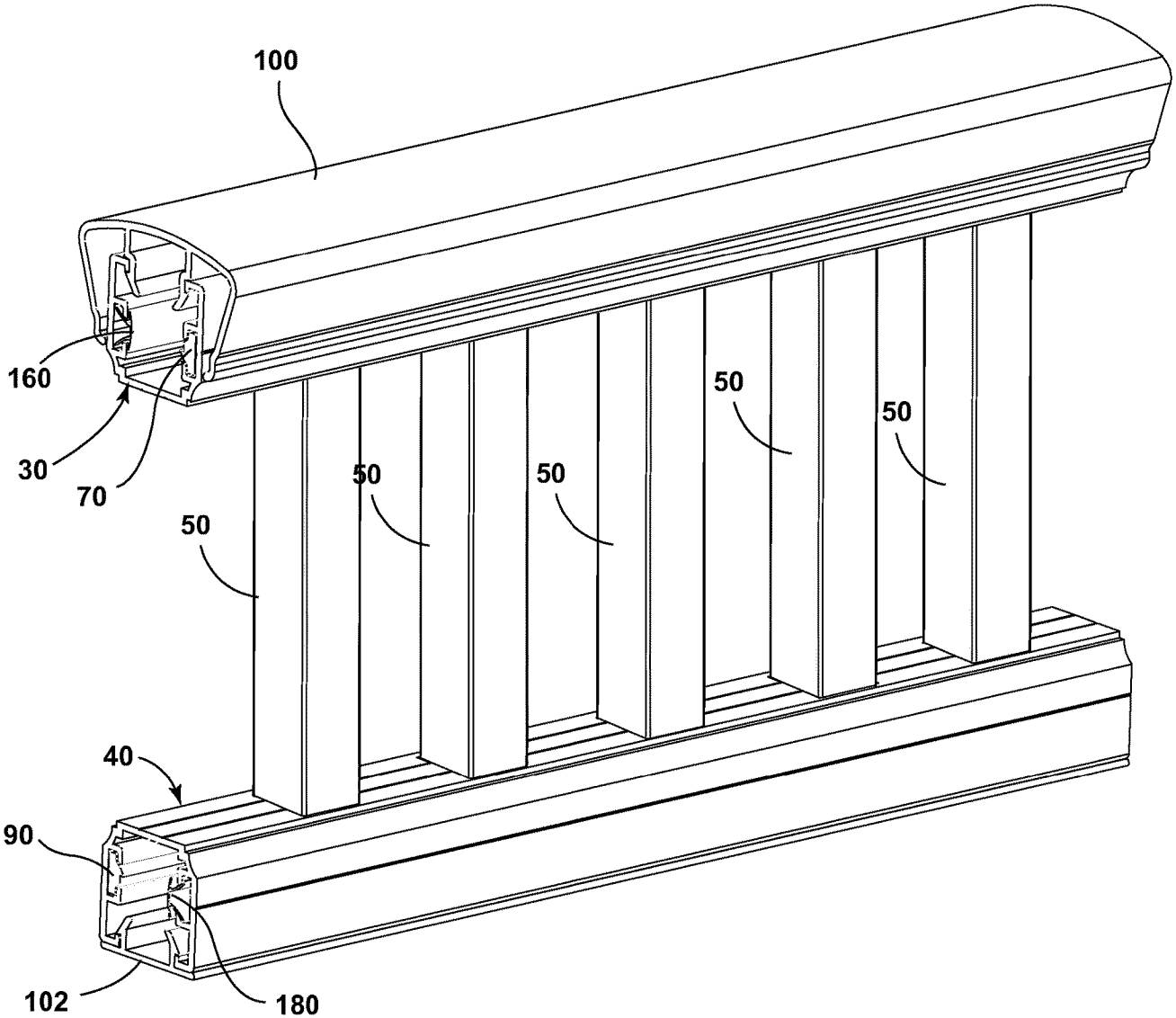
Figure 15A:
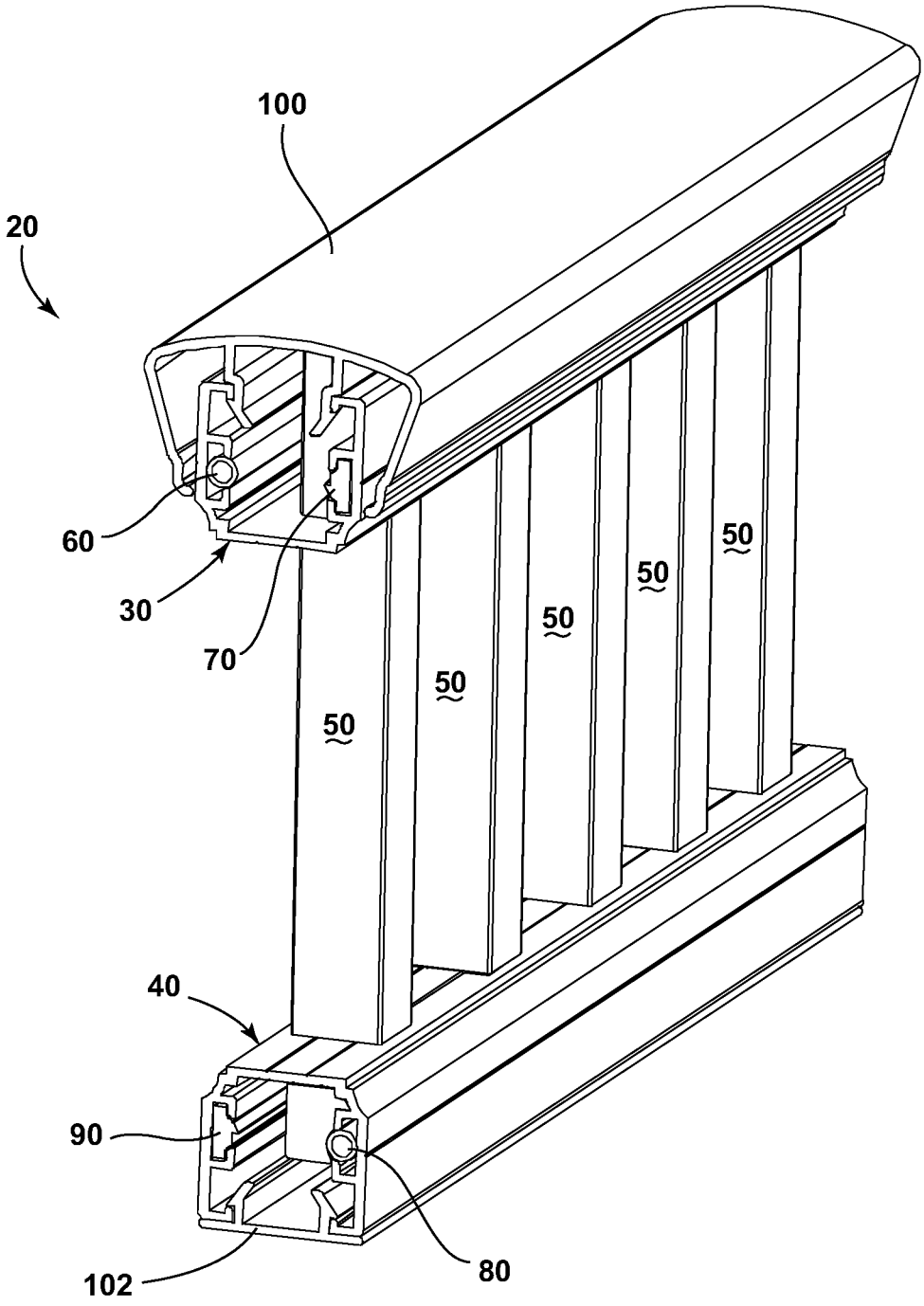
Figure 15B:
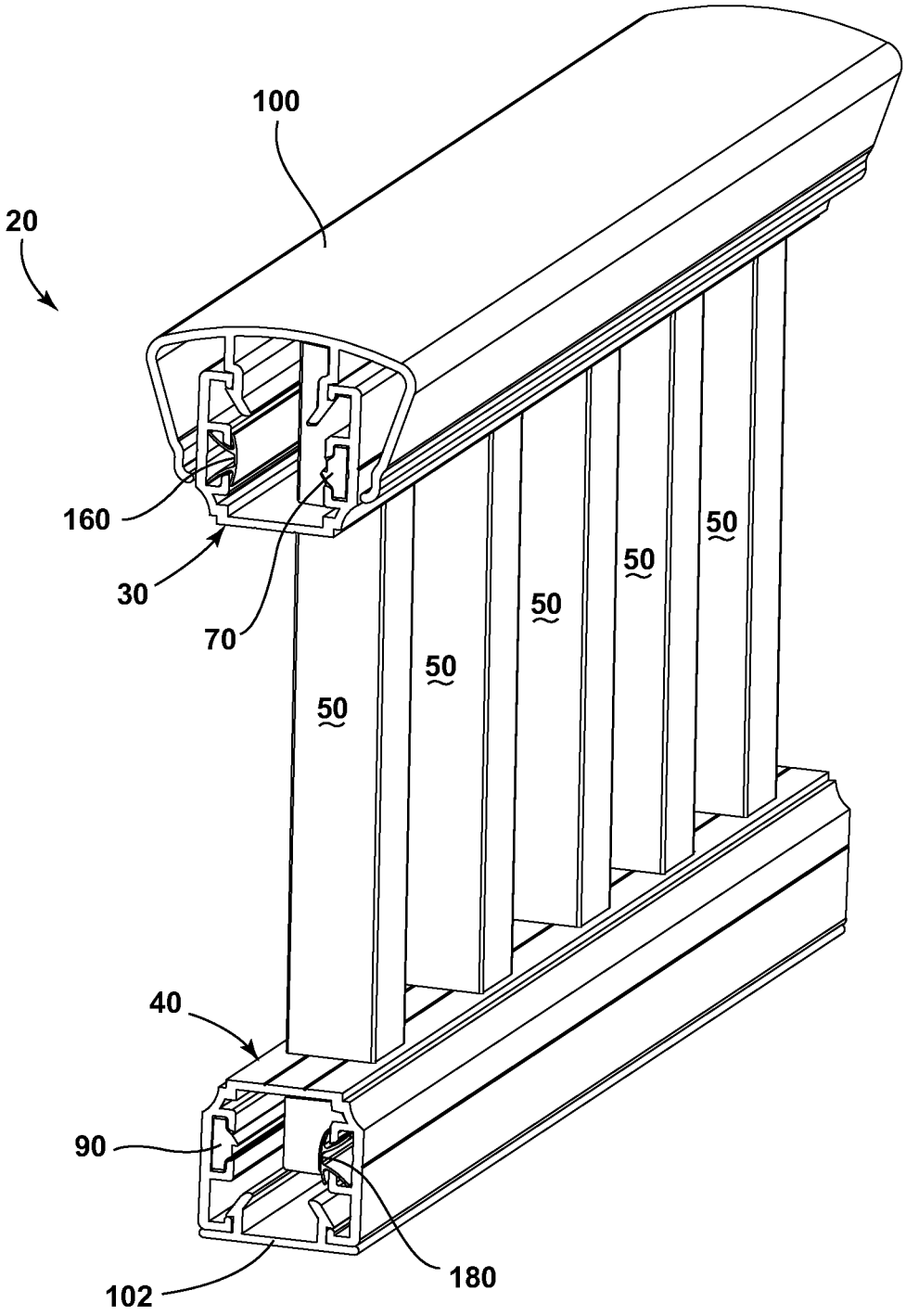
Figure 16A:
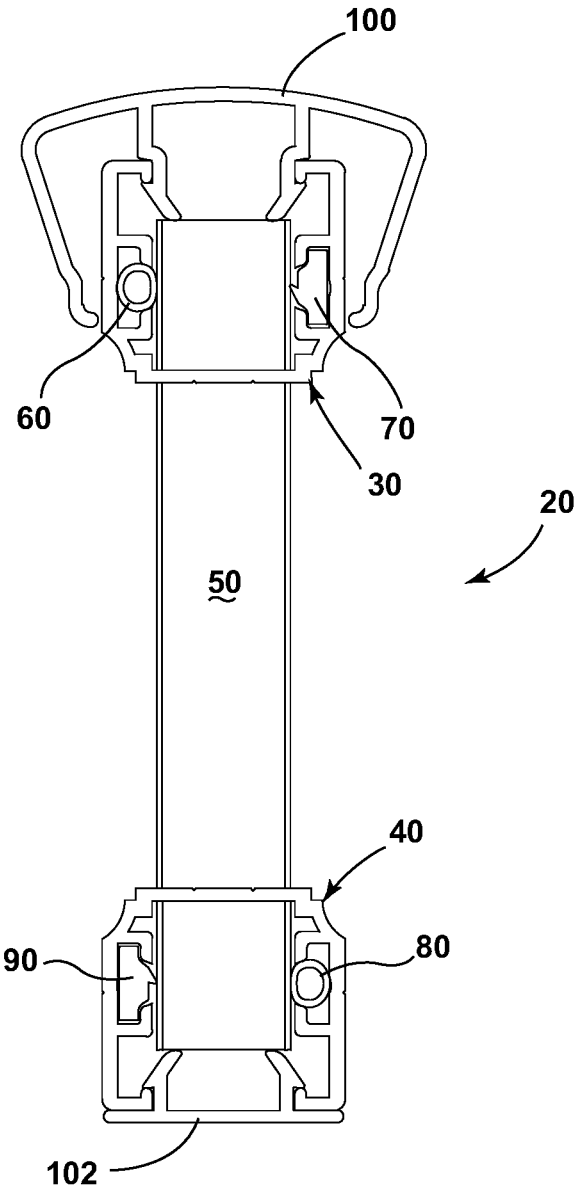
FIGS. 16A and 16B illustrate cross-sectional views of embodiments of a friction picket system in accordance with teachings of the present disclosure.
Figure 16B:
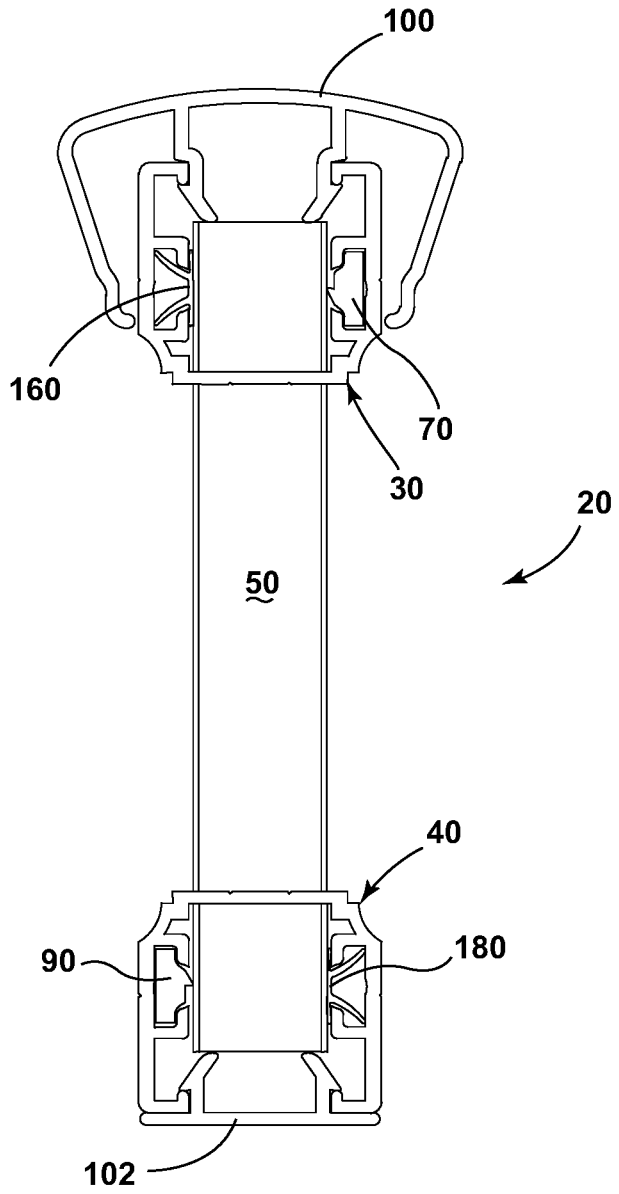
Figure 17A:
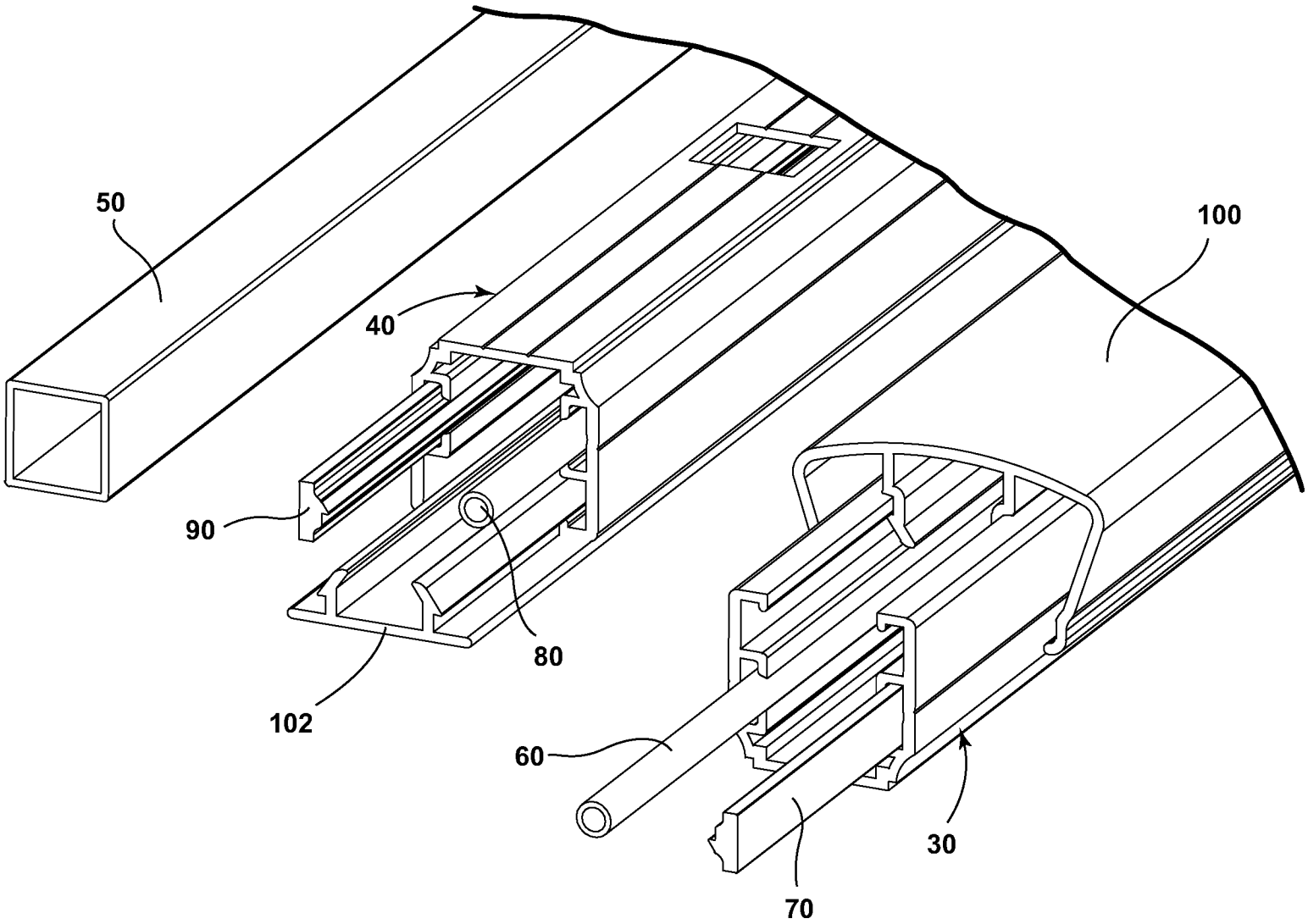
FIGS. 17A and 17B depict exploded perspective views generally illustrating portions of embodiments of a friction picket systems in accordance with teachings of the present disclosure.
Figure 17B:
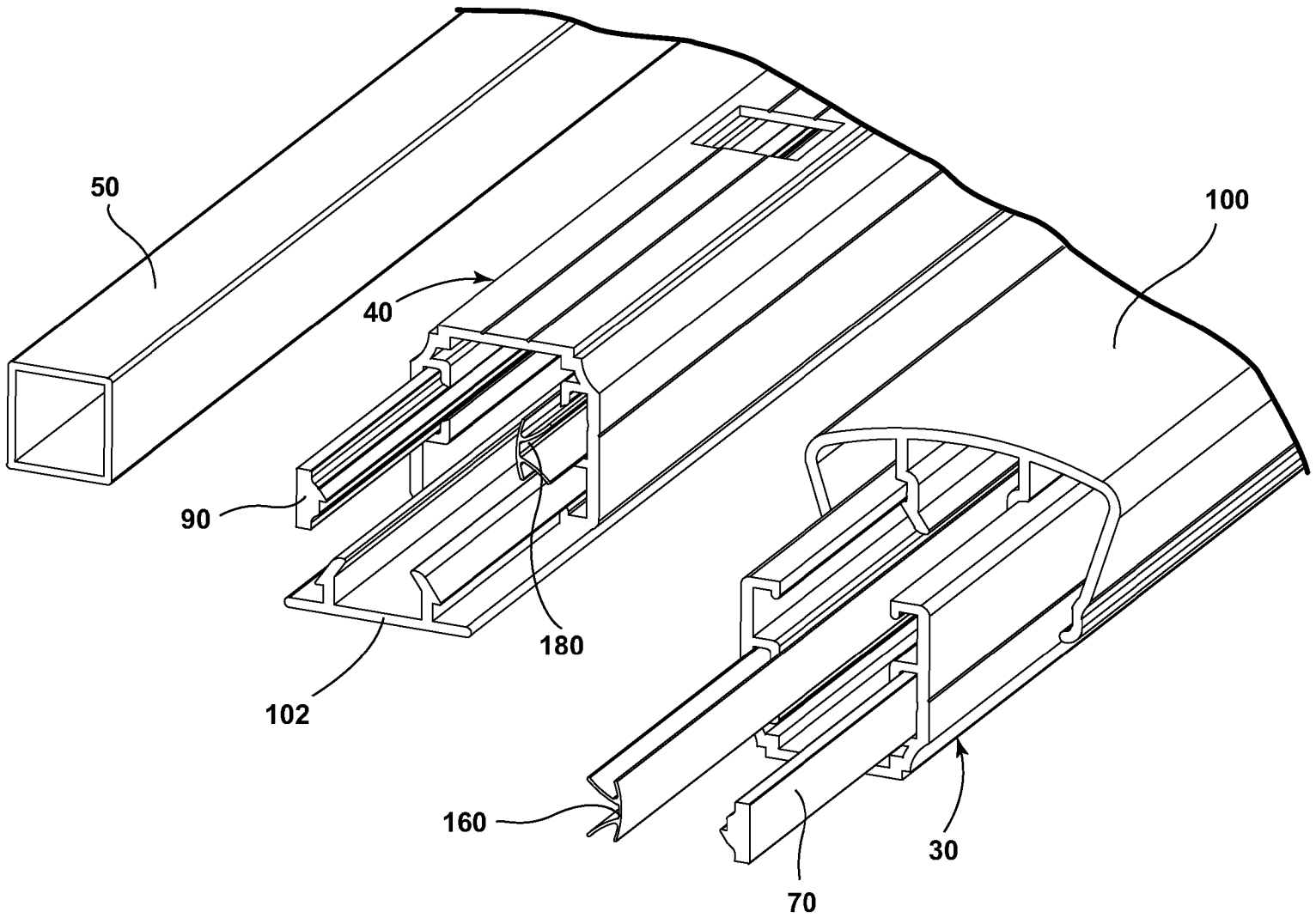
Figure 18A:
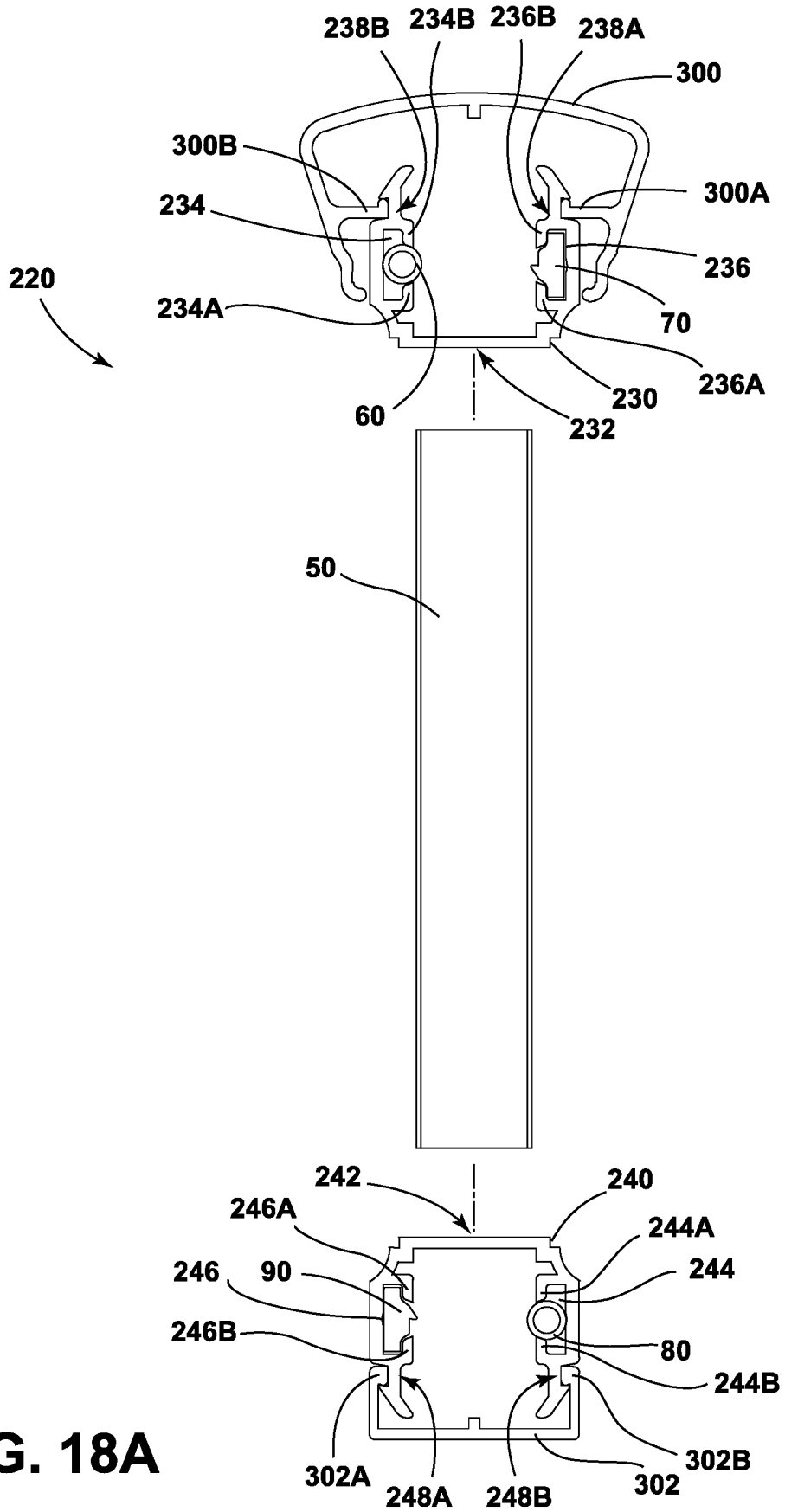
FIGS. 18A and 18B illustrate cross-sectional views of embodiments of a friction picket system in accordance with teachings of the present disclosure.
Figure 18B:
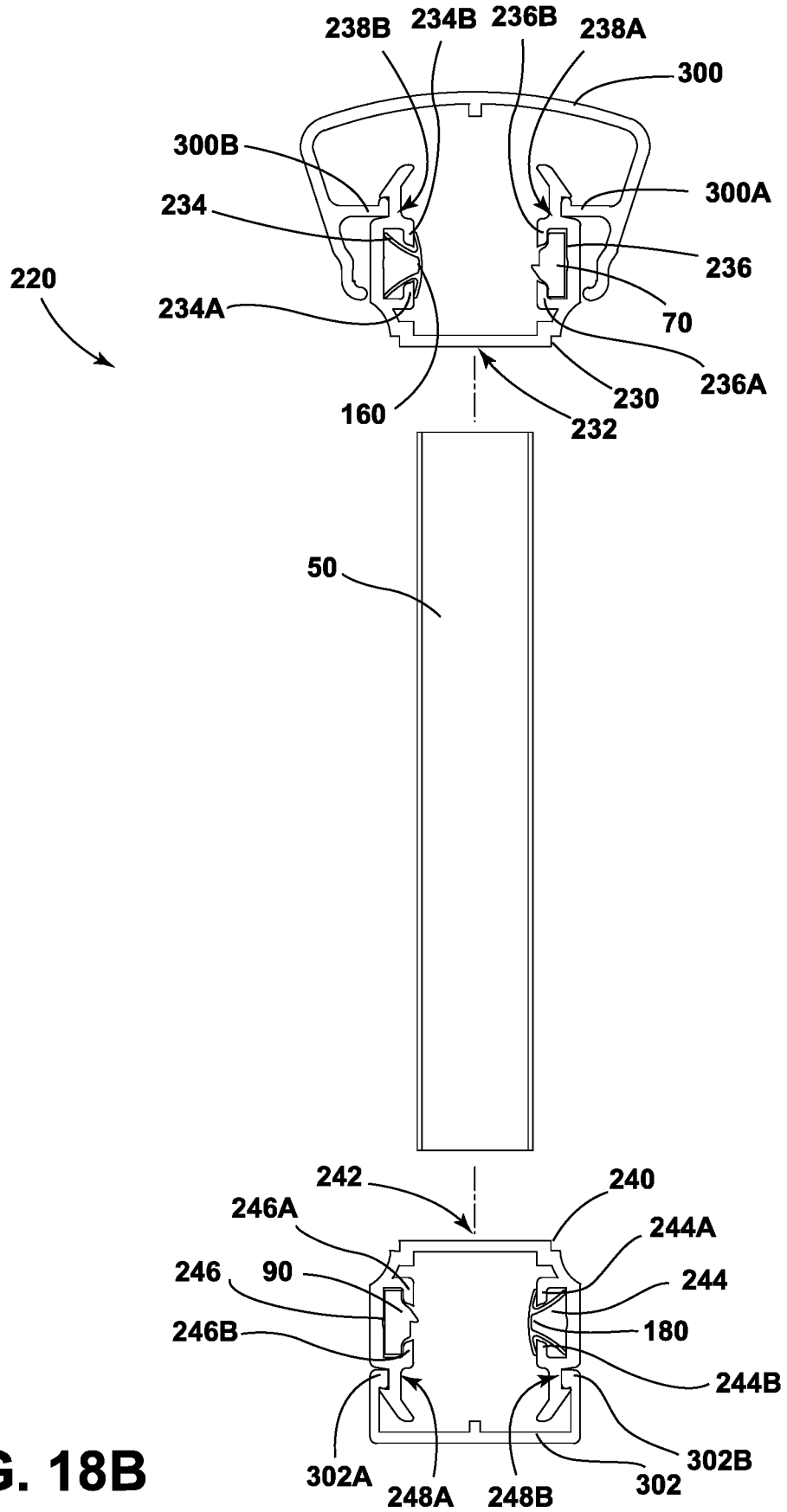
Figure 19A:
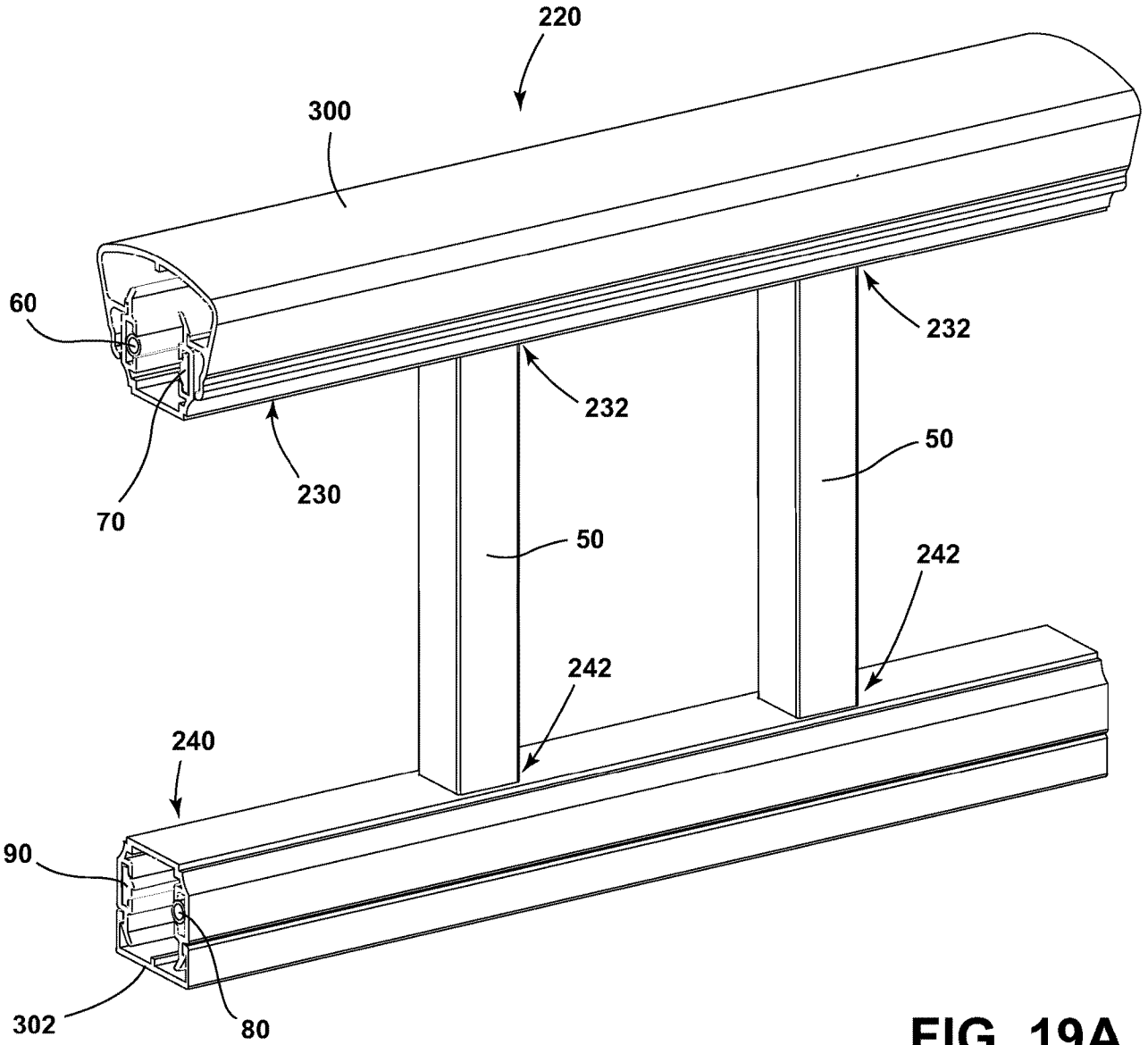
FIGS. 19A and 19B depict exploded perspective views generally illustrating portions of embodiments of a friction picket systems in accordance with teachings of the present disclosure.
Figure 19B:
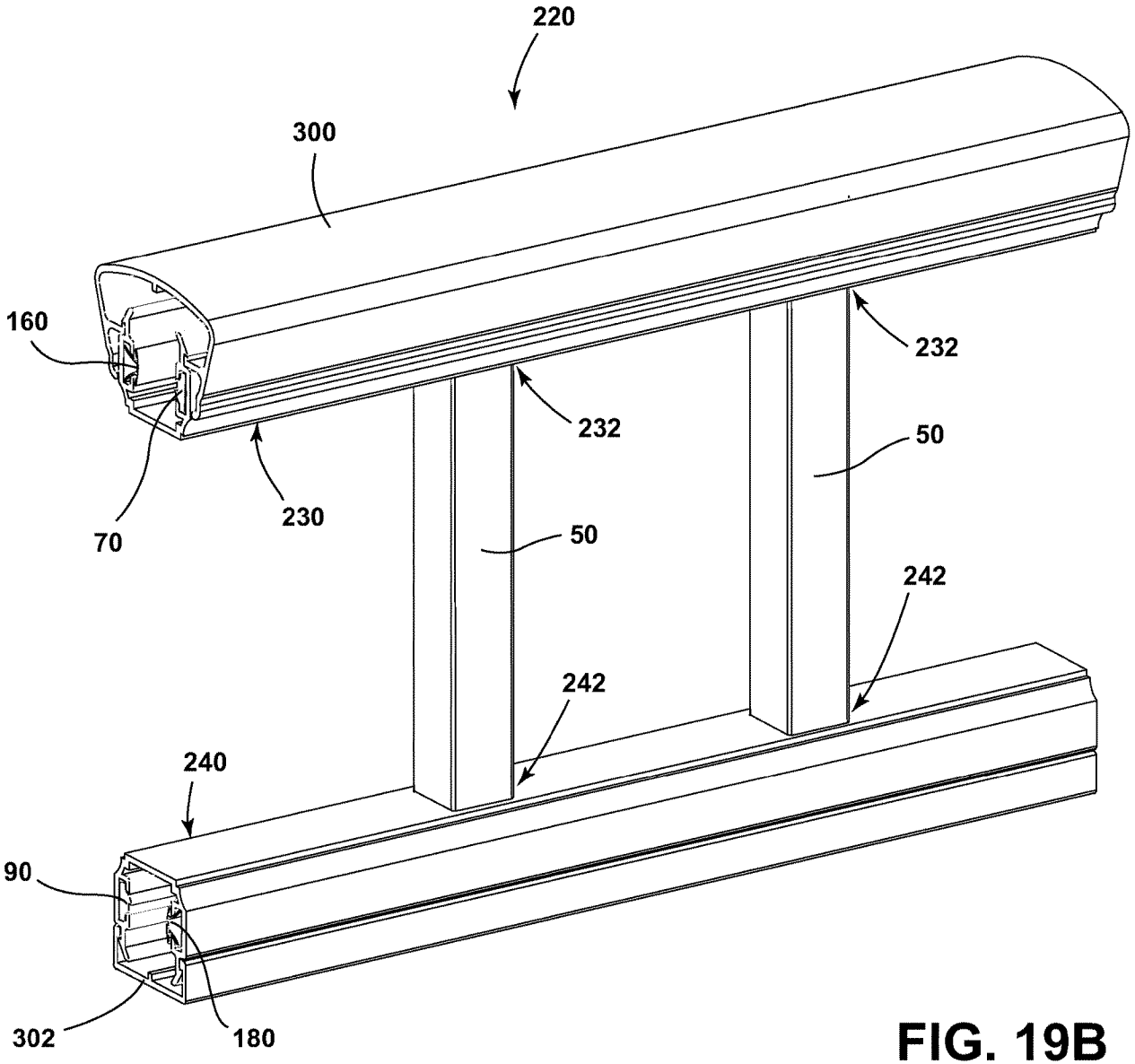
Figure 20A:
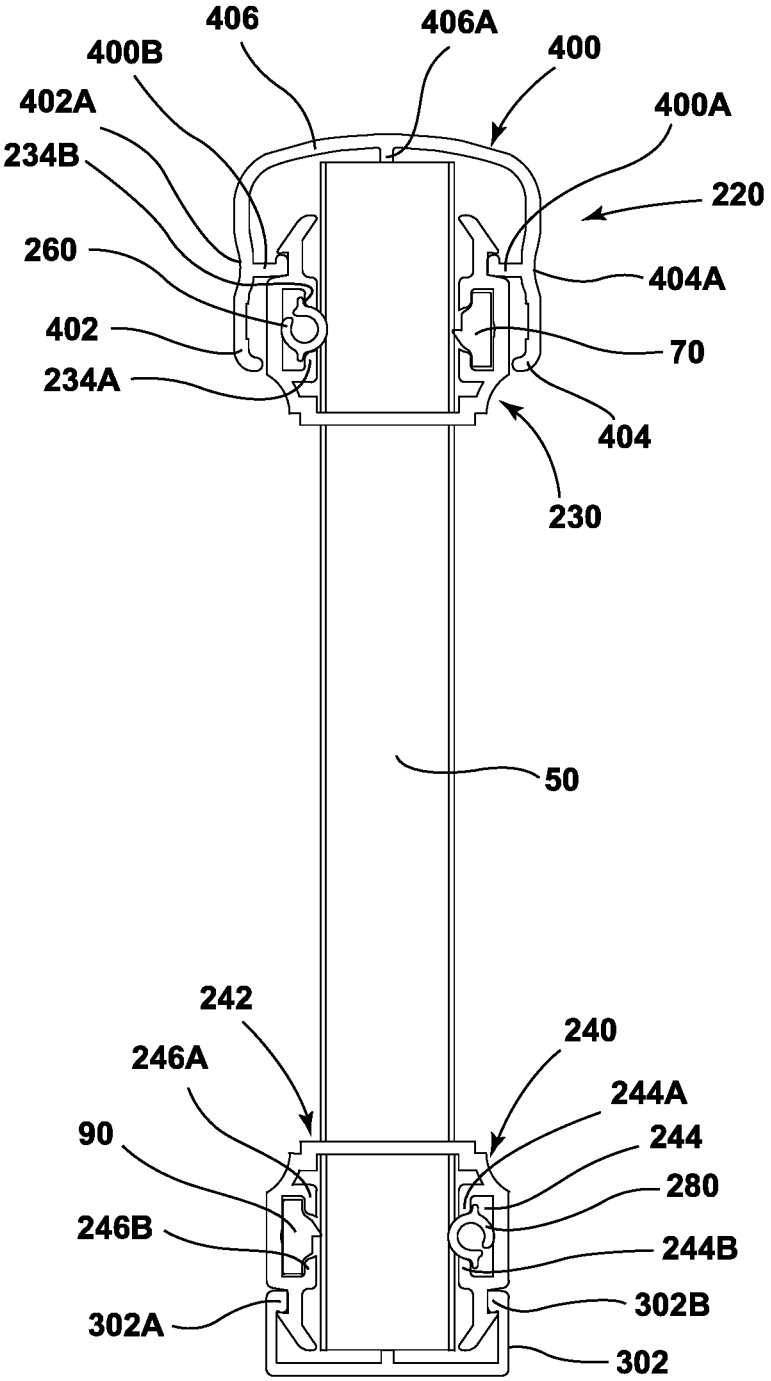
FIG. 20A depicts a cross-sectional view of an embodiment of a friction picket system in accordance with teachings of the present disclosure.
Figure 20B:
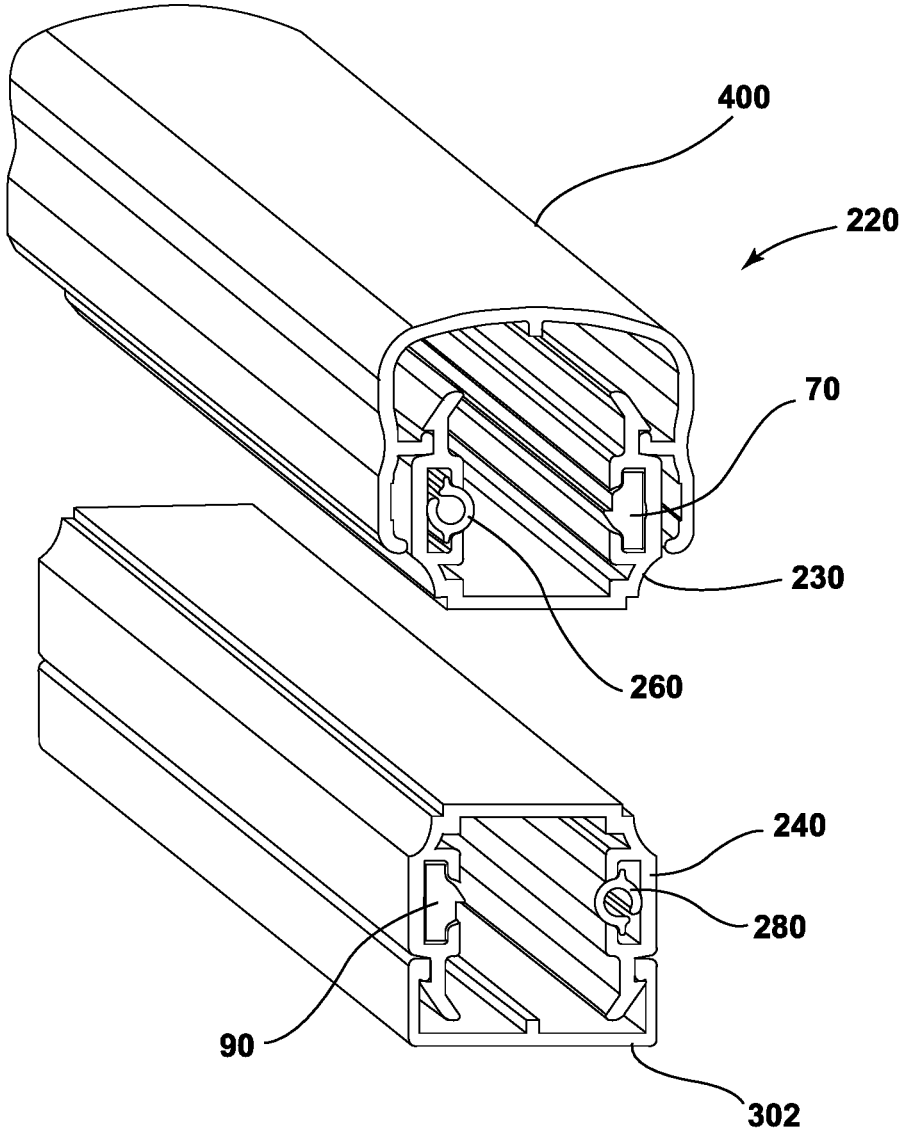
FIGS. 20B-20D illustrate perspective views generally illustrating portions of embodiments of a friction picket system in accordance with teachings of the present disclosure.
Figure 20C:
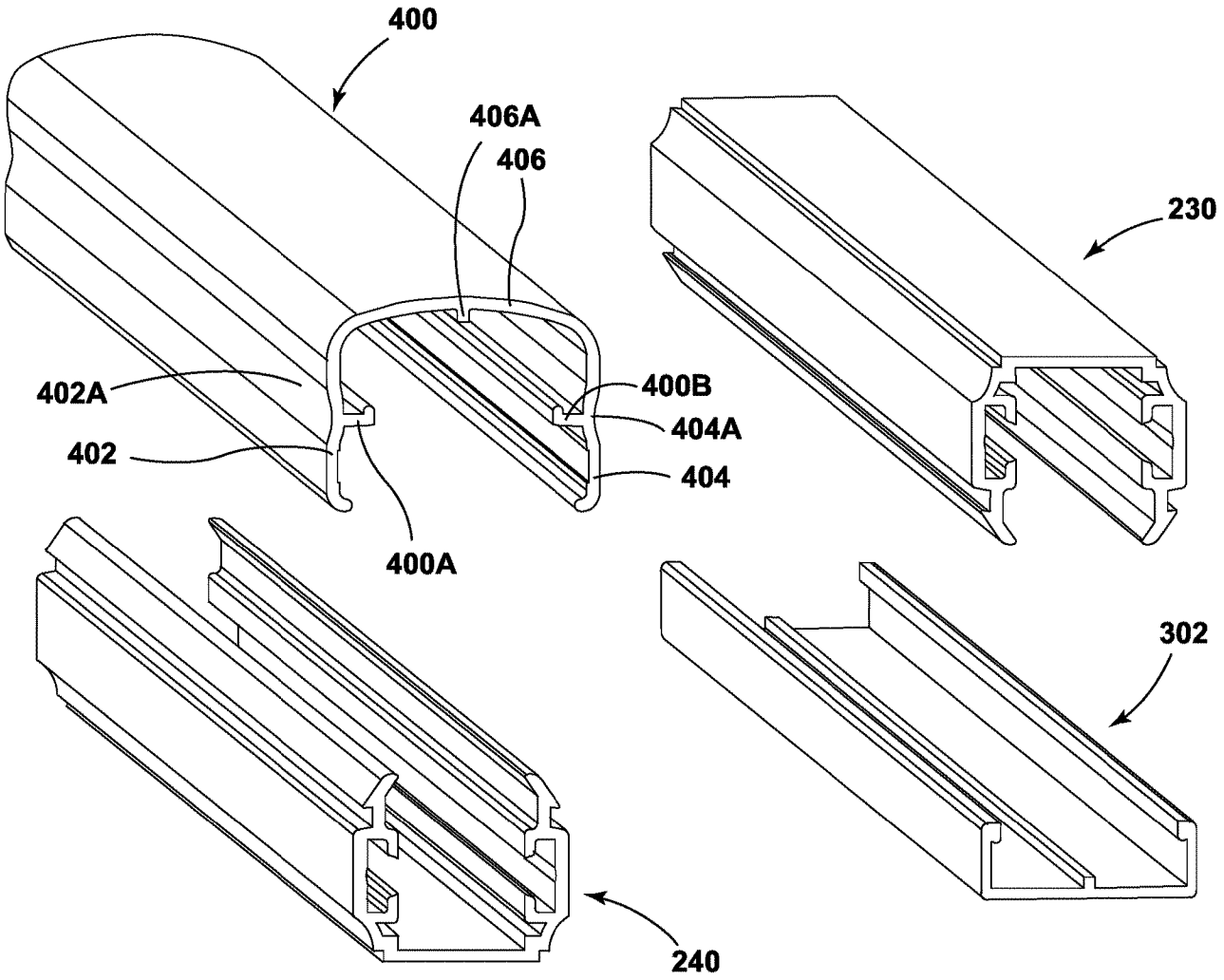
Figure 20D:
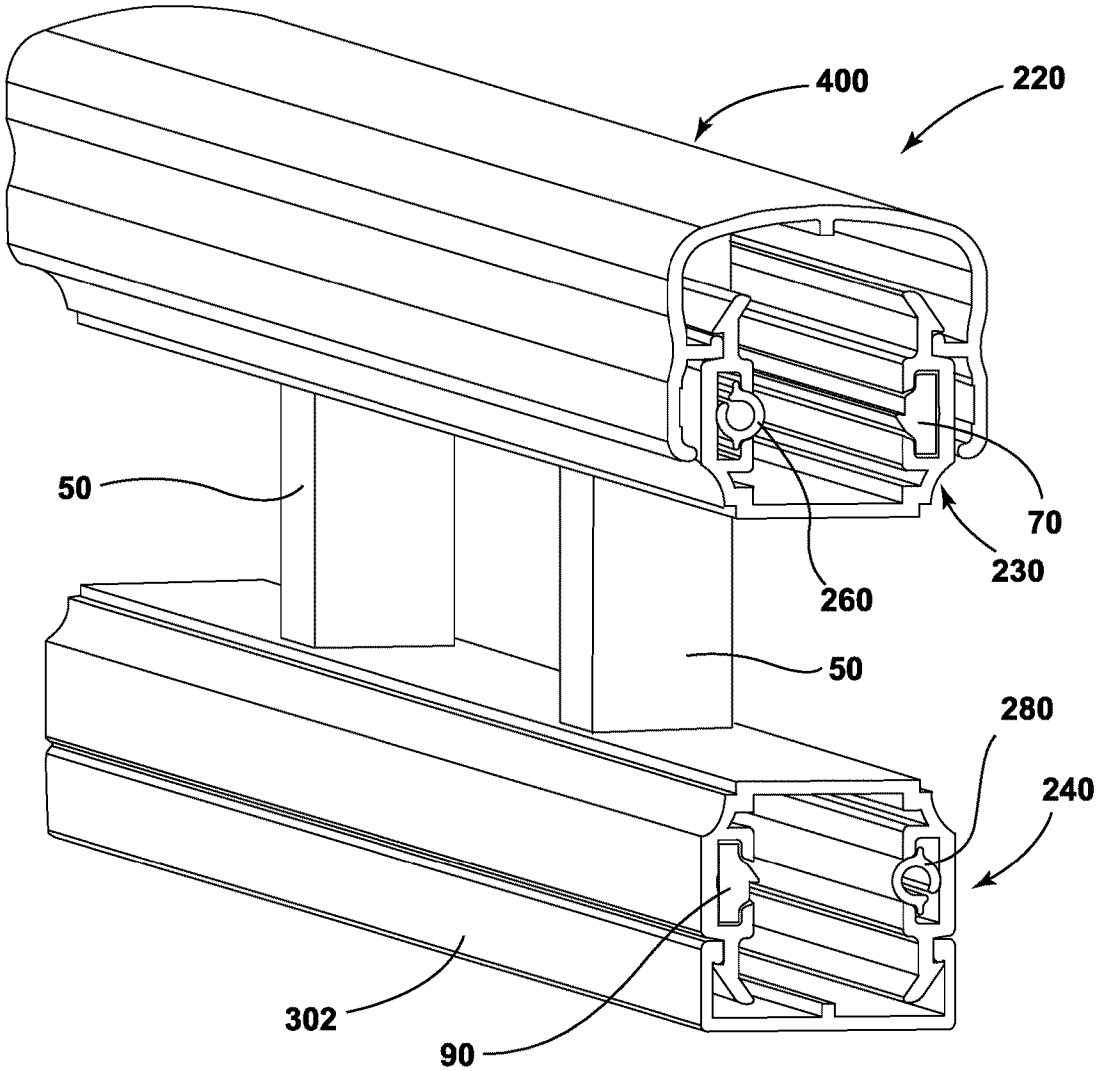
Figure 21A:
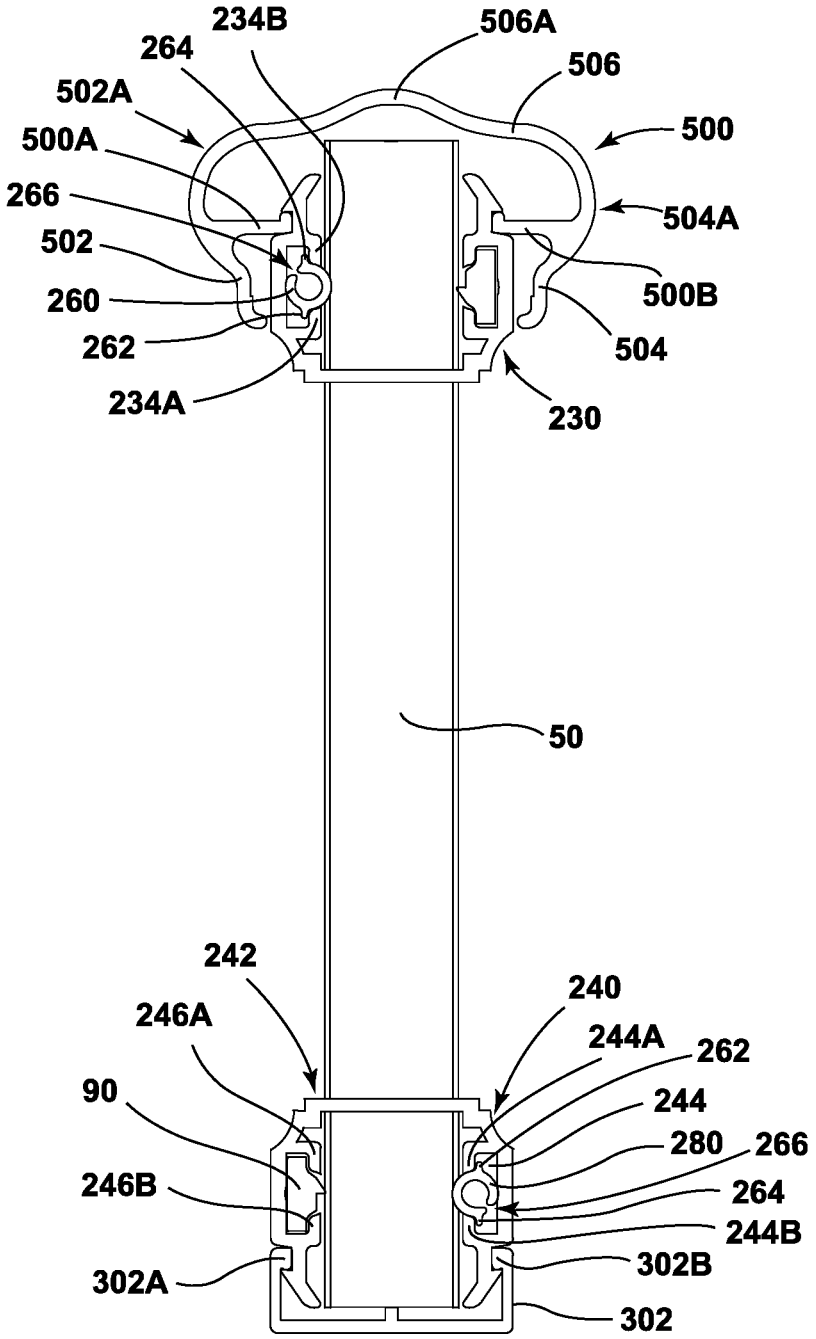
FIG. 21A depicts a cross-sectional view of an embodiment of a friction picket system in accordance with teachings of the present disclosure.
Figure 21B:
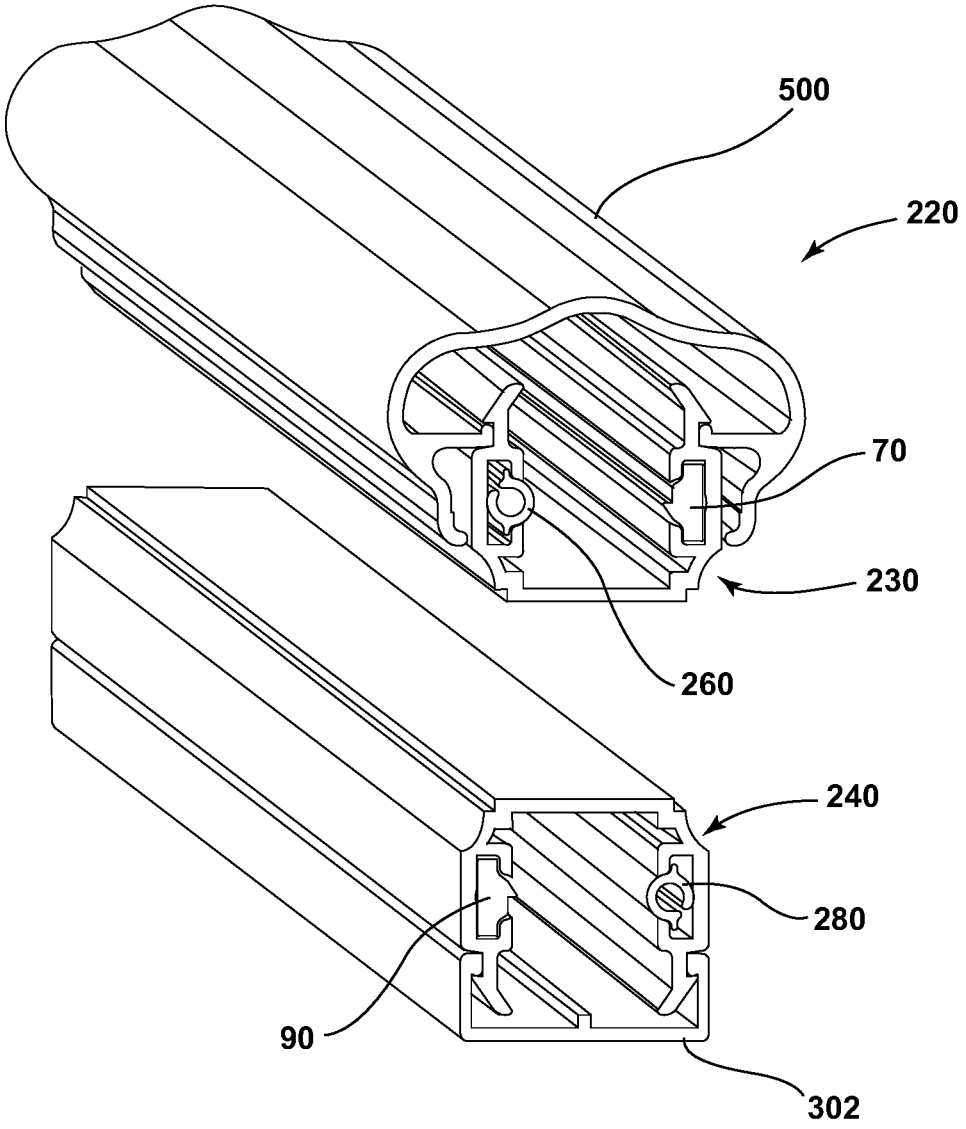
FIGS. 21B-21D illustrate perspective views generally illustrating portions of embodiments of a friction picket system in accordance with teachings of the present disclosure.
Figure 21C:
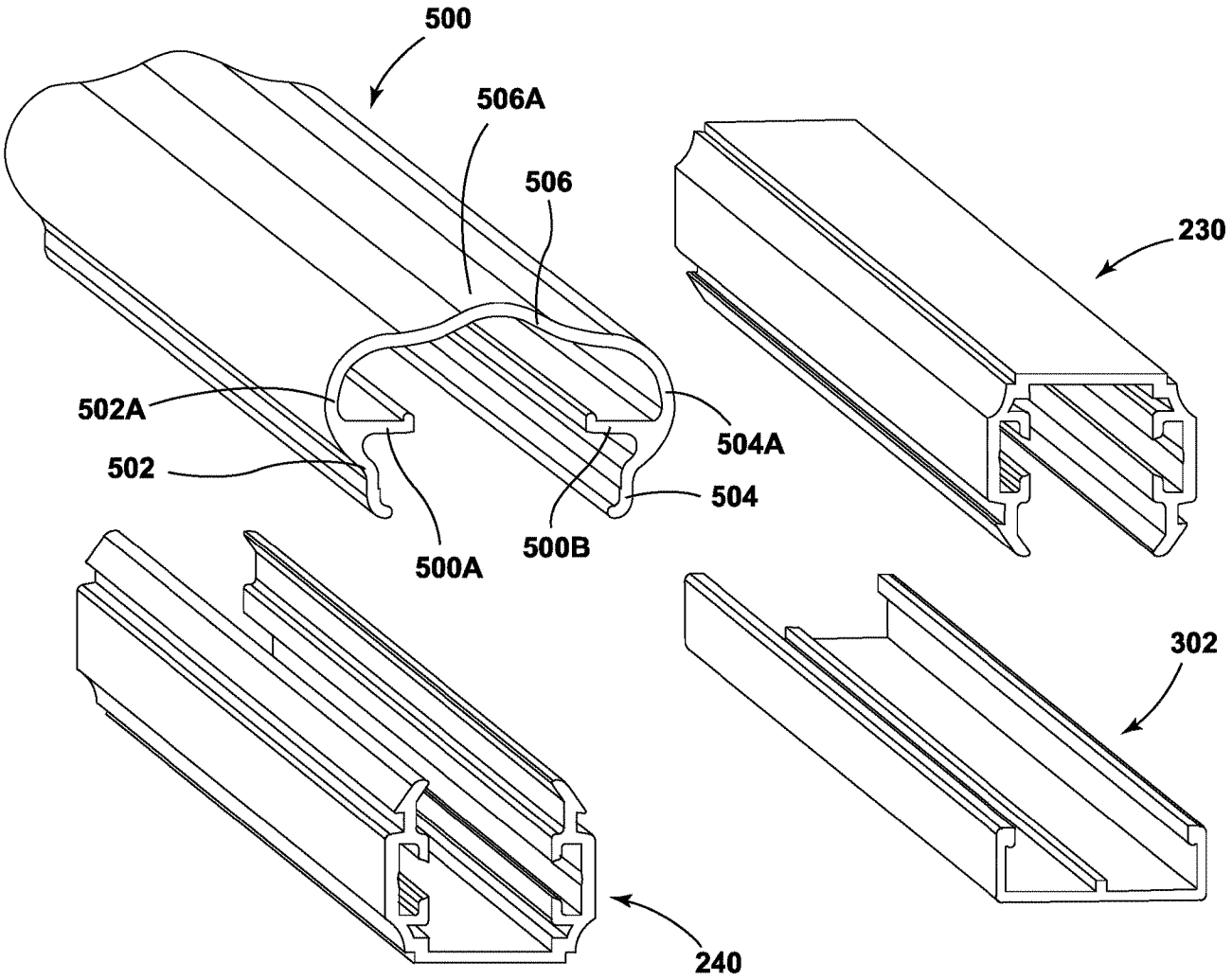
Figure 21D:
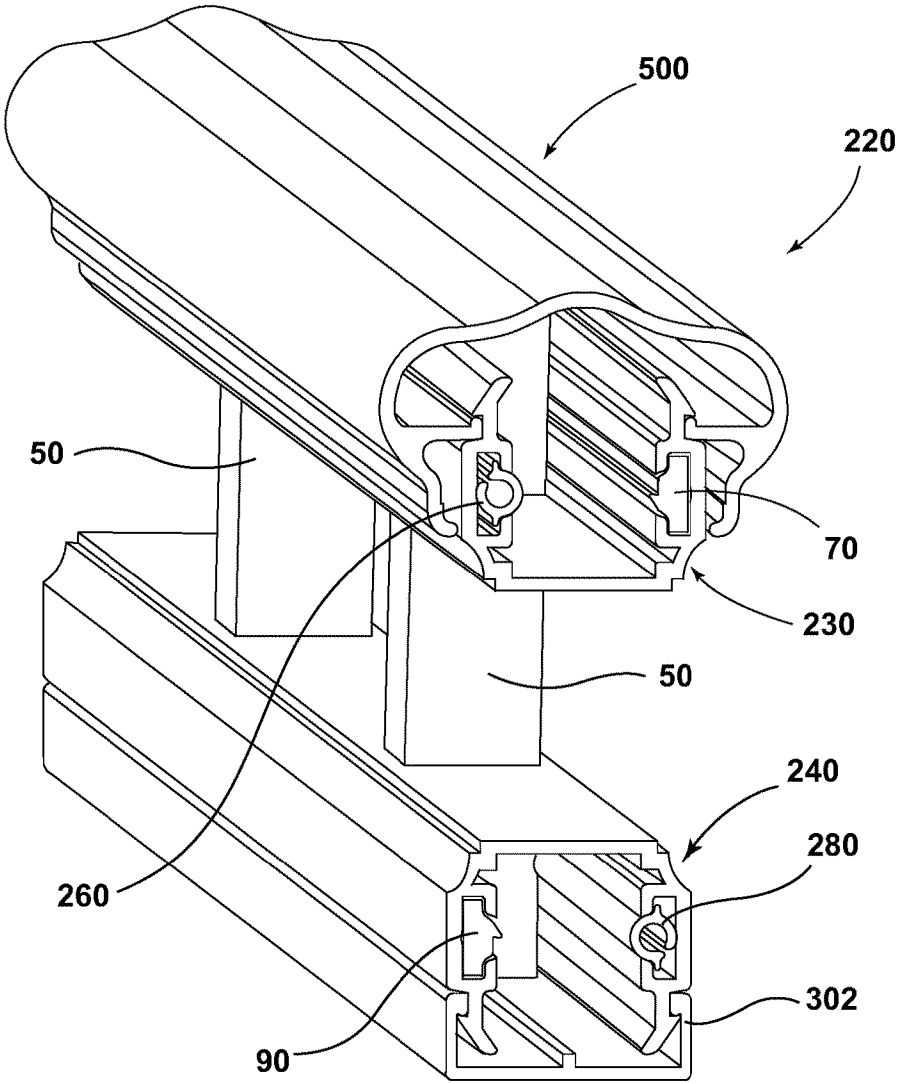

In embodiments, such as generally illustrated in FIGS. 7A-17B, a railing assembly 20 may be at least partially assembled and then shipped in an assembled or partially assembled state. For example, assembling railing assembly 20 may include a first railing portion 30 and/or a second railing portion 40 being formed and then apertures 32, 42 being formed/stamped into first railing portion 30 and/or second railing portion 40 according to a desired configuration of balusters 50 (e.g., number, spacing, residential/commercial building code requirements, size, shape, etc.). Once apertures 32, 42 have been stamped, first retaining elements (e.g., elements 60, 160, 260, 80, 180, 280) may be inserted into channels 34, 44 and/or pressure inserts 70, 90 may be inserted into channels 36, 46 (see, e.g., FIGS. 7A-8B). In embodiments, first retaining elements 60, 160, 260, 80, 180, 280 and/or pressure inserts 70, 90 (and/or corresponding channels 34, 44, 36, 46) may run along the entire length of first railing portion 30 and/or second railing portion 40. As generally illustrated in FIGS. 9A and 9B, a top cover 100 may be coupled (e.g., snapped) to one of first railing portion 30 and second railing portion 40, and a bottom cover 102 may be coupled to the other of first railing portion 30 and second railing portion 40 (e.g., via sliding and/or snapping).

In embodiments, such as generally illustrated in FIGS. 10A-16B, further assembly may be conducted in the field (e.g., at an installation location, such as at or near a customer's stairway). Second railing portion 40 may be disposed on a generally flat/horizontal surface and one or more balusters 50 may be inserted (e.g., one by one, or multiple at one time) into corresponding apertures 42 in second railing portion 40 (see, e.g., FIGS. 10A-11B). Then, first railing portion 30 may be disposed over each baluster 50 (see, e.g., FIGS. 12A and 12B) and pressed down (and/or second railing portion 40 may be pressed up) until each baluster 50 is properly seated in a corresponding aperture 32 (e.g., to form a completed railing assembly 20, such as generally illustrated in FIGS. 13A-16B).

In embodiments, insertion of a baluster 50 into a corresponding aperture 32, 42 may include a first retaining element (e.g., one or more of elements 60, 160, 260, 80, 180, 280) and a pressure insert 70, 90 applying opposing forces to the baluster 50 (e.g., retaining forces that may result from and/or increase friction between the baluster 50 and the first retaining element 60, 160, 260, 80, 180, 280 and/or pressure insert 70, 90). First retaining elements 60, 160, 260, 80, 180, 280 may be configured to bias and/or apply a force to the baluster 50 in a direction of the pressure inserts 70, 90. Additionally or alternatively, first retaining elements 60, 160, 260, 80, 180, 280 may be sufficiently flexible to allow an inserted baluster 50 to rotate to a desired stair angle (e.g., from an initial angle of 0 degrees, relative to vertical, to a desired stair angle that may be between 0 degrees and 40 degrees).

Embodiments of the present disclosure may include one of more of a variety of advantages. For example, and without limitation, railing assemblies 20 may be shipped with an assembled first railing portion 30 (e.g., with a top cover 100, retaining element 60, 160, or 260 and/or pressure insert 70), an assembled second railing portion 40 (e.g., with a bottom cover 102, retaining element 80, 180, or 280 and/or pressure insert 90), and one or more balusters 50. Initially (e.g., during shipping, upon delivery, etc.), the assembled first railing portion 30, the assembled second railing portion 40, and the one or more balusters 50 may not be assembled or operatively connected to each other (see, e.g., FIGS. 17A and 17B). Such a shipping arrangement may allow for smaller packaging relative to, for example, shipping a completed railing assembly 20, which may include balusters 50 inserted into both the first railing portion 30 and the second railing portion 40.

In embodiments, an assembled first railing portion 30, an assembled second railing portion 40, and one or more balusters 50 may be assembled together relatively quickly in the field. For example, and without limitation, balusters 50 may be inserted into and retained by first and second railing portions 30, 40 without any tools or fasteners because the retaining force provided by the first retaining elements (e.g., elements 60 and 80, elements 160 and 180, or elements 260 and 280) and/or pressure inserts 70, 90 may be sufficient to hold balusters 50 in place. Additionally or alternatively, elongated apertures 32, 42 may allow for all of the balusters 50 to be inserted into a second railing portion 40 and/or a first railing portion 30 without regard for the angle of assembly (e.g., the stair angle). In embodiments, once the balusters 50 have been inserted into the first railing portion 30, the railing assembly 20 may be angled to match the stair angle without individual adjustment of the balusters 50, the first railing portion 30, or the second railing portion 40.

In embodiments, such as generally illustrated in FIGS. 18A, 18B, 19A, and 19B, a railing assembly 220 may include a top cover 300 that may be decorative and/or configured for a user to hold, such as when using stairs. Top cover 300 may be connected (e.g., coupled and/or snapped) to a railing portion (e.g., first railing portion 230). In embodiments, top cover 300 may be disposed about a railing portion such that it covers some or all of the railing portion. Top cover 300 may be connected externally to the railing portion. For example, and without limitation, top cover 300 may include protrusions 300A, 300B that may extend toward the railing portion (e.g., horizontally) and/or may be configured to engage with external recesses of the railing portion (e.g., recesses 238A, 238B of first railing portion 230). Additionally or alternatively, a railing assembly 220 may include a bottom cover 302 that may be coupled and/or snapped to a railing portion (e.g., second railing portion 240). In embodiments, cover 302 may be connected with the railing portion externally. For example, and without limitation, bottom cover 302 may include flanges 302A, 302B that may extend toward the railing portion (e.g., vertically) and/or may be configured to engage with external recesses of the railing portion (e.g., recesses 248A, 248B of second railing portion 240).

In embodiments, first railing portion 230 may include one or more apertures 232, a channel 234 (e.g., a generally horizontal channel), which may be defined by protrusions 234A, 234B, and/or a channel 236, which may be defined by protrusion 236A, 236B. Channel 234 may be configured to receive first retaining elements 60, 80, 160, 180, 260, and/or 280. Channel 236 may be configured to receive second retaining elements 70 and/or 90. In embodiments, channels 234, 236 may include the same or similar configurations and may both be configured to receive first retaining elements 60, 80, 160, 180, 260, 280 and/or second retaining elements 70, 90.

In embodiments, second railing portion 240 may include one or more apertures 242, a channel 244 (e.g., a generally horizontal channel), which may be defined by protrusions 244A, 244B, and/or a channel 246, which may be defined by protrusion 246A, 246B. Channel 244 may be configured to receive first retaining elements 60, 80, 160, 180, 260, and/or 280. Channel 246 may be configured to receive second retaining elements 70 and/or 90. In embodiments, channels 244, 246 may include the same or similar configurations and may both be configured to receive first retaining elements 60, 80, 160, 180, 260, 280 and/or second retaining elements 70, 90.

In embodiments, first railing portion 30 may be configured the same or substantially similarly to second railing portion 40. In an assembled configuration, first railing portion 30 and second railing portion 40 may be disposed in a generally mirrored configuration. In embodiments, first railing portion 230 may be configured the same or substantially similarly to second railing portion 240. In an assembled configuration, first railing portion 230 and second railing portion 240 may be disposed in a generally mirrored configuration.

In embodiments, such as generally illustrated in FIGS. 20A, 20B, 20C, and 20D, railing assembly 220 may include a top cover 400 that may be decorative and/or configured for a user to hold, such as when using stairs. Top cover 400 may be connected (e.g., coupled and/or snapped) to a railing portion (e.g., first railing portion 230). In embodiments, top cover 400 may be disposed about a railing portion (e.g., first railing portion 230) such that it covers some or all of the railing portion. Top cover 400 may be connected externally to the railing portion. For example, and without limitation, top cover 400 may include protrusions 400A, 400B that may extend toward the railing portion (e.g., horizontally) and/or may be configured to engage with external recesses of the railing portion (e.g., recesses 238A, 238B of first railing portion 230). Cover 400 may include a first side wall 402, a second side wall 404, and/or a third side wall 406. First side wall 402 and second wall 404 may be disposed opposite each other, may be configured to be disposed on opposite sides of a railing portion (e.g., first railing portion 230), and/or may be connected to each other via third side wall 406. First side wall 402 may be generally vertical, second side wall 404 may be generally vertical, and/or third side 406 wall may be generally horizontal. First side wall 402 and/or second side 404 wall may include a recess (e.g., recesses 402A, 404A). Recesses 402A, 404A may be configured to facilitate gripping of cover 400 and/or railing assembly 220 (e.g., by a user). Recesses 402A, 404A may be aligned with protrusions 400A, 400B, respectively, and/or protrusions 400A, 400B may extend inward from first side wall 402 and second side wall 404 at or about recesses 402A, 404A. In embodiments, third side wall 406 may include a protrusion 406A that may extend generally inward (e.g., between first side wall 402 and second side wall 404) and/or perpendicularly to third side wall 406. Protrusion 406A may be configured to contact a baluster 50 and/or limit an insertion depth of a baluster 50.

In embodiments, such as generally illustrated in FIGS. 21A, 21B, 21C, and 21D, railing assembly 220 may include a top cover 500 that may be decorative and/or configured for a user to hold, such as when using stairs. Top cover 500 may be connected (e.g., coupled and/or snapped) to a railing portion (e.g., first railing portion 230). In embodiments, top cover 500 may be disposed about a railing portion (e.g., first railing portion 230) such that it covers some or all of the railing portion. Top cover 500 may be connected externally to the railing portion. For example, and without limitation, top cover 500 may include protrusions 500A, 500B that may extend toward the railing portion (e.g., horizontally) and/or may be configured to engage with external recesses of the railing portion (e.g., recesses 238A, 238B of first railing portion 230). Cover 500 may include a first side wall 502, a second side wall 504, and/or a third side wall 506. First side wall 502 and second wall 504 may be disposed opposite each other, may be configured to be disposed on opposite sides of a railing portion (e.g., first railing portion 230), and/or may be connected to each other via third side wall 506. First side wall 502 may taper generally outward (e.g., away from axis 20A), second side wall 504 may taper generally outward, and/or third side wall 506 may be generally horizontal. First side wall 502 and/or second side wall 504 may include a curved portion (e.g., curved portions 502A, 504A). Curved portions 502A, 504A may be configured to facilitate gripping of cover 500 and/or railing assembly 220 (e.g., by a user). Curved portions 502A, 504A may be generally convex and/or may extend generally horizontally outward. Curved portions 502A, 504A be aligned with protrusions 500A, 500B, respectively and/or protrusions 500A, 500B may extend inward from first side wall 502 and second side wall 504 at or about curved portions 502A, 504A. In embodiments, third side wall 506 may include a curved portion 506A that may be disposed at or about the middle of third side wall 506. Curved portion 506A may be generally convex and/or may extend generally vertically upward. Curved portions 502A, 504A 506A of first, second, and third side walls 502, 504, 506 may provide cover 500 with a generally crown-shaped cross section.

Figure 22:
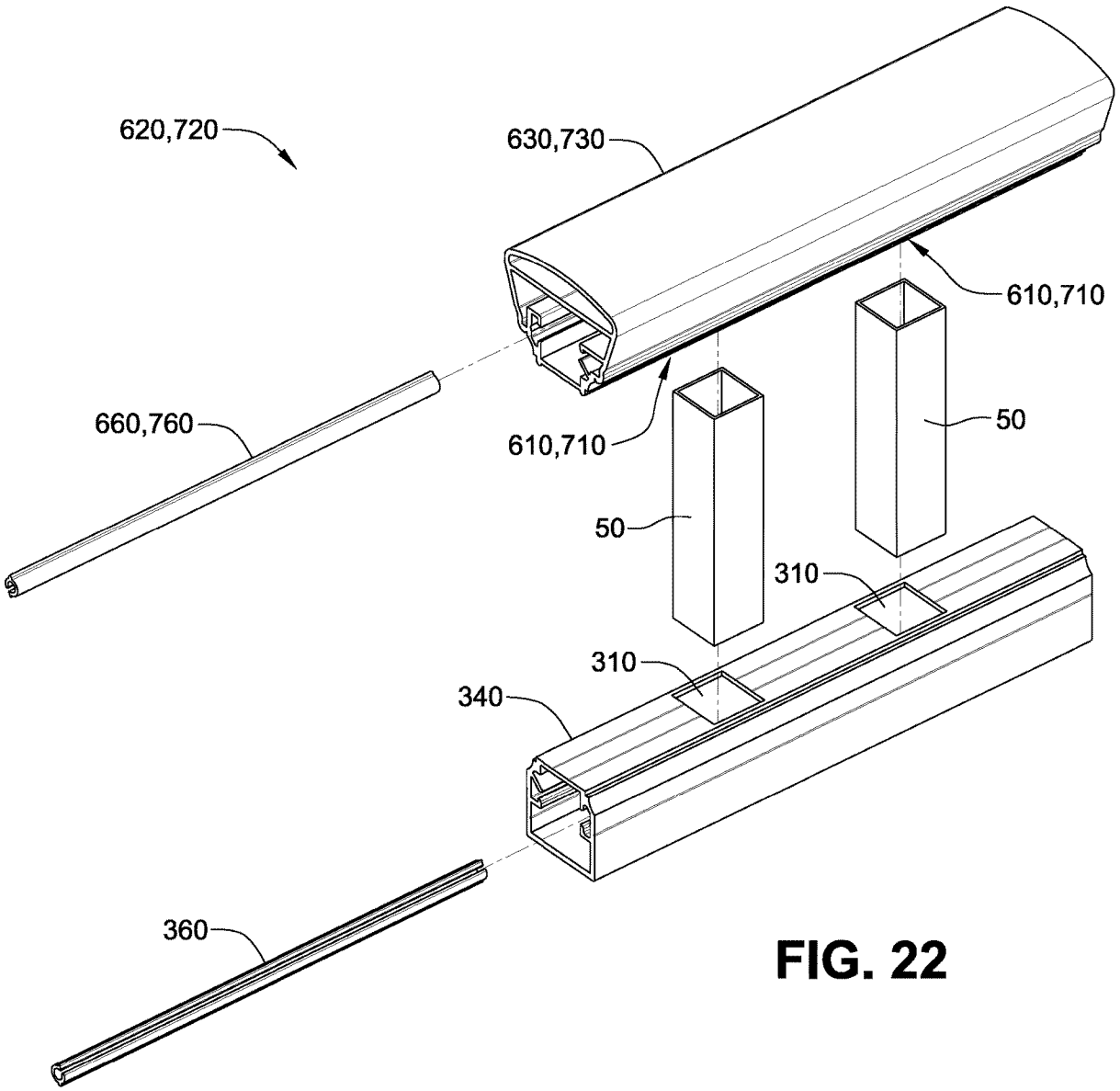
FIG. 22 depicts an exploded view generally illustrating portions of embodiments of a railing assembly in accordance with teachings of the present disclosure.

FIG. 22 depicts a perspective view of a railing assembly, such as a railing assembly 620 or a railing assembly 720. The railing assembly 620, 720 (e.g., a friction picket system) may include one or more unitary railing portions, such as an upper unitary railing portion 630, 730 or a lower unitary railing portion 340 (collectively referred to as unitary railing portions 630, 730, and 340). For instance, the railing assembly 620 can include the railing portion 630 shown in the example of FIG. 23, and the railing assembly 720 can include the railing portion 730 as shown in the example of FIG. 24. One or more balusters 50 may extend between the upper unitary railing portion 630, 730 and the lower unitary railing portion 340. The baluster 50 may be inserted into a corresponding aperture 610, 710 of the upper unitary railing portion 630, 730 and/or into a corresponding aperture 310 of the lower unitary railing portion 340. The corresponding apertures 610, 710, 310 may include one or more of a variety of shapes sizes, and/or configurations. For example, and without limitation, corresponding apertures 610, 710, 310 may include a generally rectangular and/or elongated shape that may correspond to the shape of the baluster 50. In embodiments, the upper unitary railing portion 630, 730 may be disposed generally above the lower unitary railing portion 340, and one or more balusters 50 may support the upper unitary railing portion 630, 730. A retaining element 660, 760, 360, can be located within the respective upper unitary railing portion 630, 730 or lower unitary railing portion 340.

Figure 23:
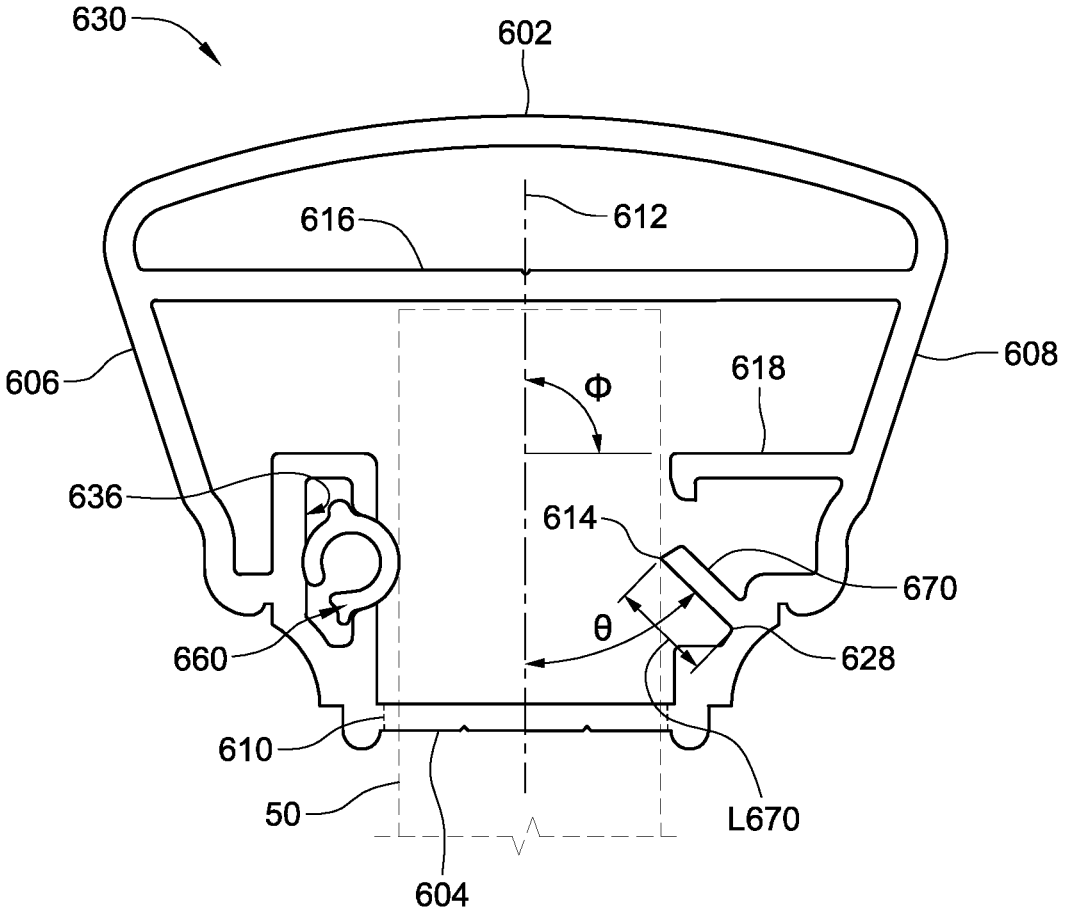
FIGS. 23-25 illustrate cross-sectional views generally illustrating embodiments of a unitary railing portion in accordance with the teachings of the present disclosure.
Figure 24:
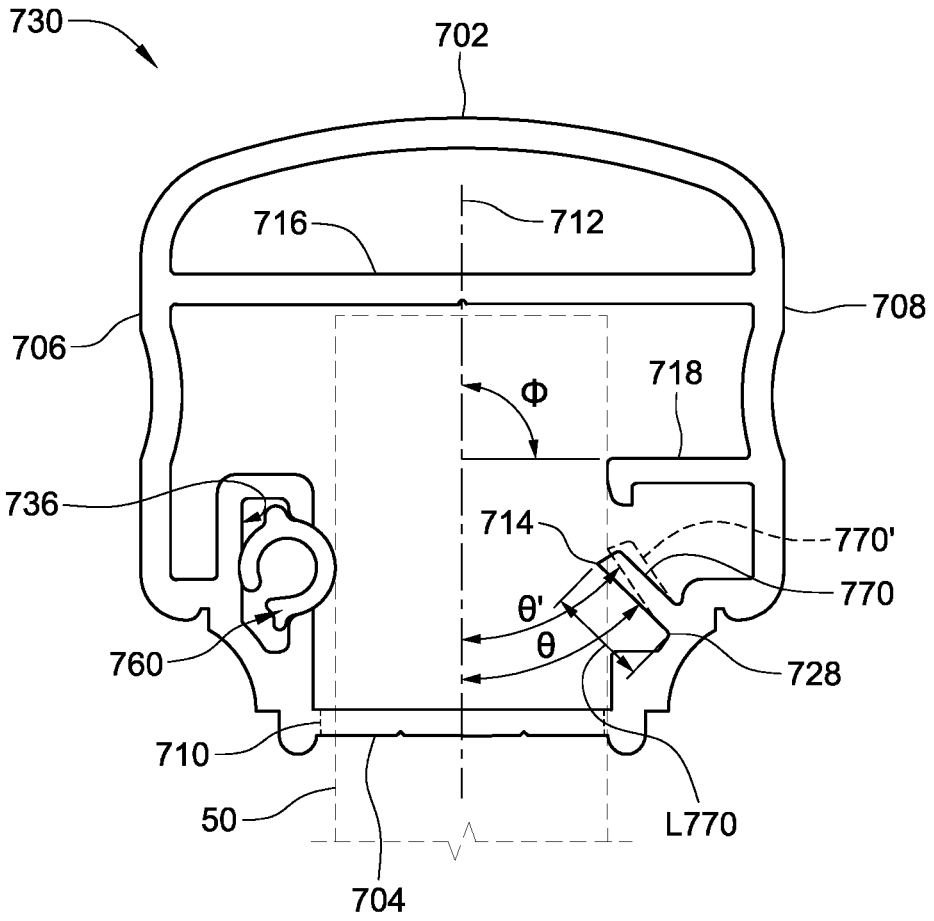
Figure 25:
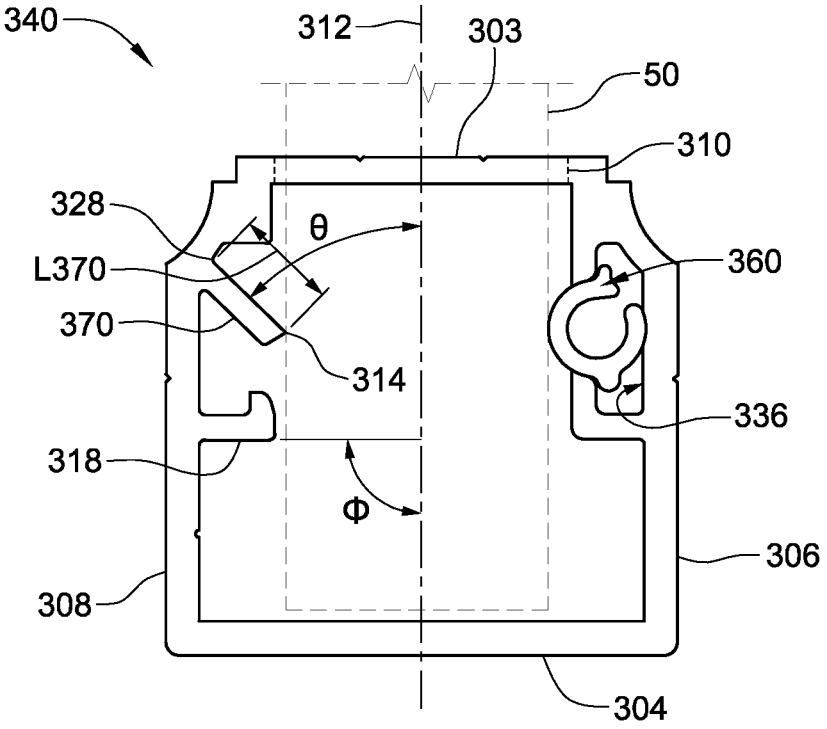

FIGS. 23-25 depict cross section views of respective examples of the upper unitary railing portion 630, 730 and the lower unitary railing portion 340. The unitary railing portion 630, 730, 340 may include a top portion 602, 702, 303; a bottom portion 604, 704, 304; a first side portion 606, 706, 306; and a second side portion 608, 708, 308. The bottom portion 604, 704, 304 may include the aperture 610, 710, 310 configured for inserting the baluster 50 along an axis of insertion 612, 712, 312 between the first side 606, 706, 306 and the second side 608, 708, 308. The unitary railing portion 630, 730, 340 may include a first channel 636, 736, 336 extended from the first side portion 606, 706, 306 and a cantilevered arm 670, 770, 370 extended from the second side portion 608, 708, 308. The channel 636, 736, 336 (e.g., the channel 36, 44 as previously shown and described herein). The retaining element 660, 760, 360 (e.g., the retaining element 260, 280) may be disposed at least partially in the first channel 636, 736, 336. In the examples of FIGS. 23-25. The baluster 50 may be retained between the retaining element 660, 760, 360 and the cantilevered arm 670, 770, 370 of the unitary railing portion 630, 730, 340. For instance, the retaining element 660, 760, 360 and the cantilevered arm 670, 770, 370 may be configured to grip the baluster 50 when the baluster 50 is inserted into the unitary railing portion 630, 730, 340 through the aperture 610, 710, 310 along the bottom portion 604, 704, 304. In an example, the unitary railing portion 630, 730, 340 may frictionally engage the baluster 50. For instance, the baluster 50 may be frictionally engaged between the retaining element 660, 760, 360 and a distal end 614, 714, 314 of the cantilevered arm 670, 770, 370. The unitary railing portion 630 and 730 may be an upper railing portion. As shown in the examples of FIG. 23-25, the unitary railing portion 630, 730, 340 may have different geometries, such as different shapes and sizes, for instance the shapes and sizes of the top portion 602, 702, 303; the bottom portion 604, 704, 304; the first side portion 606, 706, 306; and the second side portion 608, 708, 308. For example, the unitary railing portion 630 of FIG. 23 includes a different outer shape profile than the unitary railing portion 730 of FIG. 24. The different geometries may be configured for various applications. For instance, the geometries may be configured for different size and space requirements, cosmetic preferences, increasing hand grip, strength requirements, combinations thereof, or the like. As previously described, the unitary railing portion 340 in the example of FIG. 25 may be a lower railing portion.

As shown in the example of FIGS. 23-25, the cantilevered arm 670, 770, 370 is extended from the unitary railing portion 630, 730, 340, such as the second side portion 608, 708, 308 of the unitary railing portion 630, 730, 340. The cantilevered arm 670, 770, 370 may be a beam or flange of material extended from the unitary railing portion 630, 730, 340 toward the axis of insertion 612, 712, 312 of the baluster 50. In various examples, the cantilevered arm 670, 770, 370 may extend along a portion or the entire length of the unitary railing portion 630, 730, 340. A length L670, L770, L370 and position of the cantilevered arm 670, 770, 370 may be configured so the distal end 614, 714, 314 of the cantilevered arm 670, 770, 370 is in contact with the baluster 50 when the baluster 50 is inserted into the unitary railing portion 630, 730, 340. In an example, the distal end 614, 714, 314 may include a force concentration edge configured to frictionally engage the baluster 50. In an example, the force concentration edge may be at least partially embed into the baluster 50 to increase the friction between the baluster 50 and the cantilevered arm 670, 770, 370. The cantilevered arm 670, 770, 370 may be extended from the unitary railing portion 630, 730, 340 at an angle of incidence ⊖ with respect to the axis of insertion. In some examples, the angle of incidence ⊖ may range from 0 to 90 degrees, 30 to 60 degrees, 40 to 50 degrees, or the like. In various examples, the angle of incidence ⊖ and the length L670, L770, L370 of the cantilevered arm 670, 770, 370 respectively may be configured to be biased by insertion of the baluster 50. Accordingly, the cantilevered arm 670, 770, 370 may exert force on the baluster 50, and the baluster 50 may be griped between the retaining element 660, 760, 360 and the cantilevered arm 670, 770, 370. For example, the retaining element 660 may push the baluster 50 against the cantilevered arm 670 to help stabilize the baluster 50 and, depending on the shape of the distal end 614 of the cantilevered arm 670 and the angle of incidence ⊖, inhibit or prevent removal of the baluster 50 from the unitary railing portion 630, 730, 340. In some examples, the cantilevered arm 670, 770, 370 can be hingedly attached to (or integrally formed with) the unitary railing portion 630, 730, 340 and biased toward the axis of insertion 612 by a spring or other biasing element.

In some examples, the cantilevered arm 670, 770, 370 may be configured to bend with respect to the unitary railing portion 630, 730, 340 when the baluster 50 is inserted into the unitary railing portion 630, 730, 340. For instance, the cantilevered arm 670, 770, 370 may bend at a junction 628, 728, 328 of the cantilevered arm 670, 770, 370 and the second side portion 608, 708, 308 or may bend along the length L670, L770, L370 of the cantilevered arm 670, 770, 370. As shown in the example of FIG. 24, the cantilevered arm 770 can be placed in two configurations. The cantilevered arm 770 is in a first configuration (shown in solid lines in FIG. 24) when the baluster 50 is not inserted into the unitary railing portion 730. When the baluster is inserted into the unitary railing portion 730, the cantilevered arm 770' can be displaced (e.g., returnably/temporarily or plastically/permanently bent, deflected, or moved) into a second configuration (shown in phantom in FIG. 24). For instance, in the first configuration, the angle of incidence ⊖ can be a lower value than the angle of incidence ⊖' of the second configuration. In the second configuration, stress within the cantilevered arm 770 can bias the cantilevered arm 770 toward the channel 736 or the retaining element 760.

In an example, the cantilevered arm 670, 770, 370 may be configured to bend in a first direction (e.g., upward as depicted in the examples of FIGS. 22 and 23) to provide clearance for the baluster 50 when inserted. The cantilevered arm 670, 770, 370 may be configured to bend in an opposing second direction to increase the frictional engagement between the baluster 50 and the unitary railing portion 630, 730, or 340 upon withdrawal of the baluster 50. Thus, the cantilevered arm 670, 770, 370 may bend away from the baluster 50 during insertion and may bend toward the baluster 50 as the baluster 50 is being removed. When the baluster 50 is bent toward the baluster 50, the grip between the cantilevered arm 670, 770, 370 and the baluster 50 may be increased, for instance, as a result of increased friction. The amount of grip, the amount of force to insert the baluster 50, and the amount of force to remove the baluster 50 may be based on various factors, such as the length of the cantilevered arm 670, 770, 370; the angle of incidence ⊖, the shape of the cantilevered arm 670, 770, 370; the shape of the distal end 614, 714, 314; or the like. Accordingly, the force to insert the baluster 50 may be less than the force to remove baluster 50. In a further example, configuring the cantilevered arm 670, 770, 370 to deflect elastically (e.g., within the elastic range of the stress/strain characteristics of the cantilevered arm) may mitigate loss of grip between the unitary railing portion 630, 730, 340 and the baluster 50 as a result of stress relaxation over time.

The cantilevered arm 670, 770, 370 may provide greater railing stiffness, and thus less flex in the unitary railing portion 630, 730, 340 and, in some examples, the railing assembly 620, 720. For instance, the cantilevered arm 670, 770, 370 may increase the area moment of inertia of the unitary railing portion 630, 730, 340. Accordingly, the force to bend the unitary railing portion 630, 730, 340 in a direction transverse to the longitudinal direction may be increased. In another example, integrating the cantilevered arm 670, 770, 370 into the unitary railing portion 630, 730, 340 may reduce the number of parts and assembly required. As shown in the examples of FIGS. 23-25, the cantilevered arm 670, 770, 370 may be included in other railing portions, such as the railing portions in the examples of FIGS. 1-21. In some examples, the cantilevered arm 670, 770, 370 may be separable from the unitary railing portion 630, 730, 340 and may be fitted into a channel of the railing portion 630, 730, 340 to attach the cantilevered arm 670, 770, 370 to the railing portion 630, 730, 340.

In some examples, as shown in FIGS. 23-25, the unitary railing portion 630, 730, 340 may be a single-piece. For instance, the top portion 602, 702, 303, bottom portion 604, 704, 304, first side portion 606, 706, 306, and second side portion 608, 708, 308 may be constructed as a single-piece. In a further example, the channel 636, 736, 336 and the cantilevered arm 670, 770, 370 may be a single-piece with the top portion 602, 702, 303; bottom portion 604, 704, 304; first side portion 606, 706, 306; and second side portion 608, 708, 308. In some examples, the unitary railing portion 630, 730, 340 may include a structural beam 616, 716 extended across a lateral cross section of the unitary railing portion 630, 730, 340 from the first side portion 606, 706, 306 to the second side portion 608, 708, 308. In an example, the single-piece construction can be formed by extrusion. For instance, the unitary railing portion 630, 730, 340 can be an extruded profile. The single-piece construction may provide greater railing stiffness, and thus less flex in the unitary railing portion 630, 730, 340 as compared to other configurations, such as multi-part configurations. In some examples, the single-piece construction may provide greater stiffness and less flex in the railing assembly 620, 720 as a whole.

In some examples, the single-piece construction may reduce the number and size of gaps within the railing assembly 620, 720. For instance, looking to the example of FIGS. 10A-B, 12A-B, 16A-B, 18A-B, or 20A-B a gap between a flange (e.g., the flange 38A, B) of a first railing portion (e.g., first railing portion 30) and protrusion (e.g., the protrusion 100A, B) of a top cover (e.g., top cover 100) may be eliminated. Eliminating the gap between the first railing portion and the top cover may decrease the amount of flex of the upper ends (e.g., flanges 38A, 38B) of the first railing portion when the baluster 50 is inserted. For instance, the gap permits upper ends of the first railing portion in the examples of FIGS. 10A-B, 12A-B, or 16A-B to spread apart when the baluster 50 is inserted. In other words, the upper ends of the first railing portion (unrestrained as a result of the gap) may spread apart as the reaction force between the retaining element (e.g., retaining element 260, 280) and the pressure insert (e.g., pressure insert 70) is generated by the insertion of the baluster 50. Accordingly, the grip on the baluster 50 between the retaining element (e.g., retaining element 60 of the example of FIGS. 1A-D) and the pressure insert (e.g., pressure insert 70 of the example of FIGS. 1A-D) may be reduced by the deflection of the upper ends. Where the unitary railing portion 630, 730, 340 includes a single piece construction (as depicted in the examples of FIGS. 23-25), the deflection of the unitary railing portion 630, 730, 340 resulting from insertion of the baluster 50 is reduced, resulting in an increase in the grip on the baluster 50.

The gap, such as the example of FIGS. 10A-B, 12A-B, 16A-B, 18A-B, or 20A-B, may add to the amount of flex the railing portion and the railing assembly when a load is applied. In the examples of FIGS. 23-25, the unitary railing portion 630, 730, 340 includes the single-piece construction. Thus, the gap is eliminated and the amount of flex of the unitary railing portion 630, 730, 340 and the railing assembly 620, 720, may be reduced when load is applied. Accordingly, the single-piece construction of the unitary railing portion 630, 730, 340 increases the stiffness of the unitary railing portion 630, 730, 340 as compared to multi-part designs.

As shown in the examples of FIGS. 23-25, a support rib 618, 718, 318 may be extended from the second side portion 608, 708, 308 of the unitary railing portion 630, 730, 340. The support rib 618, 718, 318 may be located along the second side portion 608, 708, 308 at a position between the cantilevered arm 670, 770, 370 and the top portion 602, 702, 303. The support rib 618, 718, 318 may guide the insertion of the baluster 50, and the baluster 50 may be supported between the retaining element 660, 760, 360 on a first side, and on the second side one or more of the support rib 618, 718, 318; the cantilevered arm 670, 770, 370; or a combination thereof. In an example, the support rib 618, 718, 318 may limit the amount of deflection (e.g., bending) of the cantilevered arm 670, 770, 370 when the baluster 50 is inserted into the unitary railing portion 630, 730, 340. In the examples of FIGS. 23-25, the support rib 618, 718, 318 may be disposed horizontally from the second side portion 608, 708, 308 (e.g., perpendicular to the axis of insertion 612, 712, 312 of the baluster 50). In other examples, the support rib 618, 718, 318 may be disposed at an approach angle $\phi$ with respect to the axis of insertion 612, 712, 312, the approach angle $\phi$ including, but not limited to, a range of 0 to 90 degrees, 30 to 60 degrees, 45 to 55 degrees, or the like.

In an example, the support rib 618, 718, 318 may be a single-piece construction with the unitary railing portion 630, 730, 340. The support rib 618, 718, 318 may increase the area moment of inertia of the unitary railing portion 630, 730, 340. Accordingly, the support rib 618, 718, 318 may provide greater railing stiffness, and thus reduce the amount of flex in the unitary railing portion 630, 730, 340 when under load. For instance, the support rib 618, 718, 318 may be configured to increase the lateral stiffness of the unitary railing portion 630, 730, 340 (e.g., along a direction transverse to the longitudinal axis of the unitary railing portion 630, 730, 340). In a further example, the support rib 618, 718, 318 may provide greater railing stiffness, and thus reduce the amount of flex, in the railing assembly 620, 720 as a whole. In the examples of FIGS. 23-25, the unitary railing portion 630, 730, 340 and the corresponding railing assemblies including the cantilevered arm 670, 770, 370; the support rib 618, 718, 318; or a combination thereof, may deflect less than one-inch under the application of 1500 lbs. of lateral force, in accordance with the International Code Council (ICC) Acceptance Criteria for Handrails and Guards 273 (AC273) (Approved June 2017).

Figure 26:
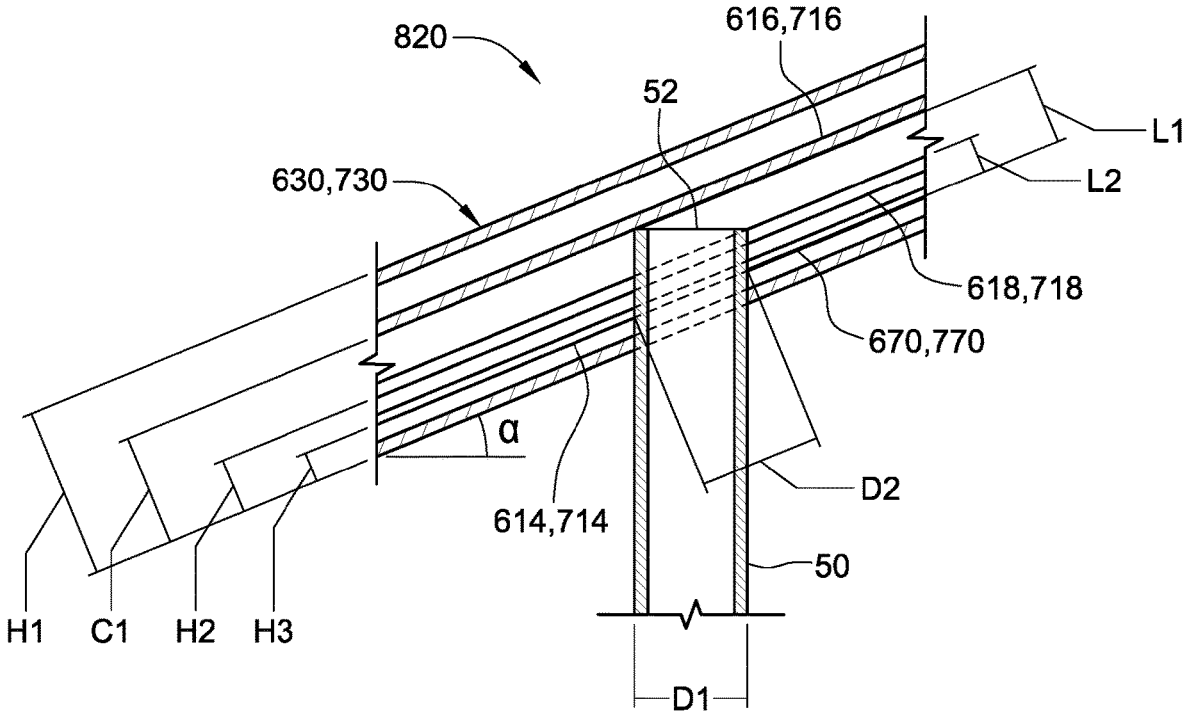
FIG. 26 depicts a cross-sectional view of a railing assembly in a stairway configuration.

FIG. 26 depicts an example of a railing assembly 820 in a stairway configuration. For instance, the unitary railing portion 630, 730, 340 may be slanted at a staircase angle $\alpha$ for ascending or descending stairs. The railing assembly 820 can include a first unitary railing portion (e.g., unitary railing portion 630, 730), a second unitary railing portion (e.g., unitary railing portion 340), or both. In an example, the unitary railing portion 630, 730 can be upper railing portion, and the unitary railing portion 340 can be a lower railing portion. In some examples, the staircase angle $\alpha$ may include, but is not limited to an angle between 0 degrees, 40 degrees, or a staircase angle $\alpha$ therebetween. The baluster 50 may be positioned substantially vertically and inserted into the first unitary railing portion 630, 730 and the second unitary railing portion 340. As shown in the example of FIG. 26, the unitary railing portion, such as the first unitary railing portion 630, 730 may include a height H1. A height of the cavity C1 may accommodate the baluster 50 within the unitary railing portion 630, 730, 340.

As the first unitary railing portion 630, 730 and the second unitary railing portion 340 are rotated with respect to the baluster 50, an insertion length L1 of the baluster 50 on a first side may be greater than an insertion length L2 of the baluster 50 on a second side. As shown in the example of FIG. 26, the insertion lengths L1, L2 can be the distance between the upper end 52 of the baluster 50 and the distal end 614, 714, 314 of the cantilevered arm 670, 770, 370. The insertion lengths L1 and L2 may be based on the staircase angle $\alpha$ of the first unitary railing portion 630, 730 and the second unitary railing portion 340 as well as a width dimension D1 of the baluster 50. In the example of the railing assembly 820 of FIG. 26, the height of the cavity C1 may be greater than the insertion length L1 and L2. Accordingly, a length of engagement between the baluster 50 and the cantilevered arm 670, 770, 370 (e.g., engagement dimension D2) can be greater than the dimension of the baluster D1. For instance, the engagement dimension D2 can be increased along the longitudinal direction of the unitary railing portion 630, 730 as the staircase angle $\alpha$ is increased. In a further example, the single-piece construction of the unitary railing portion 630, 730, 340 may increase the amount of space within the unitary railing portion 630, 730, 340 that is available for the cavity C1. As such, the single-piece construction of the unitary railing portion 630, 730, 340 can, in some instances, increase the amount of the baluster 50 that is in contact between the retaining element 660, 760, 360 and the cantilevered arm 670, 770, 370, and may correspondingly increase the grip between the unitary railing portion 630, 730 and the baluster 50.

It should be understood that references to a single element are not so limited and may include one or more of such element. It should also be understood that the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present teachings not be limited to the particular examples illustrated by the drawings and described in the specification as the best mode presently contemplated for carrying out the teachings of the present disclosure, but that the scope of the present disclosure will include any embodiments falling within the foregoing description and the appended claims.

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it may be appreciated that the specific structural and functional details disclosed herein may be representative and do not necessarily limit the scope of the embodiments.

Reference throughout the specification to "various embodiments," "embodiments," "one embodiment," or "an embodiment," or the like, means that a particular feature, structure, or characteristic described in connection with the embodiment is included in at least one embodiment. Thus, appearances of the phrases "in various embodiments," "in embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional. Any directional references (e.g., plus, minus, upper, lower, upward, downward, left, right, leftward, rightward, top, bottom, above, below, vertical, horizontal, clockwise, and counterclockwise) are used for identification purposes to aid the reader's understanding of the present disclosure, and do not create limitations, particularly as to the position, orientation, or use of embodiments.

Although only certain embodiments have been described above with a certain degree of particularity, those skilled in the art could make numerous alterations to the disclosed embodiments without departing from the scope of this disclosure. Joinder references (e.g., attached, coupled, connected, and the like) are to be construed broadly and may include intermediate members between a connection of elements, relative movement between elements, and/or various types of connections. As such, joinder references do not necessarily imply that two elements are directly connected/coupled and in fixed relation to each other. The use of "e.g." throughout the specification is to be construed broadly and is used to provide non-limiting examples of embodiments of the disclosure, and the disclosure is not limited to such examples. It is intended that all matter contained in the above description or shown in the accompanying drawings shall be interpreted as illustrative only and not limiting. Changes in detail or structure may be made without departing from the present disclosure.

What is claimed is:

1. A unitary railing portion for a railing assembly, the unitary railing portion comprising:

a top portion, a bottom portion, a first side portion, and a second side portion, wherein the bottom portion includes at least one aperture configured for inserting a baluster along an axis of insertion between the first side portion and the second side portion;

a channel extended from the first side portion;

a cantilevered arm extended from the second side portion;

a retaining element disposed at least partially in the channel; and wherein the retaining element and the cantilevered arm, in combination, are configured to retain the baluster relative to the unitary railing portion.

2. The unitary railing portion of claim 1, wherein the unitary railing portion is configured to frictionally engage the baluster between the retaining element and a distal end of the cantilevered arm.

3. The unitary railing portion of claim 2, wherein the distal end includes a force concentration edge configured to frictionally engage the baluster.

4. The unitary railing portion of claim 1, wherein the cantilevered arm is disposed at an angle of incidence with respect to the axis of insertion of the baluster.

5. The unitary railing portion of claim 4, wherein the cantilevered arm is configured to be biased by insertion of the baluster and accordingly generate force on the baluster.

6. The unitary railing portion of claim 1, wherein the cantilevered arm is configured to bend with respect to the unitary railing portion.

7. The unitary railing portion of claim 6, wherein the cantilevered arm is configured to bend in a first direction to provide clearance for the baluster when inserted and is configured to bend in an opposing second direction to increase the frictional engagement between the baluster and the unitary railing portion during withdrawal of the baluster.

8. The unitary railing portion of claim 1, wherein the top portion, the bottom portion, the first side portion, the second side portion, the channel, and the cantilevered arm are a single-piece.

9. The unitary railing portion of claim 8, wherein the unitary railing portion includes a structural beam extended across a lateral cross section of the unitary railing portion from the first side portion to the second side portion.

10. The unitary railing portion of claim 1, further comprising a support rib extended from the second side portion, the support rib located between the cantilevered arm and the top portion, wherein the support rib is configured to provide lateral stiffness to the unitary railing portion and configured to support the baluster within the unitary railing portion.

11. The unitary railing portion of claim 10, wherein the support rib is configured to limit an amount of deflection of the cantilevered arm when the baluster is inserted into the unitary railing portion.

12. A railing assembly comprising:

a first unitary railing portion including:

a top portion, a bottom portion, a first side portion, and a second side portion, wherein the bottom portion includes at least one aperture configured for inserting a baluster along an axis of insertion between the first side portion and the second side portion, a first channel extended from the first side portion, and a cantilevered arm extended from the second side portion;

a retaining element disposed at least partially in the first channel; and a baluster including a first end and a second end, the first end located through the aperture and frictionally engaged between the retaining element and the cantilevered arm.

13. The railing assembly of claim 12, wherein the distal end includes a force concentration edge configured to frictionally engage the baluster.

14. The railing assembly of claim 12, wherein the cantilevered arm is disposed at an angle of incidence with respect to the axis of insertion of the baluster.

15. The railing assembly of claim 14, wherein the angle of incidence and a length of the cantilevered arm are configured to be biased by insertion of the baluster to exert force on the baluster.

16. The railing assembly of claim 12, wherein the cantilevered arm is configured to bend with respect to the first unitary railing portion.

17. The railing assembly of claim 16, wherein the cantilevered arm is configured to bend in a first direction to provide clearance for the baluster when inserted and is configured to bend in an opposing second direction to increase the frictional engagement between the baluster and the first unitary railing portion during withdrawal of the baluster.

18. The railing assembly of claim 12, wherein the top portion, the bottom portion, the first side portion, the second side portion, the first channel, and the cantilevered arm are a single-piece.

19. The railing assembly of claim 12, further comprising a support rib extended from the second side portion, wherein the support rib is configured to limit an amount of deflection of the cantilevered arm when the baluster is inserted into the first unitary railing portion.

20. The railing assembly of claim 12, further comprising a second unitary railing portion, wherein the second unitary railing portion includes:

a second channel disposed on a side portion of the second unitary railing portion;

a retaining element disposed in the second channel;

a second cantilevered arm extended from an opposing side of the second unitary railing portion; and wherein the baluster is located through an aperture of the second unitary railing portion and frictionally engaged between the second retaining element and the second cantilevered arm.

* * * * *